US006362793B1

(12) United States Patent
Sawamura et al.

(10) Patent No.: US 6,362,793 B1
(45) **Date of Patent: *Mar. 26, 2002**

(54) ANTENNA DEVICE AND PORTABLE RADIO SET

(75) Inventors: Masatoshi Sawamura; Yoshiki Kanayama, both of Saitama; Yuichiro Saito, Chiba, all of (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/633,764

(22) Filed: Aug. 7, 2000

(30) Foreign Application Priority Data

Aug. 6, 1999 (JP) ..... 11-224265

(51) Int. Cl.[7] ..... H01Q 1/24; H01Q 1/36
(52) U.S. Cl. ..... 343/702; 343/895; 343/725
(58) Field of Search ..... 343/702, 895, 343/725, 729, 850, 853, 852, 859, 860, 865; H01Q 1/24, 1/36

(56) References Cited

U.S. PATENT DOCUMENTS 6,075,488 A * 6/2000 Hope ..... 343/702
6,097,341 A * 8/2000 Saito ..... 343/702
6,097,349 A * 8/2000 Sanford ..... 343/859

* cited by examiner

*Primary Examiner*—Hoanganh Le
(74) *Attorney, Agent, or Firm*—Jay H. Maioli

(57) ABSTRACT

An antenna in which first and second antenna elements are selected by a switching apparatus so that the first and the second antenna elements are connected to an unbalanced transmission line via a balancing-unbalancing transmission line or only the first antenna element is connected to the unbalanced transmission line. The unbalanced transmission line supplies power via a balanced-to-unbalanced transformation apparatus to the first and the second antenna elements, so as to operate as an antenna, at which time, balanced-to-unbalanced transformation action of the balanced-to-unbalanced transformation apparatus prevents leakage current from flowing from the first or the second antenna element to the unbalanced transmission line and prevents a ground element on which the unbalanced transmission line is grounded from operating as an antenna. This reduces deterioration of antenna characteristics in the vicinity of a human body, so that an antenna device and portable radio set which can sizably reduce deterioration of communication quality can be realized.

18 Claims, 53 Drawing Sheets

FIRST ANTENNA ELEMENT

SECOND ANTENNA ELEMENT

ANTENNA

GROUND MEMBER

FIRST ANTENNA ELEMENT

SECOND ANTENNA ELEMENT

ANTENNA DEVICE AND PORTABLE RADIO SET

BACKGROUND OF THE INVENTION

1. Field of the Invention

The present invention relates to an antenna device and a portable radio set, and more particularly, is suitably applied to those such as a cellular telephone, etc.

2. Description of the Related Art

The cellular telephone of this type has been decreased in size and weight so far in order to improve the portability. Thereby, a retracting/pulling out type of whip antenna device is positively developed as an antenna device provided for a cellular telephone. There is a cellular telephone configured as shown in FIGS. 1A and 1B as the cellular telephone of the above type.

In case of a cellular telephone 1 having the above configuration, a retracting/pulling out type of whip antenna device 3 is provided for a housing 2 made of a non-conductive member such as synthetic resin.

The antenna device 3 has an antenna section 6 provided with a rod antenna 4 made of a conductive wire rod and a helical antenna 5 formed by helically winding a conductive wire rod. The antenna section is set so as to be freely retracted and pulled out along a direction in which the antenna section 6 is pushed into the housing 2 shown by an arrow a at the upper end 2A of the housing 2 (this direction is hereafter referred to as retracting direction) and inversely, along a direction in which the section 6 is pulled out of the housing 2 (this direction is hereafter referred to as pull-out direction).

In the antenna section 6, a first power-supply member 7 made of a conductive member and having a protrusion 7A is electrically and mechanically connected to the lower end of the rod antenna 4 and a connecting portion 8 made of a non-conductive member is mechanically connected to the upper end of the rod antenna 4.

Moreover, a second power-supply member 9 made of a conductive member is electrically and mechanically connected to the lower end of the helical antenna 5 and mechanically connected to the connecting portion 8. Thereby, in the antenna section 6, the rod antenna 4 and the helical antenna 5 are mechanically connected each other by the connecting portion 8 but they are electrically separated from each other.

Moreover, the rod antenna 4 is covered with an antenna cover for the rod 10 and the helical antenna 5 is stored in a cap-shaped antenna cover for the helical 11 so that the antennas 4 and 5 do not directly contact a user.

A circuit substrate (not illustrated) on which various circuit devices including a transmission-reception circuit 12 and a matching circuit 13 are mounted and a shielding case serving as a ground member made of a conductive member for covering the circuit substrate are stored in the housing 2.

Moreover, an antenna power-supply terminal 14 made of a conductive member electrically connected to the matching circuit 13 is set inside of the upper end 2A of the housing 2 and only either of the rod antenna 4 and helical antenna 5 is electrically connected to the antenna power-supply terminal 14 when the antenna section 6 is retracted or pulled out.

Actually, in the antenna device 3, the antenna cover for the helical 11 is pushed in the retracting direction and made to contact the upper end 2A of the housing 2 to push the rod antenna 4 into the housing 2 and retract the rod antenna 4 in the housing 2 and electrically connect the second power-supply member 9 to the antenna power-supply terminal 14.

In addition, in this antenna device 3, under this state, the transmission-reception circuit 12 supplies the helical antenna 5 with power sequentially via the matching circuit 13, the antenna power supply terminal 14 and the second power supply member 9 so as to operate this helical antenna 5 as an antenna.

In addition, in this antenna device 3, at this time the rod antenna 4 is electrically separated from the antenna power supply terminal 14 by the connection section 8 so that it will not operate as an antenna.

On the other hand, in the antenna device 3, when the second antenna cover 11 is pulled in the direction to be pulled out under the state that the rod antenna 4 is retracted inside the housing 2, the rod antenna 4 is pulled toward outside from the upend 2A of this housing 2 and then the protrusion 7A of the first power supply member 7 is thrust onto the antenna power supply terminal 14 to bring this first power supply member 7 into electrical connection with the antenna power supply terminal 14.

In addition, in this antenna device 3, the transmission-reception circuit 12 supplies the rod antenna 4 with power sequentially via the matching circuit 13, the antenna power supply terminal, and the first power supply member 7 so as to operate this helical antenna 4 as an antenna.

Furthermore, in the antenna device 3, by electrically separating the helical antenna 5 from the antenna power-supply terminal 14 by the connecting portion 8, the antenna 5 is not operated as an antenna.

In this connection, to make the rod antenna 4 and helical antenna 5 operate as antennas, the impedances of the rod antenna 4 and helical antenna 5 are matched with the impedance of the unbalanced transmission line 16 by the matching circuit 13.

Moreover, the shielding case functions as ground for various circuit devices and moreover functions as an electrical shielding plate for preventing radio waves of external noise and radio waves emitted from the antenna section 6 from entering various circuit devices mounted on a circuit substrate.

Thereby, the cellular telephone 1 makes it possible to, at the time of pulling out the antenna section 6, transmit a transmission signal configured of a high-frequency signal from the transmission-reception circuit 12 to the rod antenna 4 through the matching circuit 13, transmit the transmission signal to a base station (not illustrated) through the rod antenna 4, and transmit a reception signal configured of a high-frequency signal transmitted from the base station and received by the rod antenna 4 to the transmission-reception circuit 12 through the matching circuit 13.

Moreover, the cellular telephone 1 makes it possible to prevent the portability of the rod antenna 4 from damaging by retracting the antenna 4 in the housing 2 at the time of retracting the antenna section 6, transmit a transmission signal from the transmission-reception circuit 12 to the helical antenna 5 through the matching circuit 13 under the above state, transmit the transmission signal to a base station through the helical antenna 5, and transmit a reception signal transmitted from the base station and received by the helical antenna 5 to the transmission-reception circuit 12 through the matching circuit 13.

Incidentally, in such a cellular telephone 1, multi-path phasing could take place when signals transmitted from a base station are received. Thus, as such a cellular telephone there is the one that is provided with an antenna device of a diversity reception system.

Here, FIG. 2 shows a basic configuration of the antenna device 15 of a diversity reception system, and for reception two antenna elements 16 and 17, for example, are provided, and these antenna elements 16 and 17 are brought into electrical connection with the switch 20 via the matching circuits 18 and 19 respectively, and the switch 20 is electrically connected with the reception circuit (not shown).

In addition, in this antenna device 15, the levels of the reception signals received by these two antenna elements 16 and 17 periodically are compared, and based on the result of this comparison, the switch 20 undergoes switch control to switch the antenna element 16 or 17 to be used for reception. Thus, the reception signal with a high level is selectively received so that multi-path phasing is reduced.

Incidentally, FIG. 3A as well as 3B where the same symbols for parts as in FIG. 1A as well as 1B corresponds each other shows a cellular telephone 22 which is provided with an antenna device 21 of a diversity reception system.

Such an antenna device 21 has a predetermined built-in antenna 23 disposed inside the housing 27, and this built-in antenna 23 is brought into electrical connection with the matching circuit 24.

This matching circuit 24 is brought into electrical connection with the switch 25 together with the matching circuit 13 to be brought into electrical connection with the antenna section 6, and this switch 25 is brought into connection with electrical connection with the transmission-reception circuit 12.

In addition, in this antenna device 21, a rod antenna 4 and a helical antenna 5 of the antenna section 6 are used as an antenna element for the dual use of transmission and reception, and the switch 25 undergoes switching control so that a built-in antenna 23 is used as the antenna element to be exclusively used for reception, and thus the transmission-reception circuit 12 is brought into electrical connection with the antenna section 6 at the time of transmission and the transmission-reception circuit 12 is brought into electrical connection with either the antenna section 6 or the built-in antenna 23 at the time of reception.

Thus, in a cellular telephone 22, the transmission signals are transmitted from the transmission-reception circuit 12 to the rod antenna 4 or the helical antenna 5 sequentially via the switch 25 and the matching circuit 13, and thereby these transmission signals are sent to the base station via the rod antenna 4 or the helical antenna 5.

In addition, in the cellular telephone 22, at the time of reception, the switch 25 rapidly undergoes switching control so that the reception signals received by the rod antenna 4 or the helical antenna 5 are transmitted to the transmission-reception circuit 12 sequentially via the matching circuit 13 and the switch 25, and the reception signals received by the built-in antenna 23 are transmitted to the transmission-reception circuit 12 sequentially via the matching circuit 24 and the switch 25 so that the levels between these reception signals are compared.

In addition, in this cellular telephone 22, when the level of reception signals received by the rod antenna 4 or the helical antenna 5 is high, the rod antenna 4 or the helical antenna 5 is brought into electrical connection with the transmission-reception circuit 12 via the switch 25, and when the level of reception signals received by the built-in antenna 23 is high, the built-in antenna 23 is brought into electrical connection with the transmission-reception circuit 12 via the switch 25.

Thereby, in the cellular telephone 22, at the time of reception, the reception signals received by the rod antenna 4 or the helical antenna 5 are transmitted to the transmission-reception circuit 12 sequentially via the matching circuit 13 as well as the switch 25, or the reception signals received by the built-in antenna 23 are transmitted to the transmission-reception circuit 12 sequentially via the matching circuit 13 as well as the switch 25.

Thus, in this cellular telephone 22, an antenna element of either any of the rod antenna 4 or the helical antenna 5 and the built-in antenna 23 is used so as to selectively receive reception signals with a high level and thus reduce multi-path phasing.

Incidentally, cellular telephones 1 and 22 in such a configuration are provided with, for example, an unbalanced transmission line 26 being configured by comprising a micro-strip line formed in a circuit substrate, and the transmission-reception circuit 12 is brought into electrical connection with the rod antenna 4, the helical antenna 5 or the built-in antenna 23 via the hot side of this unbalanced transmission line 26, and in addition, the ground side of this unbalanced transmission line 26 is grounded to the shield case.

In addition, in the cellular telephone 1 and 22, as shown in FIGS. 4A to 4C, the transmission-reception circuit 12 supplies the rod antenna 4, the helical antenna 5 or the built-in antenna 23 with power via the hot side of the unbalanced transmission line 26 so as to bring these rod antenna 4, helical antenna 5, or built-in antenna 23 into operation as an antenna, and then from the ground side of this unbalanced transmission line 26, the leakage current i1 flows into the shield case 27 which is approximately same potential with this so as to bring this shield case 27 into operation as an antenna as well.

But, in such cellular telephones 1 and 22, with any of the rod antenna 4, the helical antenna 5, and the built-in antenna 23 being thus brought into operation as an antenna, the shield case 27 operates as an antenna, and therefore a hand of a user grabbing the housing 2, which covers the shield case 27 via this housing 2, gives rise to a problem that the antenna characteristics of the cellular telephones 1 and 22 are deteriorated.

In addition, when the shield case 27 is operating as an antenna, the housing 2, which is grabbed by the user's hand, approaches his/her head, and then this head will further cover the shield case 27 via the housing 2, and therefore the antenna characteristics of the cellular telephones 1 and 22 are further deteriorated, thus giving rise to a problem that the communication quality over telephones is deteriorated.

Moreover, the shield case 27, which operates as an antenna for transmission, radiates a power, and at that time a hand or the head of a user, which approaches the shield case, gives rise to a problem that the power per unit time and unit mass to be absorbed by a specific portion in a human body (so called Specific Absorption Rate (SAR)) increases.

SUMMARY OF THE INVENTION

In view of the foregoing, an object of this invention is to provide an antenna device as well as a portable radio set which can sizably reduce deterioration of the communication.

The foregoing object and other objects of the invention have achieved by the provision of an antenna device of a diversity reception system comprising: a first antenna element installed so as to be retracted and pulled out freely, a fixed second antenna element, an unbalanced transmission line for supplying the first and the second antenna elements with power, balanced-to-unbalanced transformation means for implementing balanced-to-unbalanced transformation action between this unbalanced transmission line and the first and second antenna elements, switching means for selectively switching connections of the unbalanced transmission line with the first and the second antenna elements and with only the first antenna element so that at the time of reception, the first and second antenna elements are brought into connection with the unbalanced transmission line via the balanced-to-unbalanced transmission line, or only the second antenna element is brought into connection with the unbalanced transmission line, and the switching means are arranged to bring the unbalanced transmission line into connection with the first and the second antenna elements via the balanced-to-unbalanced transmission line so that the unbalanced transmission line supplies the first and the second antenna elements with power via the balanced-to-unbalanced transformation means so as to operate the above described first and second antenna elements as an antenna.

Consequently, at the time when the first and the second antenna elements are caused to operate as an antenna, the balanced-to-unbalanced transformation action of the balanced-to-unbalanced transformation means prevents the leakage current from flowing via the unbalanced transmission line from the first or the second antenna element to the ground member onto which this unbalanced transmission line is grounded, and prevents the above described ground member from operating as an antenna so that deterioration of antenna characteristics in the vicinity of the human body can be sizably reduced.

In addition, in the present invention, in a portable radio set having an antenna device of a diversity reception system, a first antenna element installed so as to be retracted and pulled out freely in the antenna device, a fixed second antenna element, an unbalanced transmission line to supply the first and the second antenna elements with power, balanced-to-unbalanced transformation means for implementing balanced-to-unbalanced transformation action between this unbalanced transmission line and the first and second antenna elements, switching means for selectively switching connections of the unbalanced transmission line with the first and the second antenna elements and with only the first antenna element so that at the time of reception, the first and second antenna elements are brought into connection with the unbalanced transmission line via the balanced-to-unbalanced transmission line, or only the second antenna element is brought into connection with the unbalanced transmission line are arranged to be installed, and the switching means are arranged to bring the unbalanced transmission line into connection with the first and the second antenna elements via the balanced-to-unbalanced transmission line so that the unbalanced transmission line supplies the first and the second antenna elements with power via the balanced-to-unbalanced transformation means so as to operate the above described first and second antenna elements as an antenna.

Consequently, at the time when the first and the second antenna elements are caused to operate as an antenna, the balanced-to-unbalanced transformation action of the balanced-to-unbalanced transformation means prevents the leakage current from flowing via the unbalanced transmission line from the first or the second antenna element to the ground member onto which this unbalanced transmission line is grounded, and prevents the above described ground member from operating as an antenna so that deterioration of antenna characteristics in the vicinity of the human body can be sizably reduced.

The nature, principle and utility of the invention will become more apparent from the following detailed description when read in conjunction with the accompanying drawings in which like parts are designated by like reference numerals or characters.

DETAILED DESCRIPTION OF THE EMBODIMENT

Preferred embodiments of this invention will be described with reference to the accompanying drawings.

(1) Principle

Figure 5:
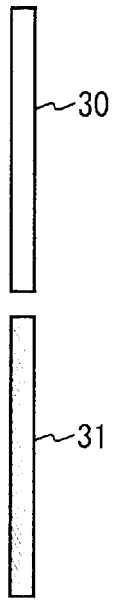
FIG. 5 is a schematic wiring diagram showing a configuration of a balanced type antenna.
Figure 6A:
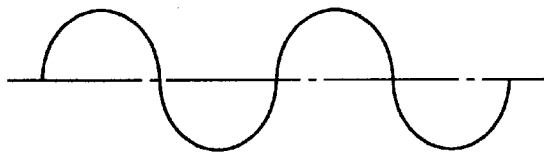
FIGS. 6A and 6B are schematic graphs on voltage waves to be served to describe operation of the balanced type antenna.
Figure 6B:
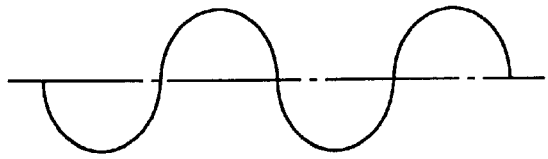

As shown in FIG. 5, an antenna, which is configured by comprising a first and a second antenna elements 30 and 31 which are structurally as well as electrically symmetrical like an dipole antenna, is brought into operation with a voltage having the same amplitude but having the phases shifted by around 180 degrees for these first and second antenna elements 30 and 31 as shown in FIGS. 6A and 6B to take an excited figure of balanced type so as to be categorized as an antenna of balanced type.

Figure 7:
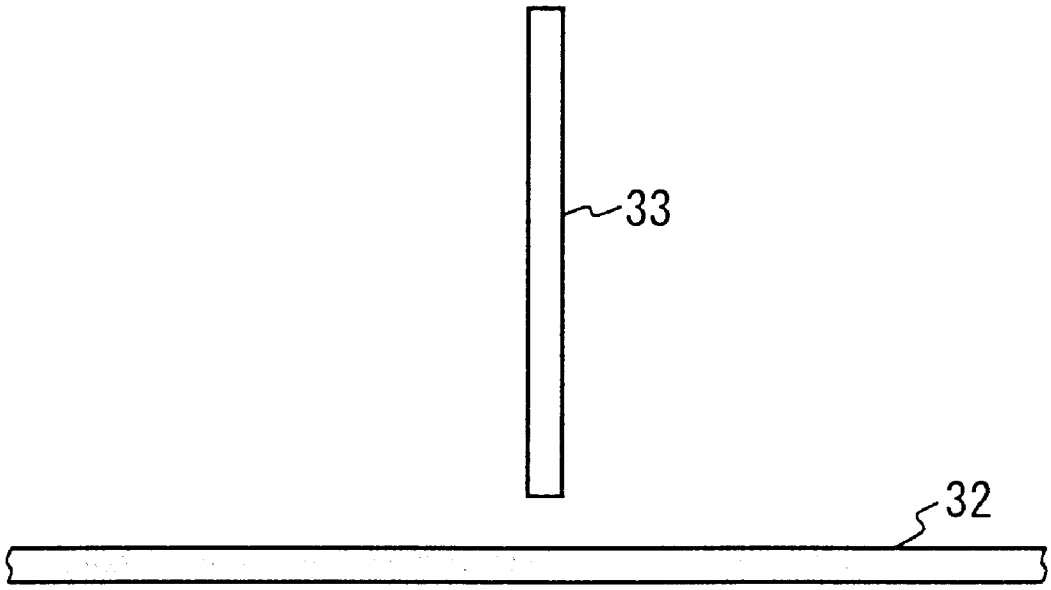
FIG. 7 is a schematic view showing a configuration of an unbalanced type antenna.
Figures 8A, 8B:
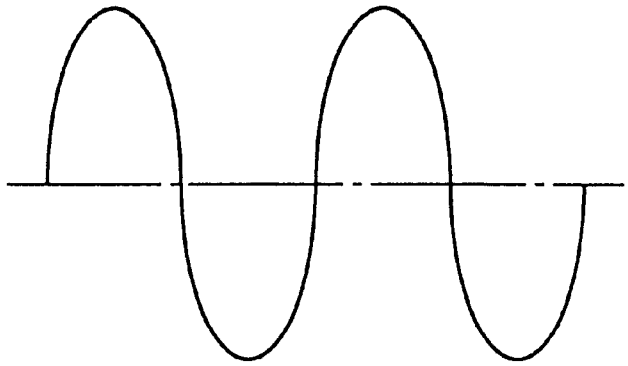
FIGS. 8A and 8B are schematic graphs on voltage waves to be served to describe operation of the unbalanced type antenna.

In addition, as shown in FIG. 7, the one, which is configured by comprising a ground member 32 which can be regarded to structurally have an asymmetric and infinite size as in a monopole antenna disposed approximately perpendicularly on the ground member which is more vast than a disk having a radius of, for example, one wave length (electrical length) and can be regarded to have an infinite size and an antenna 33 disposed approximately perpendicular thereto, makes as shown in FIGS. 8A and 8B this vast ground member 32 approximately zero-potential, and a voltage varying in a predetermined cycle is given rise to in the antenna 33, which then operates to take an unbalanced excited figure, and thus is categorized as an antenna of unbalanced type.

Incidentally, in such an antenna of unbalanced type, which has the vast ground member 32, the image current flowing in this antenna of unbalanced type can be assumed without difficulty, and thus the antenna characteristics of the above described antenna of unbalanced type can be selected approximately as equal as in the antenna of balanced type.

Figure 1A:
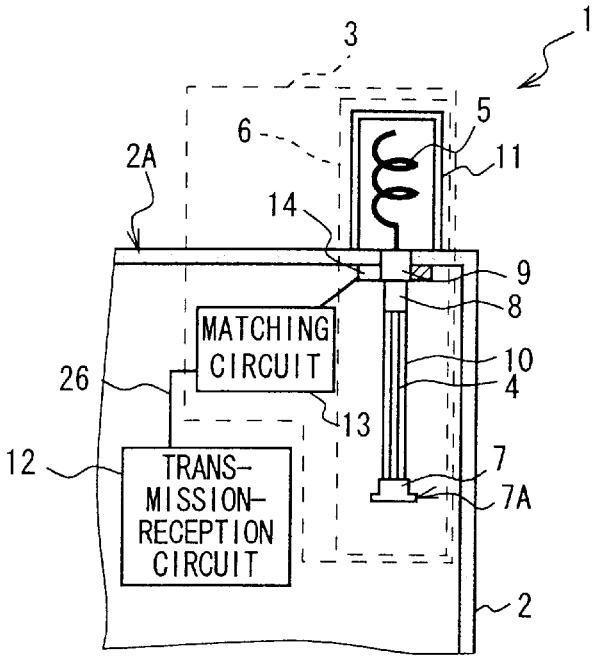
FIG. 1A(PRIOR ART)
FIGS. 1A and 1B are block diagrams showing a circuit configuration of a conventional cellular telephone.
Figure 1B:
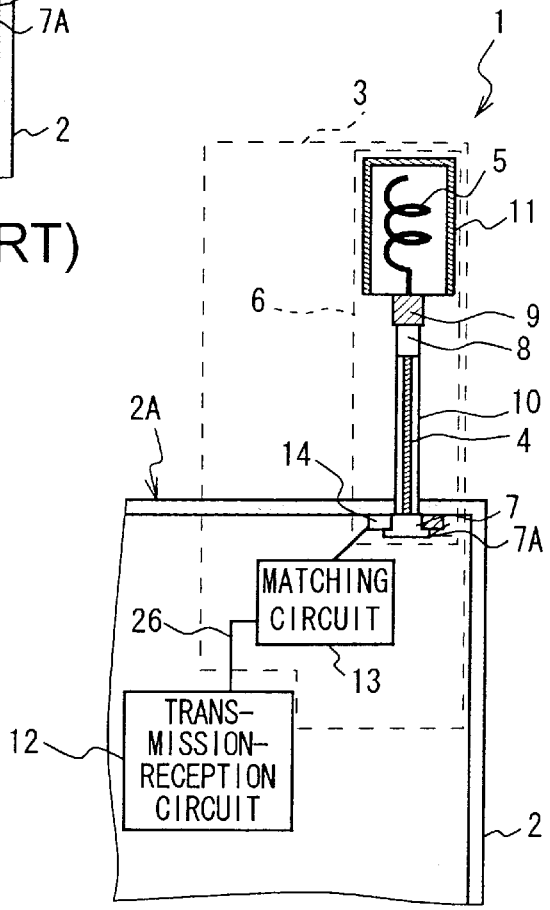
FIG. 1B(PRIOR ART)
Figure 2:
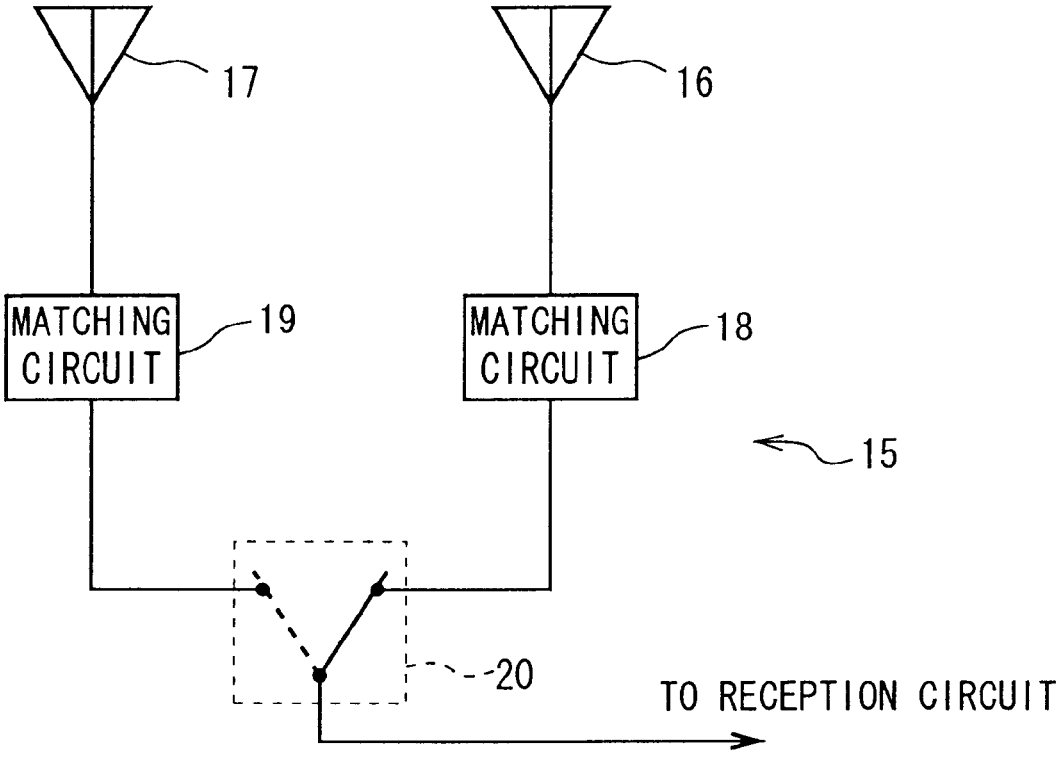
FIG. 2(PRIOR ART)
FIG. 2 is a block diagram showing a basic configuration of an antenna device of a diversity reception system.
Figure 3A:
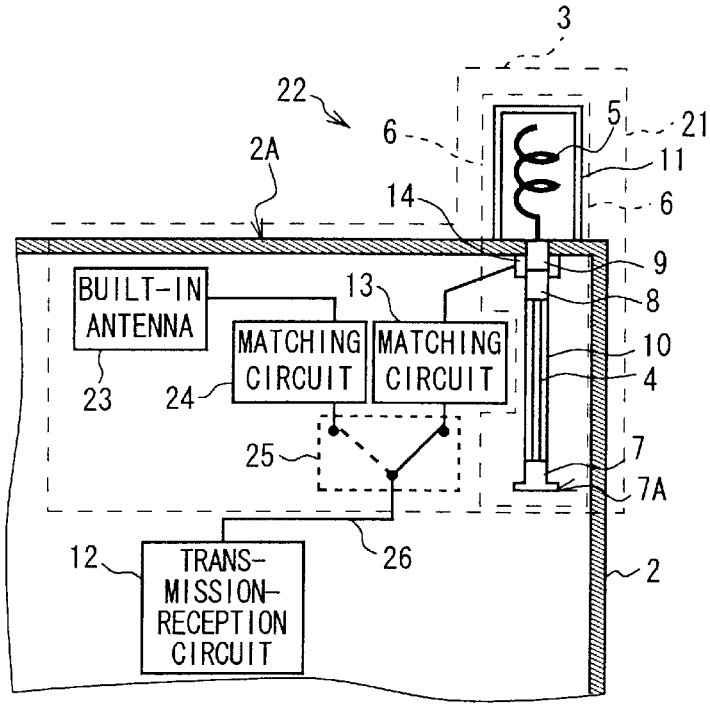
FIG. 3A(PRIOR ART)
FIGS. 3A and 3B are block diagrams showing an inner configuration of a cellular telephone in which an antenna device of a diversity reception system is installed.
Figure 3B:
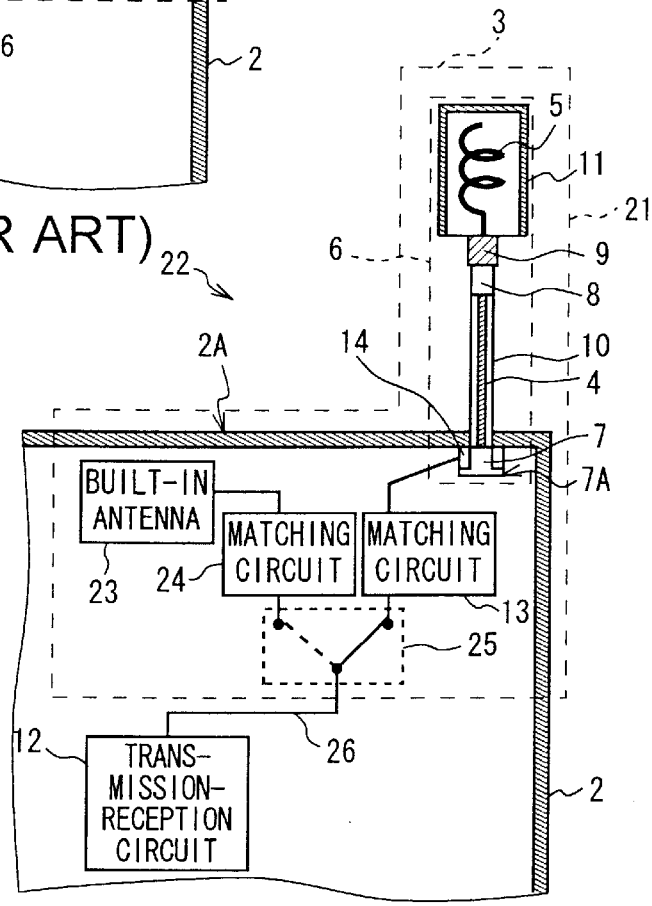
FIG. 3B(PRIOR ART)
Figure 4A:
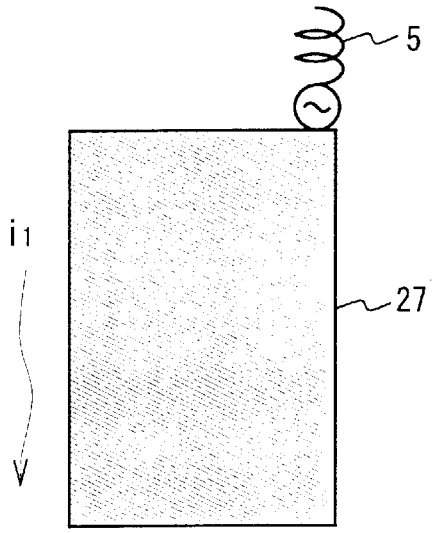
FIG. 4A(PRIOR ART)
FIGS. 4A to 4C are schematic front views to be served to describe operation of a conventional shield case as an antenna.
Figure 4B:
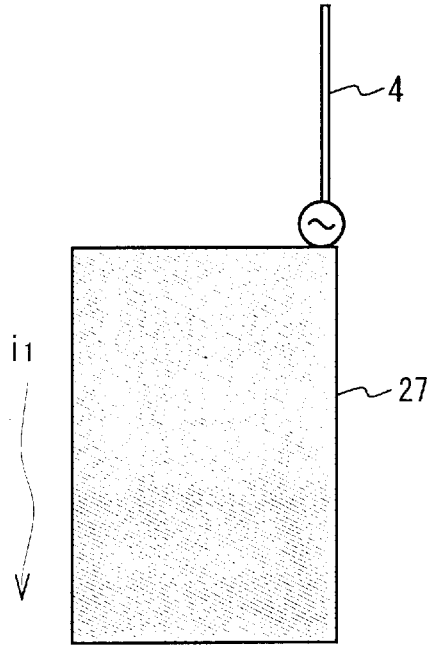
FIG. 4B(PRIOR ART)
Figure 4C:
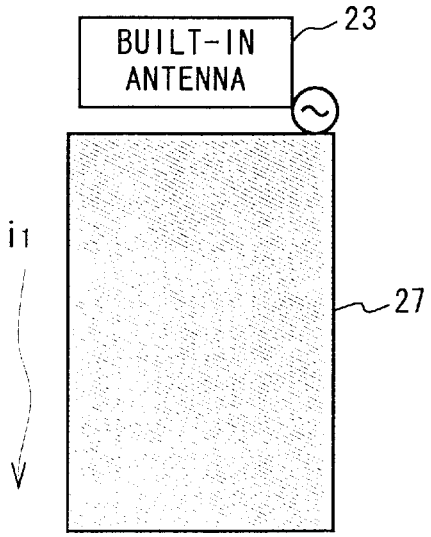
FIG. 4C(PRIOR ART)
Figure 9:
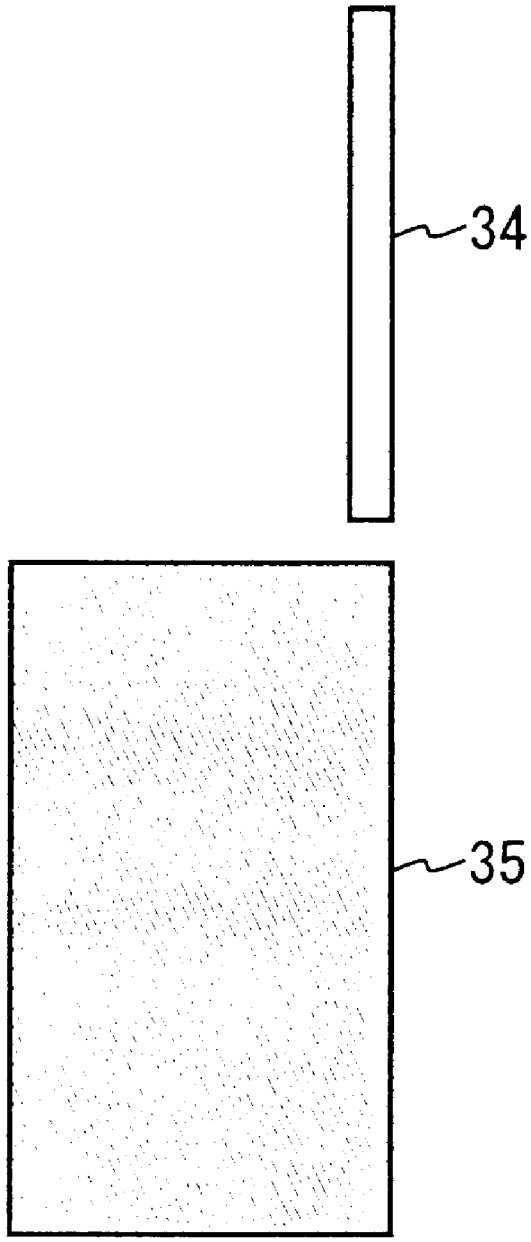
FIG. 9 is a schematic view showing a configuration of an antenna in medium excited figure.

Moreover, as shown in FIG. 9, as this kind of antenna, there is also an antenna being configured by comprising the structurally and electrically asymmetric first and second antenna elements 34 and 35 such as a rod antenna 4 (in FIGS. 1A and 1B as well as FIGS. 3A and 3B) shown in a conventional cellular telephones 1 and 25 (in FIGS. 1A and 1B FIGS. 3A and 3B), a helical antenna 5 (in FIGS. 1A and 1B as well as FIGS. 3A and 3B) or a built-in antenna 23 (in FIGS. 3A and 3B) and a shield case 27 (in FIGS. 4A to 4C).

Figure 10A:
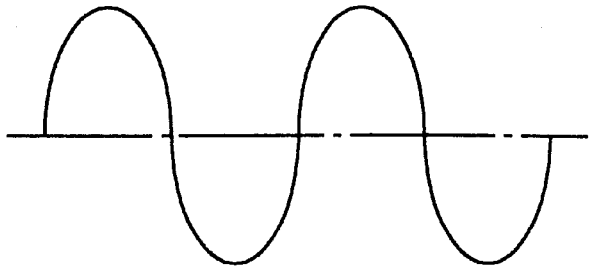
FIGS. 10A and 10B are schematic graphs on voltage waves to be served to describe an example of operation of the antenna in medium excited figure.
Figure 10B:
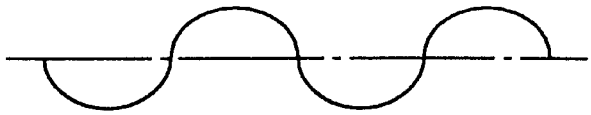

The antenna in such a configuration is structurally and electrically asymmetric, and therefore, as shown in FIGS. 10A and 10B for example, takes a medium excited figure which can be regarded neither as an excited figure of balanced type nor as an excited figure of unbalanced type, and therefore is categorized as an antenna which is different from the antenna of balanced type and the antenna of unbalanced type (and hereinafter this will be called as antenna of medium excited figure).

In addition, FIG. 11 is to show a cellular telephone 36 in accordance with the present invention with the matching circuit having been removed, and this cellular telephone 36 is provided with an antenna device 40 of the diversity reception system having the rod antenna 38 as well as the helical antenna 39 for example as the first and second antenna elements in the housing 37.

This rod antenna 38 as well as the helical antenna 39 is structurally asymmetric, but will become electrically symmetric with the approximately equal electrical length being selected so as to configure an antenna taking an excited figure of approximately balanced type (hereafter to be referred to as antenna of approximately balanced type).

Incidentally, in the present invention, unless specified otherwise in particular, the antenna provided in the antenna device will be structurally asymmetrical but will become electrically symmetrical, and will take an excited feature of balanced type so as to be categorized as the antenna of approximately balanced type.

Figure 11B:
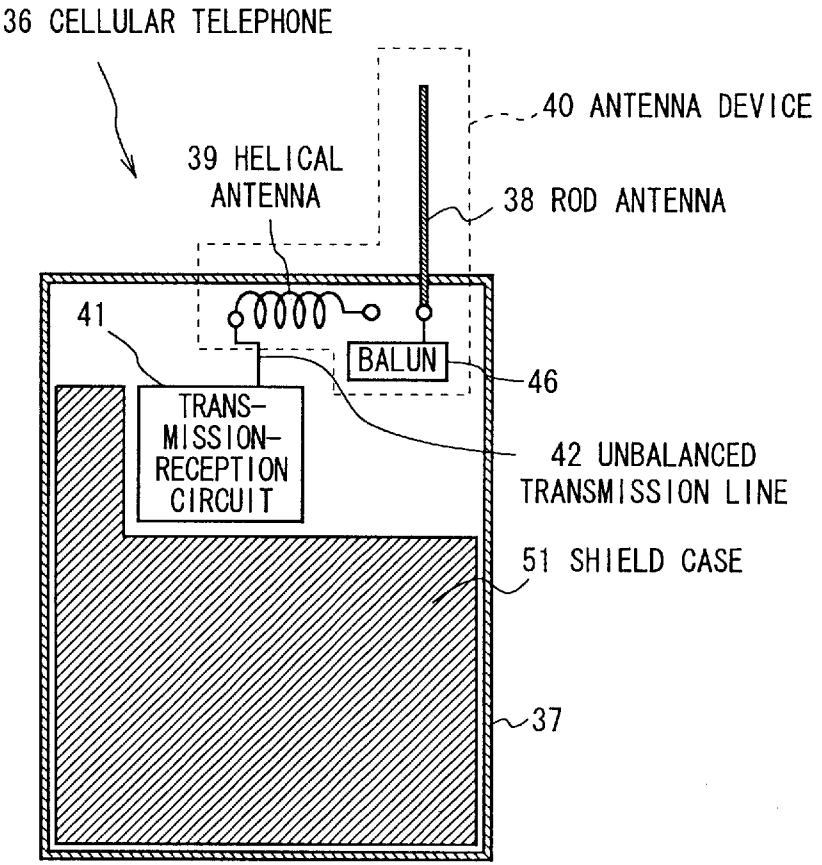
FIGS. 11A and 11B are schematic sectional views to be served to describe a principle of a cellular telephone according to the present invention.
Figure 11A:
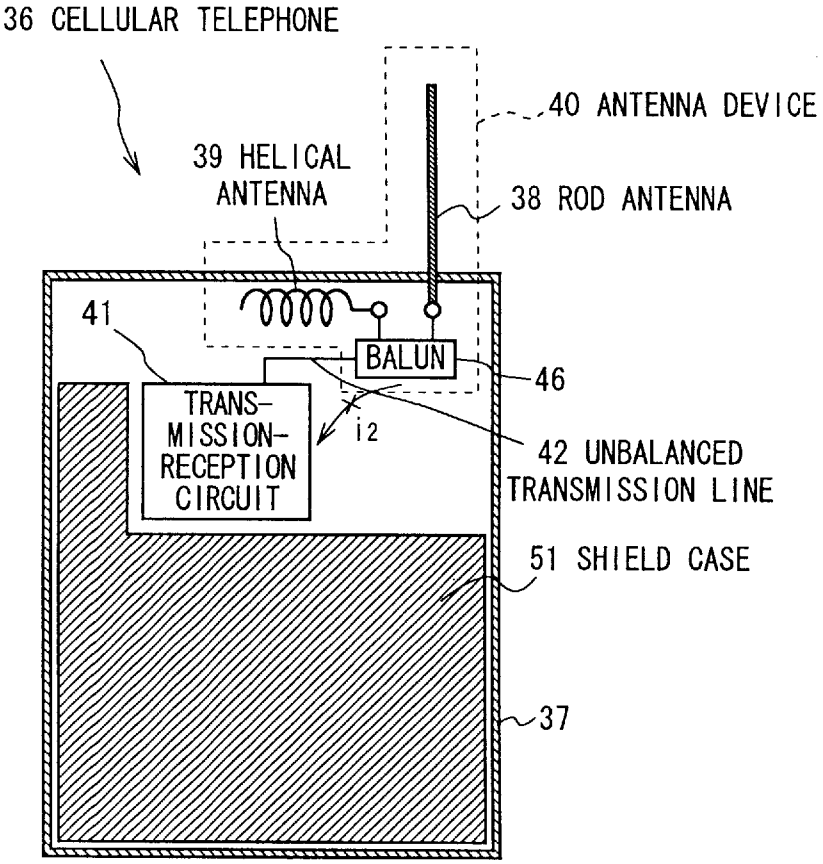

In addition, as shown in FIG. 11A, in the antenna device 40, both the rod antenna 38 and the helical antenna 39 will be used as an antenna element for transmission at the time of transmission.

In addition, in the antenna device 40, the rod antenna 38 as well as the helical antenna 39 is used for an antenna element for reception at the time of reception as shown in FIG. 11A, and as shown in FIG. 11B only the helical antenna 39 is used for the antenna element for reception while this rod antenna 38 as well as well as the helical antenna 39 and a single helical antenna 39 are selectively used for receiving reception signals at high levels so as to reduce multi-path phasing.

Incidentally, the antenna device 40 is provided with an unbalanced transmission line 42 being configured by a micro-strip line, and both the rod antenna 38 and the helical antenna 39 are brought into electrical connection or only the helical antenna 39 is brought into electrical connection with the transmission-reception circuit 41 via this unbalanced transmission line 42.

Figure 12:
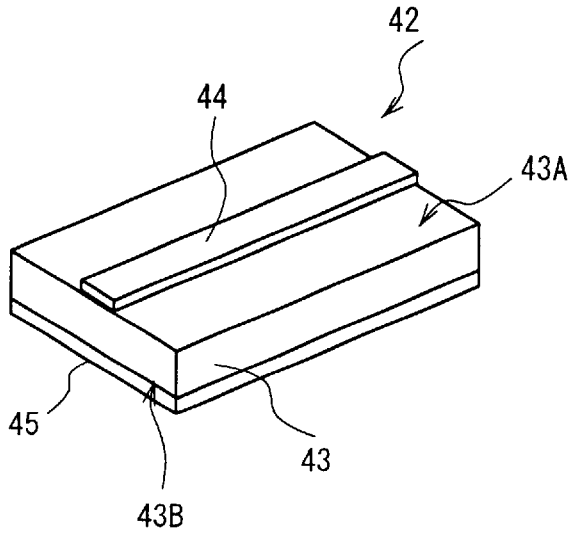
FIG. 12 is a schematic perspective view showing a configuration of an unbalanced transmission line configured by comprising a micro-strip line.

Here, FIG. 12 shows a micro-strip line having been applied as an unbalanced transmission line 42, which is configured by comprising a strip conductor 44 being provided as a hot side on one surface 43A of the dielectric layer 43 having a predetermined thickness and an earth conductor 45 being provided as a ground side on the other surface 43B of the dielectric layer 43, and is formed on a circuit substrate (not shown) housed inside the housing 37 for example.

Figure 13:
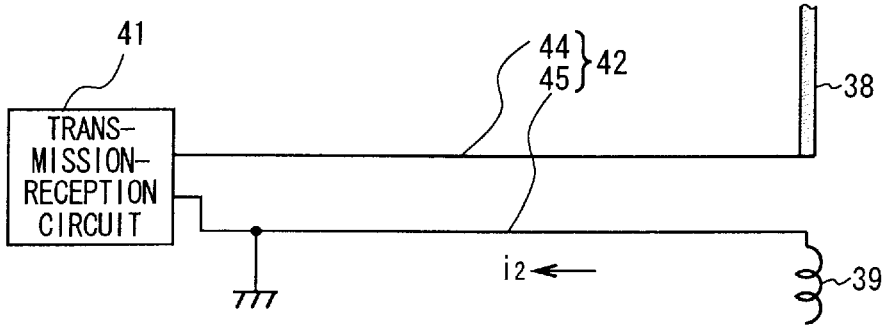
FIG. 13 is a schematic block diagram to be served to describe connections between an unbalanced transmission line and a rod antenna as well as a helical antenna.

And in such an antenna device 40, as shown in FIG. 13, when both the rod antenna 38 and the helical antenna 39 are used together at the time of transmission and at the time of reception, basically for example the rod antenna 38 is brought into electrical connection with the transmission-reception circuit 41 via the hot-side 44 of the unbalanced transmission line 42, and the helical antenna 39 is brought into electrical connection with the transmission-reception circuit 41 via the ground side 45 of this unbalanced transmission line 42.

However, since in this antenna device 40 the rod antenna 38 and the helical antenna 39 take an excited figure of approximately balanced type while the unbalanced transmission line 42 takes an unbalanced excited figure due to grounding of the ground side 45 and thus they take excited figures being different each other, and the rod antenna 38 as well as the helical antenna 39 and the unbalanced transmission line 42 are brought into direct electrical connection so that the difference in an excited figure results in unbalanced current when this rod antenna 38 as well as the helical antenna 39 operates as an antenna for dual use of transmission and reception.

As a result hereof, in the cellular telephone 36, a leakage current i2 flows from the helical antenna 39 to the shield case, which is approximately equally potential with this via the ground side 45 of the unbalanced transmission line 42 and, thus this leakage current i2 operates the shield case as an antenna so that when the housing 37 approaches the hand or the head of a user, the antenna characteristics are deteriorated.

Figure 14:
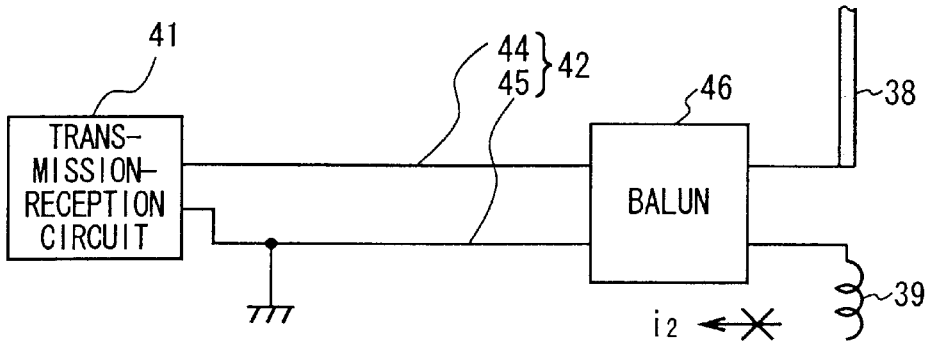
FIG. 14 is a schematic block diagram to be served to describe connections between an unbalanced transmission line and a rod antenna as well as a helical antenna using a balun.

Thus, as shown in FIG. 14, in the antenna device 40 according to the present invention, a balun (balanced-to-unbalanced transformer) 46 is provided to implement balanced-to-unbalanced transformation among the unbalanced transmission line 42, the rod antenna 38, and the helical antenna 39.

Figure 15:
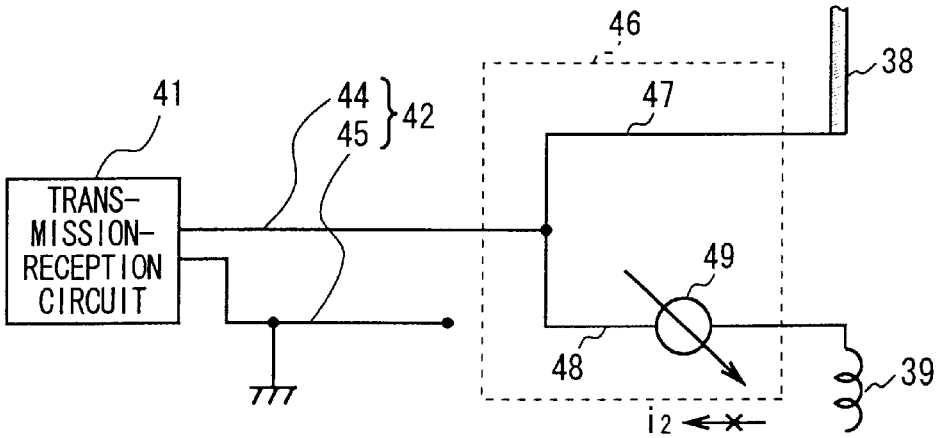
FIG. 15 is a block diagram showing a configuration of a balun.

This balun 46, for example as shown in FIG. 15, is configured by the first and second transmission lines 47 and 48 of two systems to be provided, together with the phasing device 49 to be provided midway in this second transmission line 48.

In addition, in the balun 46, in the connecting side of the unbalanced transmission line 42 (this hereinafter to be referred to as unbalanced side), one ends of the first as well as second transmission lines 47 and 48 are respectively brought into electrical connection with the hot side 44 of this unbalanced transmission line 42, and at the connection side of the antenna element (this hereinafter to be referred to as balanced side), the other ends of these first as well as second transmission lines 47 and 48 are respectively brought into electrical connection with the rod antenna 38 and the helical antenna 39.

Figure 16:
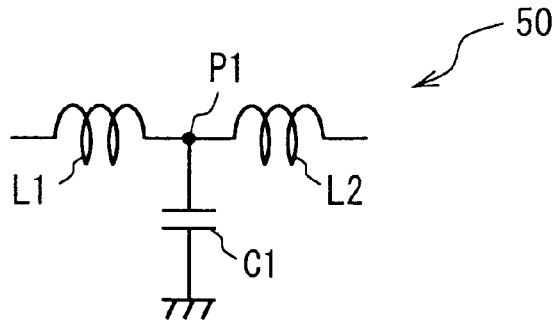
FIG. 16 is a block diagram showing a configuration of a phasing circuit of the balun.

Here, the phasing device 49, for example as shown in FIG. 16, is configured by symmetrically-structured T-type phasing circuits 50 being assembled wherein two dielectric reactance elements L1 and L2 are brought into connection in series and have their middle connection point P1 coming into conductive connection with one end of a capacitive reactance element C1 together with the other end of the above described capacitive reactance element C1 being grounded.

In addition, in the balun 46, a high-frequency signal supplied by the transmission-reception circuit 41 via the hot side 44 of the unbalanced transmission line 42 is taken in from the unbalanced side so that this high-frequency signal without any change is sent out into the rod antenna 38 at the balanced side via the first transmission line 47, and at the same time in the phasing device 49 of the second transmission line 48 as the other side, this high-frequency signal undergoes phase shifting by around 180 degrees against the rod antenna 38 within the working frequency band, and the obtained high-frequency signal with shifted phase is sent out to the helical antenna 39 at the balanced side.

Thereby, the balun 46 can operate the rod antenna 38 and the helical antenna 39 as an electrically symmetrical antenna of approximately balanced type that gives rise to a voltage figure as in the above described FIGS. 6A and 6B as balanced-to-unbalanced transformation action.

Thus, this balun 46 prevents the rod antenna 38 and the helical antenna 39 from giving rise to an unbalanced state in current so as to prevent the leakage current i2 from flowing from the helical antenna 39 to the ground side 45 of the unbalanced transmission line 42 and as a result hereof can prevents the shield case from operating as an antenna.

Incidentally, such a balun 46 can be extensively miniaturized for forming in its entirety, and thus can be easily installed in the cellular telephone 36 which tends to be miniaturized and light-weighed since, as the inductive reactance elements L1 and L2 and the capacitive reactance element C of the above described phasing circuit 50 for the phasing device 49, those, for example, in micro chip shape of around 1 mm cube can be used.

Figure 17:
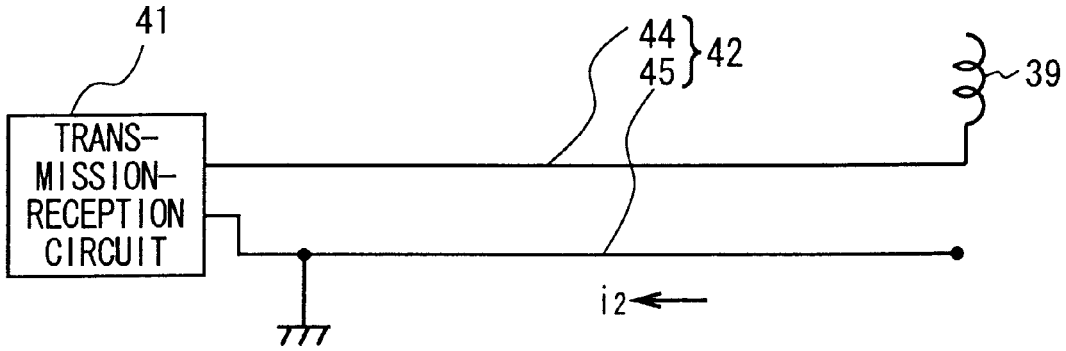
FIG. 17 is a block diagram to be served to describe connection between a helical antenna and an unbalanced transmission line at the time of reception.

In addition, in the antenna device 40, as shown in FIG. 17, when only the helical antenna 39 is used at the time of reception, this helical antenna 39 is brought into electrical connection with the transmission-reception circuit 41 via the hot side 44 of the unbalanced transmission line 42 without using any balun in particular, and the ground side 45 of the unbalanced transmission line 42, that is not brought into connection with any antenna element, is brought into electrical connection with the transmission circuit 41.

Thus, in the antenna device 40, when this helical antenna 39 is supplied with power from the transmission-reception circuit 41 via the unbalanced transmission line 42, the above described helical antenna 39 is brought into operation as an antenna, but at that time the leakage current i2 flows into the shield case 51 from the ground side 45 of the unbalanced transmission line 42 so that this shield case operates as an antenna.

Figure 18A:
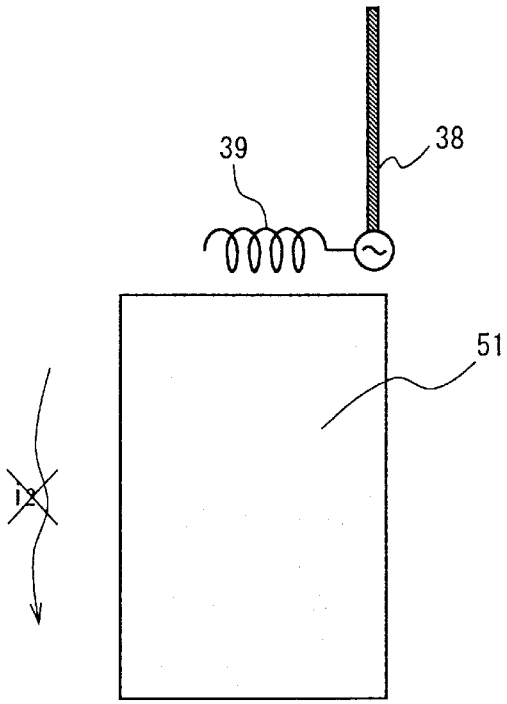
FIGS. 18A and 18B are schematic diagrams to be served to describe a shield case at the time of operation of an antenna.
Figure 18B:
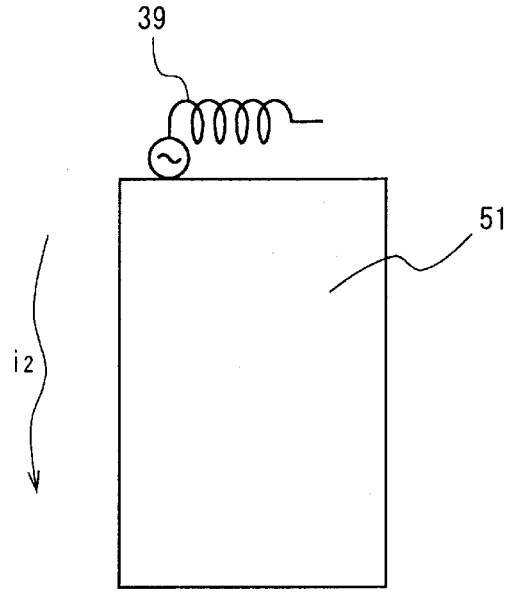

Accordingly, in the cellular telephone 36 according to the present invention, as shown in FIGS. 18A and 18B, when only the helical antenna 39 is used at the time of reception, the shield case 51 operates as an antenna, and therefore when the housing 37 is grabbed by the hand of a user or the housing 37 approaches the head of a user, similarly to the conventional cellular telephone, the antenna characteristics of this cellular telephone 36 in the vicinity of a human body is deteriorated.

However, in this cellular telephone 36, when both the rod antenna 38 and the helical antenna 39 are used together at the time of transmission and at the time of reception, thus two antenna elements are used so that not only the antenna characteristics can be improved but also deterioration of the antenna characteristics of this cellular telephone 36 in the vicinity of a human body is sizably reduced due to the shield case 51 being made not to operate as an antenna even if the housing 37 is grabbed by the hand of a user or the housing 37 approaches the head of a user, and the deterioration in communication quality can be sizably reduced.

In addition, in the cellular telephone 36, when both the rod antenna 38 and the helical antenna 39 are used together at the time of transmission and reception, the shield case 51 is caused to function only as an essential ground as well as electrical shield plate, and not to operate as an antenna so that the power to be absorbed by a human body from this shield case 51 is controlled to sizably reduce SAR. In addition thereto, when only the helical antenna 39 operates as an antenna, the shield case 51 also operates as an antenna, however, there is no problem about the power i.e. SAR to be absorbed by a human body from this shield case 51.

Incidentally, FIGS. 11A and 11B show the transmission-reception circuit 41 that is disposed outside the shield case 51 inside the housing 37 in order to simplify description, but actually this transmission-reception circuit 41 is disposed inside the shield case 51. In addition, the balun 46 is disposed outside the shield case 51 for description, but this balun 46 can be disposed either inside or outside the shield case 51.

Figure 19:
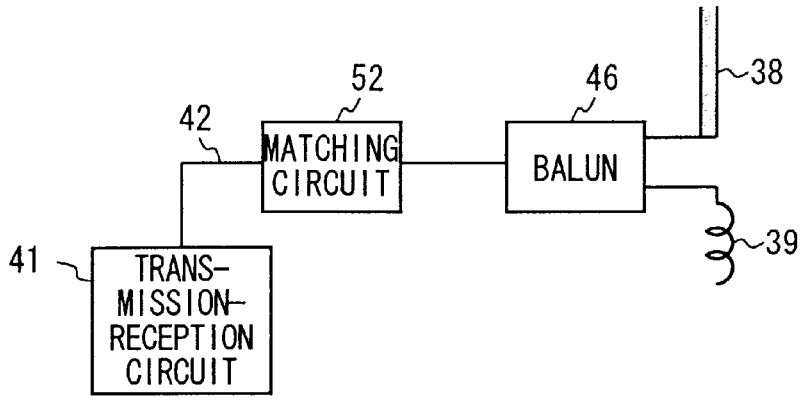
FIG. 19 is a block diagram to be served to describe disposition of a matching circuit to the unbalanced side of a balun.

In addition, in FIGS. 11A and 11B, FIGS. 13 to 15, and FIG. 17, the matching circuit is removed from the drawing in order to simplify description, but as shown in FIG. 19, the matching circuit 52 can be provided for example between the unbalanced transmission line 42 and the balun 46.

Figure 20:
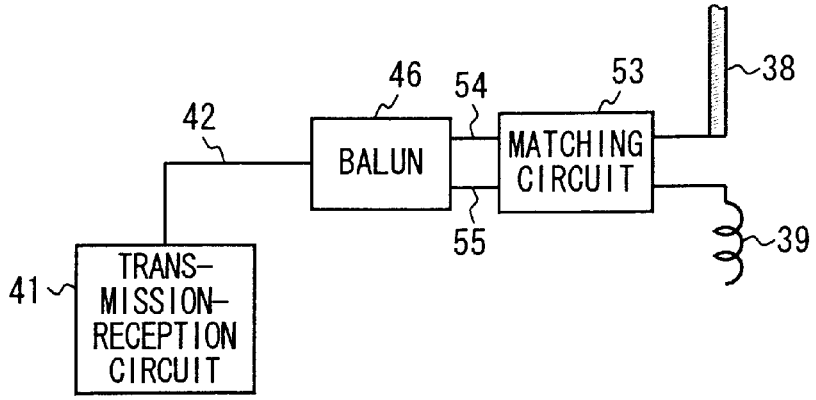
FIG. 20 is a block diagram to be served to describe disposition of a matching circuit to a balanced side of the balun.

Moreover, as shown in FIG. 20, the matching circuit 53 can be provided between the balun 46 and the rod antenna 38 as well as the helical antenna 39. However, when the matching circuit 53 is grounded at this time, even if the balun 46 implements the balanced-to-unbalanced transforming function, the leakage current given rise to in the helical antenna 39 flows into the shield case 51 via this matching circuit 53, and as a result hereof, this shield case 51 will operate as an antenna.

Figure 21A:
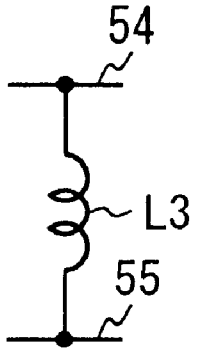
FIGS. 21A and 21B are block diagrams showing a configuration of the matching circuit disposed on the balanced side of the balun.
Figure 21B:
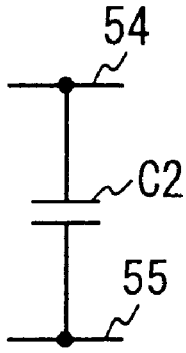

Accordingly, as shown in FIGS. 21A and 21B, if such a matching circuit 53 is arranged to be configured by comprising an inductive reactance element L3 or a capacitive reactance element C2 that is brought into connection in parallel between the two transmission lines 54 and 55 to bring the balanced side of the balun 46 and the rod antenna 38 as well as the helical antenna 39 into electrical connection so as not to be grounded, this matching circuit 53 can be provided between the balun 46 and the rod antenna 38 as well as the helical antenna 39 without any problems.

(2) First Practical Embodiment

Figure 22:
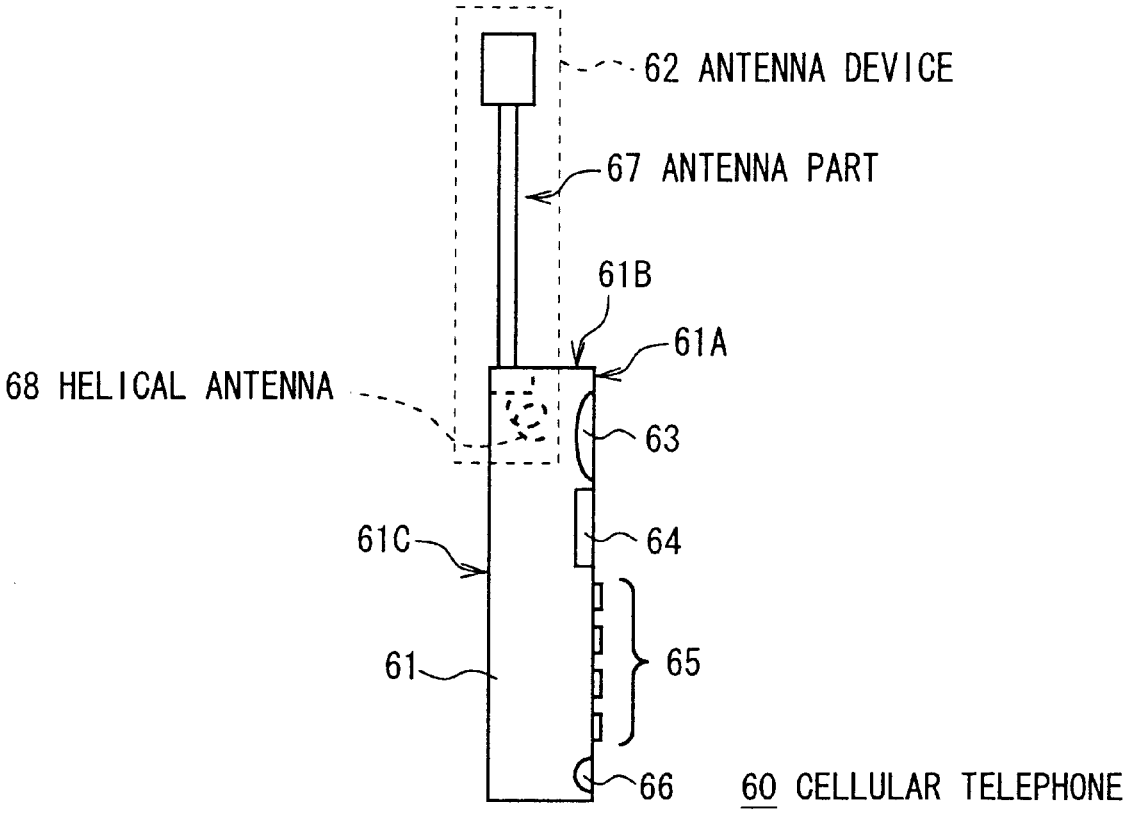
FIG. 22 is a schematic side view showing a first practical embodiment on a configuration of a cellular telephone according to the present invention.

In FIG. 22, the numeral 60 denotes a cellular telephone in its entirety according to a first practical embodiment, being configured by comprising an antenna device 62 of a diversity reception system being provided in a housing 61 made of non-conductive member such as synthetic resin, etc.

This housing 61 is formed like a box where a speaker 63, a liquid crystal display section 64, various operation keys 65 and a microphone 66 are disposed in the front surface 61A.

In addition, in the antenna device 62, an antenna section 67 having a first antenna element is installed in the side of the back surface 61C of the upper surface 61B of the housing 61 which can be retracted and pulled out freely approximately in parallel in the elongated direction of this housing 61 (this hereinafter to be referred to as the box elongated direction) and as a second antenna element the first antenna element 68 of a fixed type formed by conductive line member being spirally rolled is disposed inside the upper portion of the back surface 61C of the housing 61.

In addition, in this cellular telephone 60, the first antenna element of the antenna section 67 and the first helical antenna 68 are assembled and disposed in side of the back surface 61C of the housing 61 so that, even if the front surface 61A of this housing 61 approaches the head of a user for telephone communication, the first antenna element as well as the first helical antenna 68 can be disposed remote from the head of the user, and thus deterioration of antenna characteristics of this cellular telephone in the vicinity of a human body is arranged to be reduced.

Figure 23:
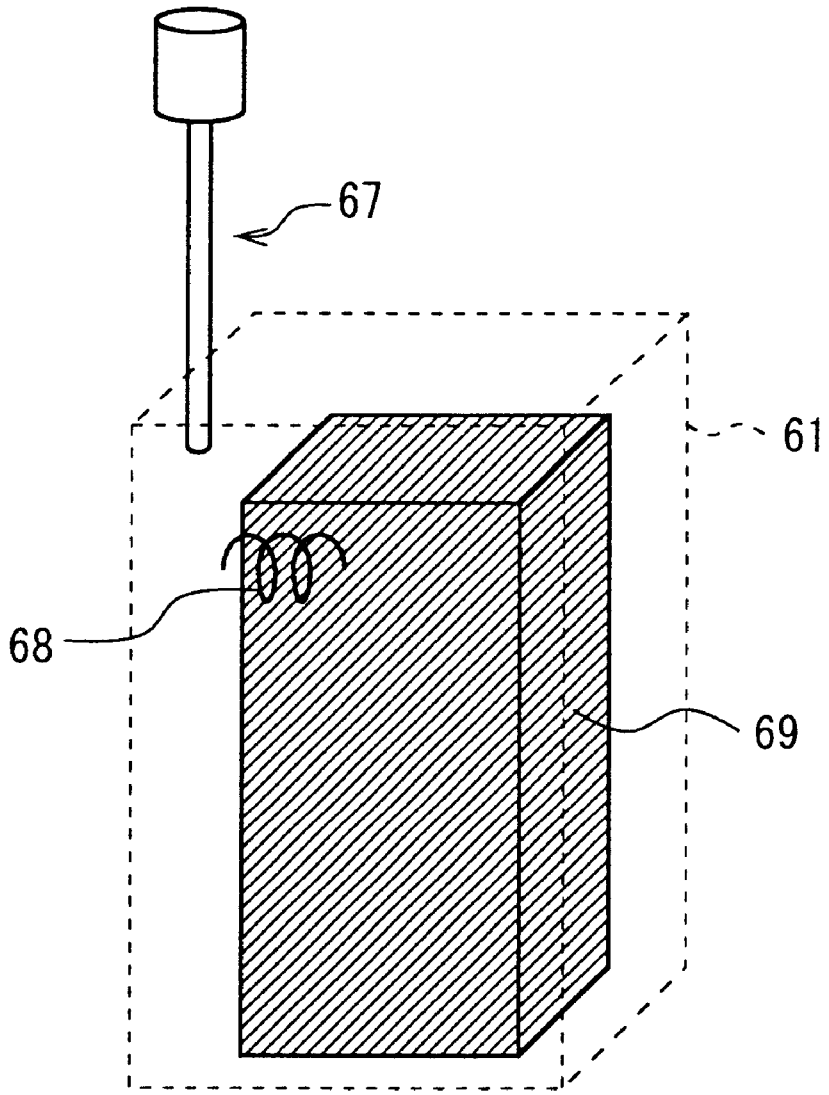
FIG. 23 is a schematic diagram to be served to describe disposition of an antenna section, a first helical antenna, and a shield case.

In addition, in the cellular telephone 60, as shown in FIG. 23, the antenna section 67 as well as the first helical antenna 68 is disposed so as to be electrically separated from the shield case 69 housed inside the housing 61, and thereby, in the case where the first antenna element as well as the first helical antenna 67, which is used as an antenna element for dual use of transmission and reception, is brought into capacitive junction with the shield case 69 80 that the above described shield case 69 is arranged to be prevented from operating as an antenna.

Figure 24A:
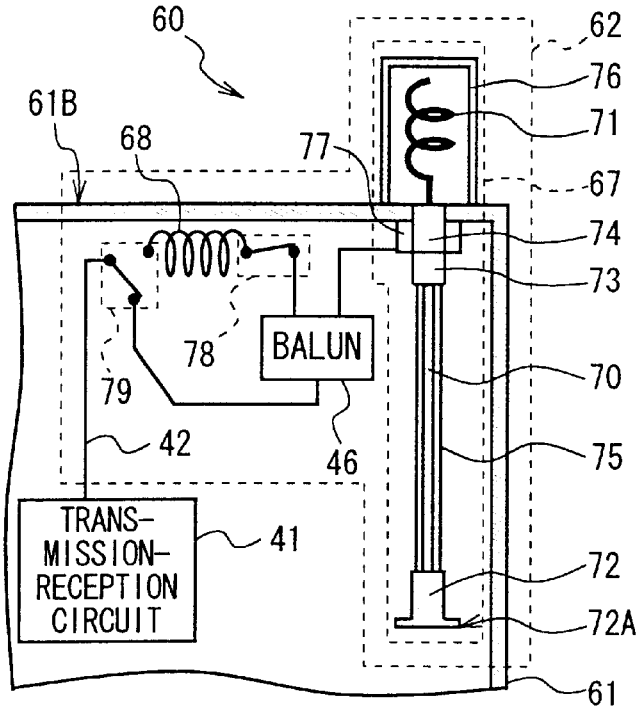
FIGS. 24A and 24B are block diagrams showing an inner configuration of a cellular telephone at the time of transmission and at the time of reception according to a first practical embodiment.
Figure 24B:
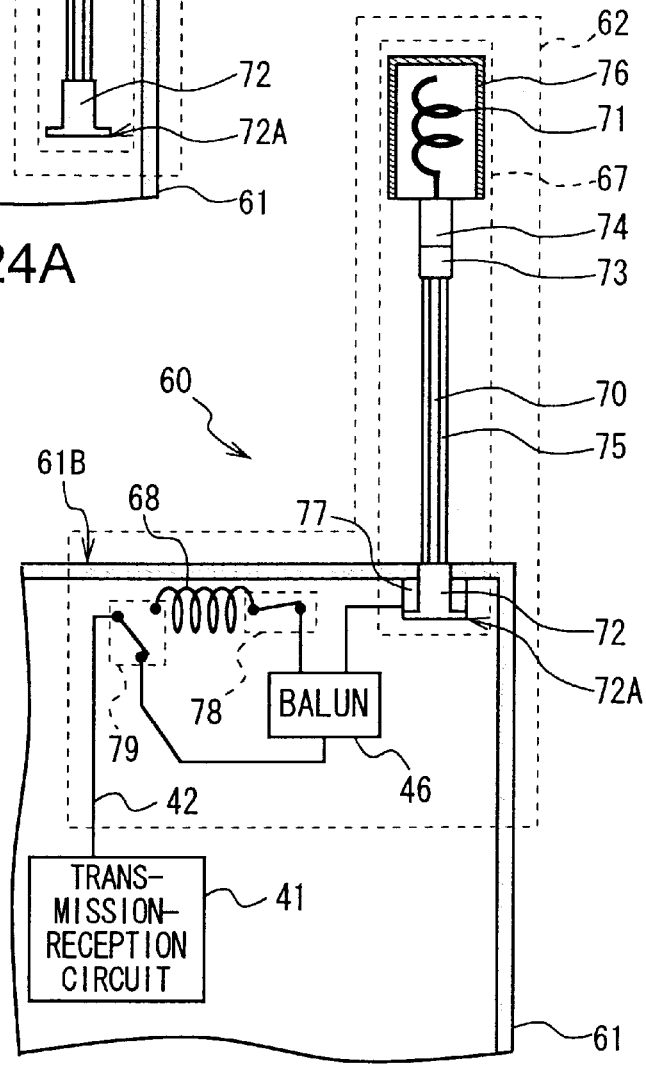

Actually, FIGS. 24A and 24B and FIG. 25A are to show the inner configuration of this cellular telephone 60 without the matching circuit and the shield case, and inside the housing 61, a circuit substrate (not shown) on which various circuit elements such as the transmission-reception circuit 41 and the balun 46, etc. are housed and a shield case made of conductive member covering this circuit substrate is housed.

In addition, in the antenna device 62, the rod antenna 70 made of a stick form conductive line member as the first antenna element and the second helical antenna 71 formed with a conductive line member spirally scrolled are installed in the antenna section 67.

The lower end of this rod antenna 70 and the power supply member for the rod 72 made of a conductive member having T-shaped sectional view are brought into electrical as well as mechanical connection, and the upper end of this rod antenna 70 and the connecting section 73 made of non-conductive member are brought into mechanical connection.

In addition, the lower end of the second helical antenna 71 and the power supply member for the helical 74 made of conductive member are brought into electrical as well as mechanical connection, and this power supply member for the helical 74 and the connecting section 73 are brought into mechanical connection. Thereby, the second helical antenna 71 and the rod antenna 70 are mechanically linked with the connecting section 73 but electrically separated.

In addition, the rod antenna 70 is covered with the antenna cover for the rod 75 made of non-conductive member and the second helical antenna 71 is housed in the antenna cover for the helical 76 which is made of non-conductive member and formed in a shape of a cap so that they will not be brought into direct contact with a human body.

In addition thereto, in this antenna section 67, an antenna power supply terminal 77 made of conductive member and formed to shape a ring for example is disposed inside the upper surface 61B of the housing 61 and the rod antenna 70 is inserted through it. In addition, this antenna power supply terminal 77 and the balanced side of the balun 46 are brought into electrical connection.

Thereby, in the antenna device 62, at the time when the antenna section 67 is retracted, this antenna section 67 is pushed toward the retracting direction and the antenna cover for the helical 76 is thrust onto the upper surface 61B of the housing 61 to bring the power supply member for the helical 74 into electrical connection with the antenna power supply terminal 77, and thus to bring the balanced side of the balun 46 and the second helical antenna 71 into electrical connection sequentially via the antenna power supply terminal 77 and the power supply member for the helical 74 and to electrically separate the rod antenna 70 from the balanced side of this balun 46.

In addition, in the antenna device 62, at the time when the antenna section 67 is pulled out, this antenna section 67 is pulled toward the pulling direction and the protrusion 72A of the power supply member for the rod 72 is thrust onto the antenna power supply terminal 77 to bring this power supply member for the rod 72 into electrical connection with the antenna power supply terminal 77, and thereby to bring the balanced side of the balun 46 and the rod antenna 70 into electrical connection sequentially via the antenna power supply terminal 77 and the power supply member for the rod 72 and to electrically separate the second helical antenna 71 from the balanced side of this balun 46.

Incidentally, at this time, the power supply member for the rod 72 is brought into electrical connection with the antenna power supply terminal 77, and in addition, performs its role as a stopper to prevent the antenna section 67 from being pulled out outside the housing 61.

Thus, in the antenna device 62, the electrical connection between the rod antenna 70 toward the balanced side of the balun 46 and the second helical antenna 71 is switched in accordance with retracting and pulling out of the antenna section 67 so that either this rod antenna 70 or the second helical antenna 71 is arranged to be used as an antenna element.

In addition thereto, the antenna device 62 is provided with an unbalanced transmission line 42 comprising the micro-strip line formed in the circuit substrate inside the housing 61 and the first as well as second switching device 78 and 79 formed in the above described circuit substrate.

This first switch 78 has two points of contact to implement switching electrically, and one point of contact is brought into electrical connection with the balanced side of the balun 46, and the other point of contact is brought into electrical connection with the one end of the first helical antenna 68.

In addition, the second switch 79 has three points of contact that can be electrically switched, in such a way that the two points of contact divide the hot side of the unbalanced transmission line 42 into two, and these two points of contact are brought into electrical connection with the transmission-reception circuit 41 or the unbalanced side of the balun 46 via the hot side which is divided into two respectively to be applied to these two points of contact, and the remaining one point of contact is brought into electrical connection with the other end of the first helical antenna 68.

In addition, in the antenna device 62, the first and second switches 78 and 79 at the time of transmission undergo switching control to connect the first helical antenna 68 electrically with the balanced side of the balun 46 via the first switch 78, and in addition to connect the transmission-reception circuit 41 electrically with the unbalanced side of this balun 46 and the second switch 79 via the unbalanced transmission line 42 and the second switching device 79.

Thereby, in the antenna device 62, the rod antenna 70 or the second helical antenna 71, which is brought into electrical connection with the transmission-reception circuit 41 sequentially via the unbalanced transmission line 42 and the balun 46, and the first helical antenna 68 are to be used as an antenna element for transmission.

Figure 25:
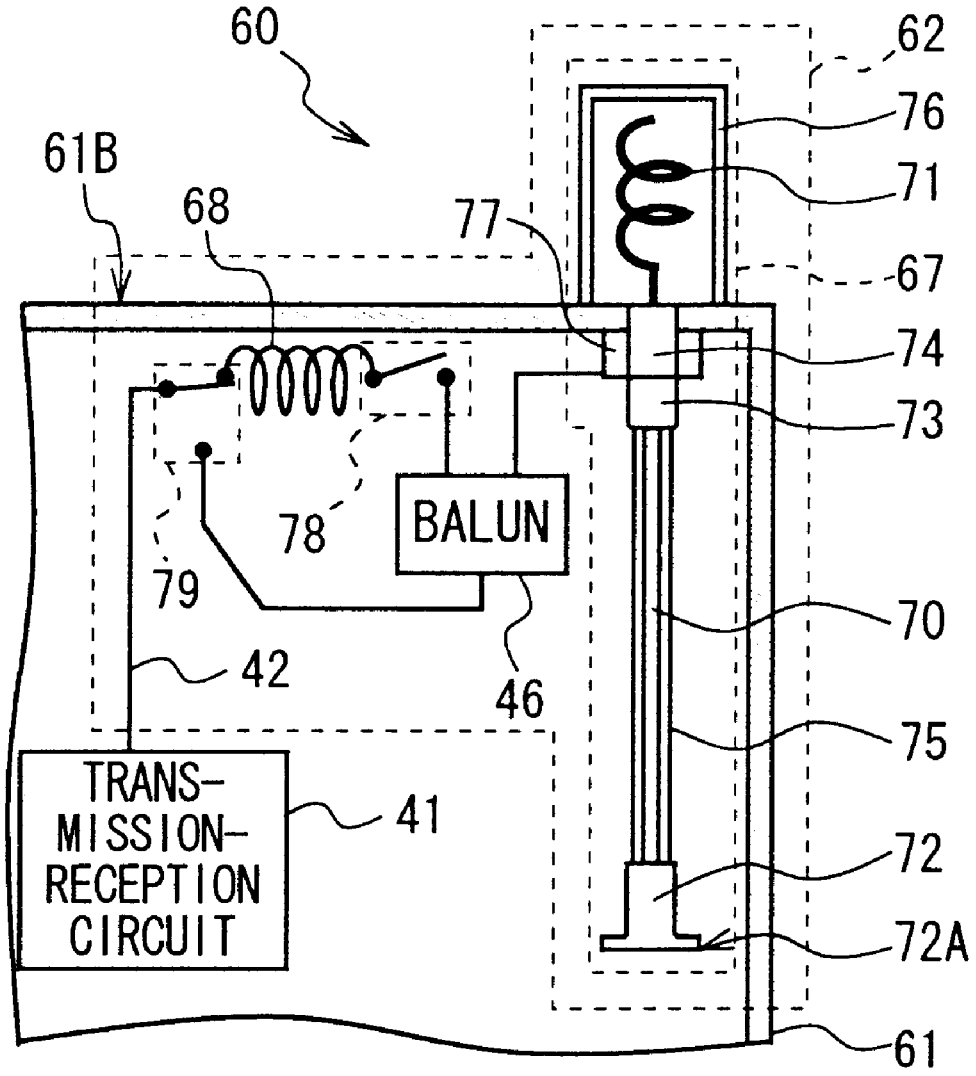
FIG. 25 is a block diagram showing an inner configuration of a cellular telephone at the time of reception according to the first practical embodiment.

In addition, in the antenna device 62, the first and second switches 78 and 79 at the time of reception undergo switching control to connect the first helical antenna 68 electrically with the balanced side of the balun 46 via the first switch 78, and in addition to connect the transmission-reception circuit 41 electrically with the unbalanced side of this balun 46 via the unbalanced transmission line 42 and the second switch 79, or as shown in FIG. 25 one end of the first helical antenna 68 is opened via the first switch 78, and the other end of this first helical antenna 68 is brought into electrical connection with the transmission-reception circuit 41 via the second switch 79 and the unbalanced transmission line 42.

Thereby, in the antenna device 62, the rod antenna 70 or the second helical antenna 71, which is brought into electrical connection with the transmission-reception circuit 41 sequentially via the unbalanced transmission line 42 and the balun 46, and the first helical antenna 68 are to be used as an antenna element for reception, or this antenna element for reception is to be selectively switched and used so that only the first helical antenna 68, which is brought into electrical connection with the transmission-reception circuit 41 via the unbalanced transmission line 42, is treated as the antenna for reception.

Thus, in this antenna device 62, the antenna element for reception to thus selectively implement switching for use is to execute the diversity reception selectively receiving the reception signals of high levels.

Actually, in the antenna device 62, at the time of transmission as well as reception, when the rod antenna 70 or the second helical antenna 71 and the first helical antenna 68 are used together, the transmission-reception circuit 41 supplies power to the rod antenna 70 or the second helical antenna 71 and the first helical antenna 68 sequentially via the unbalanced transmission line 42 and the balun 46 so as to cause the both antenna elements of this rod antenna 70 or the second helical antenna 71 and the first helical antenna 68 to give rise to a voltage figure as in the above described FIGS. 6A and 6B and to operate as an antenna of approximately balanced type.

In addition, in the antenna device 62, at this time, function of the balun 46 with respect to balancing and unbalancing prevents the leakage current from flowing from the rod antenna 70 or the second helical antenna 71 to the ground side of the unbalanced transmission line 42.

Thereby, in the antenna device 62, the leakage current flows from the ground side of the unbalanced transmission line 42 to the shield case to prevent this shield case from operating as an antenna so that the above described shield case can function solely as essential electrical shield plate and ground.

Thus, in this cellular telephone 62, deterioration of the antenna characteristics of this cellular telephone 60 in the vicinity of a human body can be sizably reduced in consideration of the portion due to the shield case being thus made not to operate as an antenna even if the housing 61 is grabbed by the hand of a user and the housing 61 approaches the head of a user, and the power to be absorbed by a human body from this shield case can be controlled.

Incidentally, in the antenna device 62, when only the first helical antenna 68 is used at the time of reception, the transmission-reception circuit 41 supplies the first helical antenna 68 with power via the unbalanced transmission line 42 so as to operate this first helical antenna 68 as an antenna.

Thus, the cellular telephone 60 operates by repeating in a time-shared fashion the transmission processing mode to actually transmit and process transmission signals, the comparison processing mode to compare and process the levels of reception signals, and the reception processing mode to receive and process the reception signals, and at the time of the transmission processing mode, the transmission-reception circuit 41 supplies the rod antenna 70 or the second helical antenna 71 and the first helical antenna 68 with the transmission signals made of high frequency signals sequentially via the unbalanced transmission line 42 and the balun 46, and thereby transmits these transmission signals to the base station (not shown) via the rod antenna 70 or the second helical antenna 71 and the first helical antenna 68.

In addition, the cellular telephone 60, at the time of the comparison processing mode, switches and controls the first and second switches 78 and 79 rapidly, and brings the rod antenna 70 or the second helical antenna 71 and the first helical antenna 68 into electrical connection sequentially with the transmission-reception circuit 41 via the unbalanced transmission line 42 and the balun 46 so as to supply with the reception signals made of high frequency signals, which are transmitted from the base station and received via this rod antenna 70 or the second helical antenna 71 and the first helical antenna 68, to the transmission-reception circuit 41 sequentially via the balun 46 as well as the unbalanced transmission line 42, and at the same time, with the transmission-reception circuit 41 being brought into electrical connection with only this second helical antenna 68 via the unbalanced transmission line 42, to supply the reception signals, which are transmitted from the base station and received via this first helical antenna 68, to the transmission-reception circuit 41 sequentially via the balun 46 as well as the unbalanced transmission line 42.

Thereby, the cellular telephone 60 compares the level of the reception signals received by this rod antenna 70 or the second helical antenna 71 and the first helical antenna 68 with the level of the reception signals received only by the first helical antenna 68, and selects the antenna element that has received the reception signals of higher level.

In addition, the cellular telephone 60 selects the rod antenna 70 or the second helical antenna 71 and the first helical antenna 68 as the antenna which has received the reception signals of the higher level with this comparison processing mode, and then switches and controls the first and second switches 78 and 79 in the subsequent reception processing mode, and brings the rod antenna 70 or the second helical antenna 71 and the first helical antenna 68 into electrical connection with the transmission-reception circuit 41 sequentially via the balun 46 and the unbalanced transmission line 42 so as to supply the transmission-reception circuit 41 with the reception signals which have been transmitted from the base station and received via this rod antenna 70 or the second helical antenna 71 and the first helical antenna 68.

On the other hand, the cellular telephone 60 selects only the first helical antenna 68 as the antenna which has received the reception signals of the higher level with this comparison processing mode, and then switches and controls the first and second switch device 78 and 79 in the subsequent reception processing mode, and brings only this second helical antenna 68 into electrical connection with the transmission-reception circuit 41 via the unbalanced transmission line 42 so as to supply the transmission-reception circuit 41 with the reception signals which have been transmitted from the base station and received via this first helical antenna 68.

Thereby, this cellular telephone 60, at the time of the reception mode, selectively switches for use the antenna element for reception in accordance the level of the reception signals with the diversity reception system so as to be able to selectively receive the reception signals of high levels all time and reduce multi-path phasing.

In addition, the cellular telephone 60 uses the first helical antenna 68 as the antenna element in accordance with the levels of the reception signals at the time of the reception mode, and then, as described above the shield case operates as an antenna so that the antenna characteristics in the vicinity of a human body are deteriorated similarly to the conventional cellular telephone, and at the time when both of the rod antenna 70 or the second helical antenna 71 and the first helical antenna 68 are used as an antenna element for reception in accordance with the levels of reception signals at the time of this reception mode and at the time when both of this rod antenna 70 or the second helical antenna 71 and the first helical antenna 68 are used as an antenna element for transmission at the time of this transmission mode, the balanced-to-unbalanced transforming function of the balun 46 can prevent the shield case from operating as an antenna, and thus deterioration of the antenna characteristics in the vicinity of a human body can be sizably reduced.

Incidentally, this cellular telephone 60, in which the antenna section 67 is provided so as to be able to be retracted and pulled out freely, is used with this antenna section 67 pulled out at the time of communication, but when it is being carried, will come into the waiting state with the antenna section 67 to be pushed into the housing 61 in order that it is possible to prevent its portability from being hampered.

Incidentally, in the case of this first practical embodiment, in the antenna device 62, the rod antenna 70 is disposed with its elongated direction approximately in parallel along the elongated direction of the box, and the first helical antenna 68 is disposed with the central axis of its spiral (this hereinafter to be referred to as the first central axis) approximately perpendicular to the box elongated direction, and the second helical antenna 71 is disposed with the central axis of its spiral (this hereinafter to be referred to as the second central axis) approximately in parallel to the box elongated direction.

Accordingly, in this antenna device 62, the rod antenna 70 as Well as the second helical antenna 71 can improve the level of polarization on a surface approximately in parallel along the box elongated direction, and the first helical antenna 68 is made to have its first central axis approximately perpendicular to the box elongated direction so that the level of polarization on the surface approximately in parallel along the direction approximately perpendicular to this box elongated direction can be improved.

In addition thereto, in the antenna device 62, thus the level of polarization on the surface approximately in parallel along the box elongated direction and the direction perpendicular to the box elongated direction can be improved so that according thereto the level of polarization on the surface approximately in parallel along the predetermined direction between this box elongated direction and the direction perpendicular to the box can also be improved.

Accordingly, the cellular telephone 60 can implement transmission and reception to and from the base station comparatively stably even if the figure of this cellular telephone 60 changes.

(3) Second Practical Embodiment

Figure 26A:
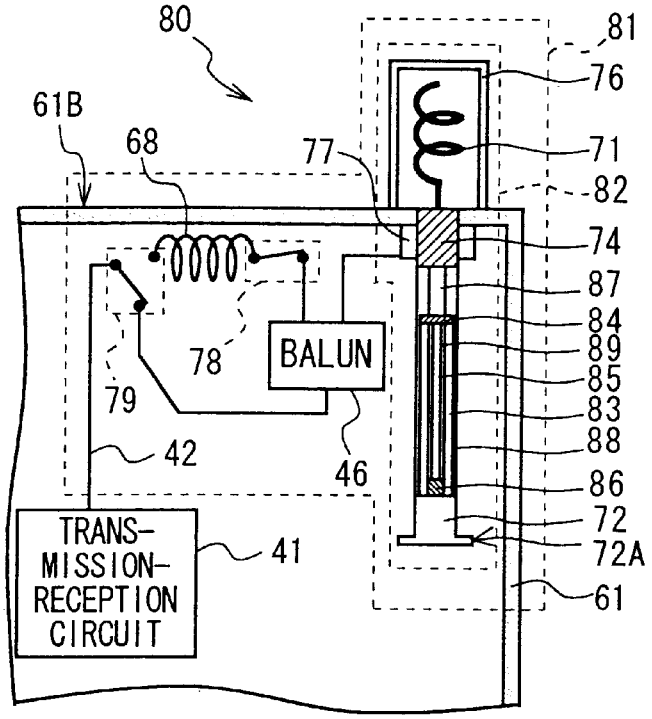
FIGS. 26A and 26B are block diagrams showing an inner configuration of a cellular telephone according to a second practical embodiment.
Figure 26B:
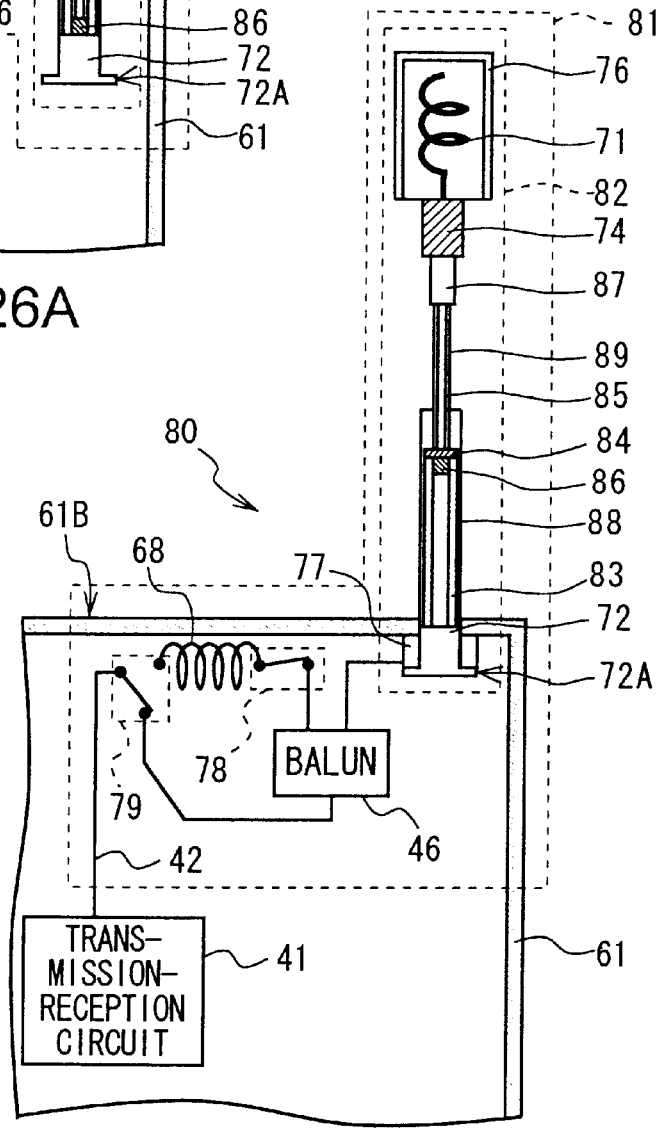

FIGS. 26A and 26B, in which the same numerals as in FIGS. 24A and 24B are given to show the corresponding portions, show a cellular telephone 80 according to the second practical embodiment, which is configured as in the cellular telephone 60 (FIGS. 24A and 24B) according to the above described first practical embodiment except the configuration of the antenna section 82 of the antenna device 81.

Figure 27A:
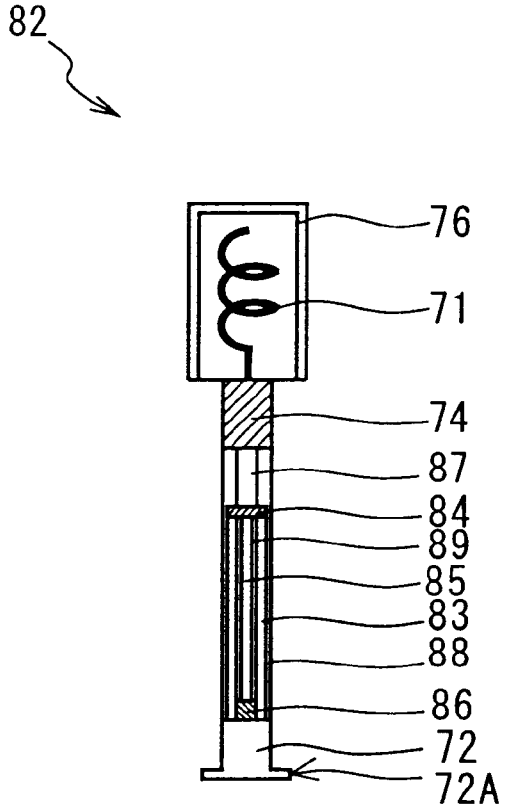
FIGS. 27A and 27B are schematic sectional views showing a configuration of an antenna section.
Figure 27B:
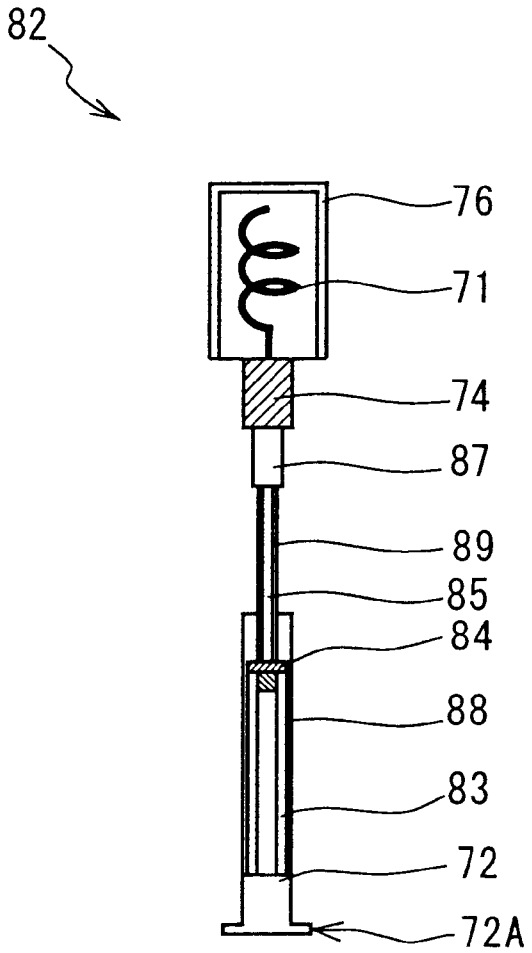

In FIGS. 27A and 27B in which the same numerals denotes the corresponding portions in FIGS. 24A and 24B, this antenna section 81 comprises a first antenna half part 83 and a second antenna half part 85, the first antenna half part 83 made of conductive cylindrical member with its lower end with which the power supplying member for the rod 72 is brought into electrical and mechanical connection and with its upper end where the stopper for pull-out 84 is provided, and the second antenna half part 85 made of conductive stick form member being inserted through the cavity of this first antenna half part 83 in such a fashion so as to be able to be retracted and pulled out freely.

In addition, the lower end of the second antenna half part 85 located inside the cavity of the first antenna half part 83 is brought into electrical and mechanical connection with a sliding spring 86 made of conductive member and the upper end of the second antenna half part 85 is brought into mechanical connection with the connection portion 87 made of non-conductive member.

In addition, this connection portion 87 is brought into mechanical connection with a power supply member for a helical 74, and thereby the second antenna half part 85 and the second helical antenna 71 are brought into mechanical connection with this connection portion 87, and nevertheless are electrically separated.

Moreover, these first and second antenna half parts 83 and 85 are respectively covered by antenna covers 88 and 89.

Thereby the antenna section 82 forms an elastic rod antenna with the sliding sprint 86 sliding inside the cavity of this first antenna half part 83 when the second antenna half part 85 is thrust into, or pulled out of, the first antenna half part 83 so that the first antenna half part 83 and the second antenna half part 85 are brought into electrical connection via this sliding spring 86.

Actually, this antenna device 81 (FIGS. 26A and 26B) will thrust the second antenna half side 85 into the first antenna half side 83 so as to thrust this antenna part 82 throughout inside the housing 61 when the antenna cover for the helical 76 is pushed in the retracting direction at the time of when the antenna section 82 is retracted.

In addition, in the antenna device 81, the antenna cover for the helical 76 is thrust onto the upper surface 61B of the housing 61, and then the second antenna half side 85 in its entirety is thrust into the first antenna half part 83 so that the shortened rod antenna is formed by this first and second antenna half parts 83 and 85, and under this state, the antenna section 82 is retracted inside the housing 61 for housing.

Incidentally, in the antenna device 81, at this time, the power supply member for the helical 74 is brought into electrical connection with the antenna power supply terminal 77 so that the second helical antenna 71 is brought into electrical connection with the balanced side of the balun 46.

In addition, in the antenna device 81, when the antenna section 82 is pulled out, the antenna cover for the helical 76 is pulled in the pulling direction so that the antenna section 82 is pulled out outside from the upper surface 61B of the housing 61 while the second antenna half part 85 is pulled out from the first antenna half section 83.

In addition, in the antenna device 81, when the protrusion 72A of the power supply member for the rod 72 is thrust onto the antenna power supply terminal 77, the second antenna half part 85 is fully pulled out from the first antenna half part 83 and thus the rod antenna, which is extended by these first and second antenna half parts 83 and 85, is formed, and this extended rod antenna is to be pulled outside the housing 61.

Thereby, in the cellular telephone 80, when the antenna section 82 is thrust, the above described antenna section 82 is shortened to form the rod antenna, which is thrust into inside the housing 61, so that the portion of this antenna section 82 thrust into inside the housing 61 can be remarkably made short compared with the cellular telephone 60 (FIGS. 24A and 24B) according to the above described first practical embodiment.

Accordingly, in the cellular telephone 80, also in the case where the antenna section 82 can not be thrust easily due to the space occupied by a battery, etc. inside the housing 61, this antenna section 82 can be easily installed on the upper surface 61B of the housing 61 in a fashion so as to be freely retracted and pulled out.

(4) Third Practical Embodiment

Figure 28A:
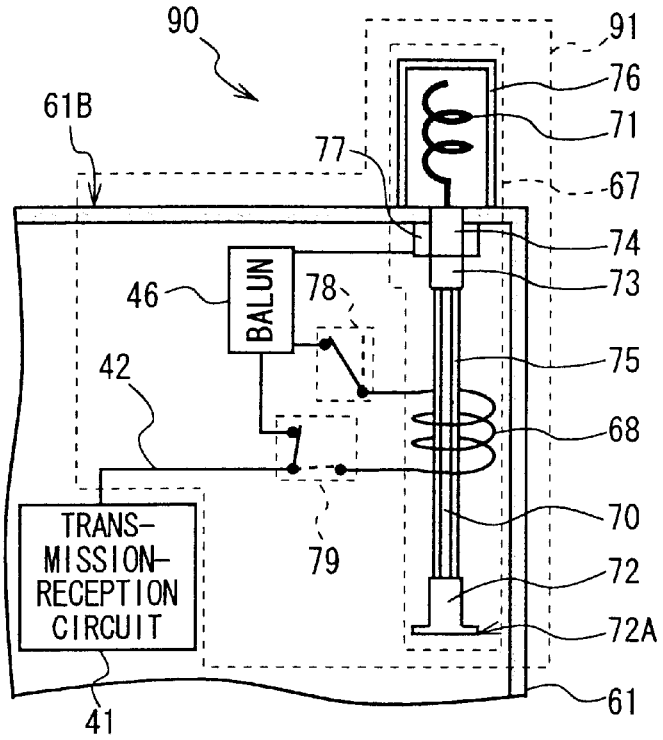
FIGS. 28A and 28B are block diagrams showing an inner configuration of a cellular telephone according to a third practical embodiment.
Figure 28B:
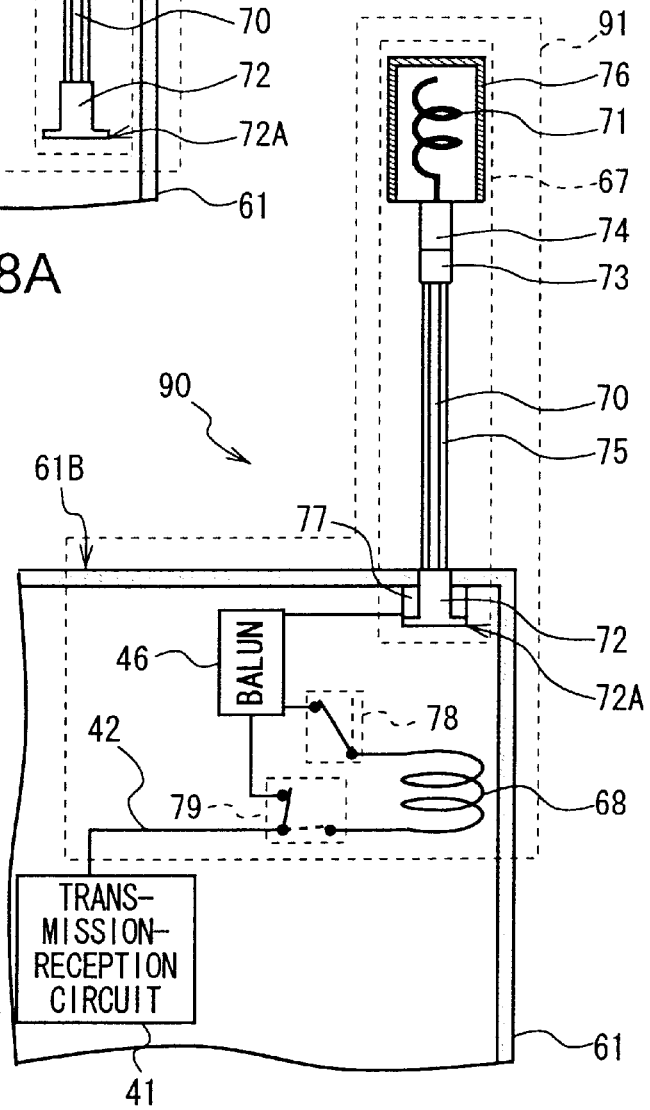

FIGS. 28A and 28B, in which the same numerals as in FIGS. 24A and 24B are given to show the corresponding portions, show a cellular telephone 90 according to the third practical embodiment, which is configured as in the cellular telephone 60 (FIGS. 24A and 24B) according to the above described first practical embodiment except the disposing location as well as the posture of the first helical antenna 68 of the antenna device 91.

The first helical antenna 68 is disposed to have the first central axis being made approximately in parallel along the box elongated direction and approximately overlapping the extended line of the first central axis of the second helical antenna 71.

In addition, in the antenna device 91, when the antenna section 67 is thrust and pulled out, the rod antenna 70 is arranged so as to be able to be retracted and pulled out so that it is inserted through this first helical antenna 68 along the first central axis.

Thus, in the antenna device 91, the first helical antenna 68 and the antenna section 67 are disposed together so that the disposition space for the first helical antenna 68 and the antenna section 67 can be made remarkably small.

Thereby, in the cellular telephone 90, the housing 61 can be made remarkably small compared with the above described first practical embodiment, and thus this cellular telephone 90 can be miniaturized.

(5) Fourth Practical Embodiment

Figure 29A:
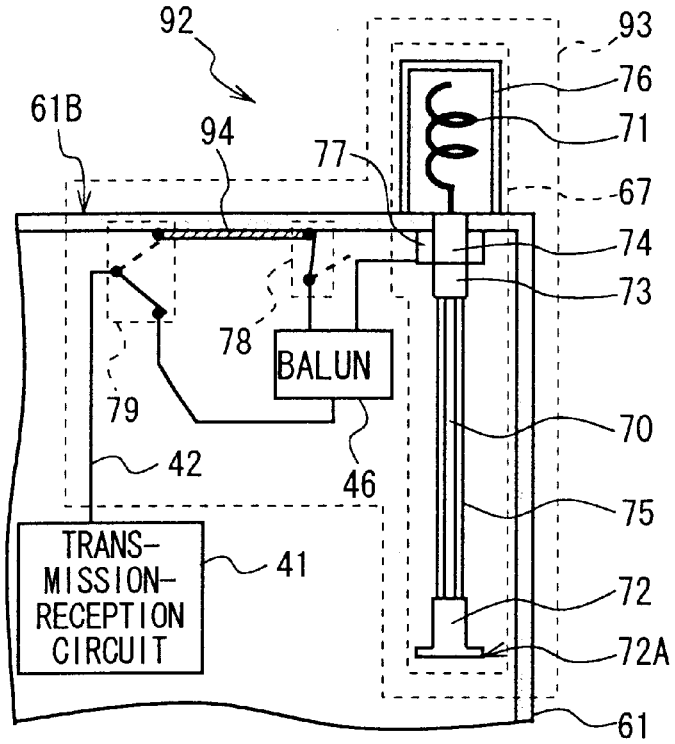
FIGS. 29A and 29B are block diagrams showing an inner configuration of a cellular telephone according to a fourth practical embodiment.
Figure 29B:
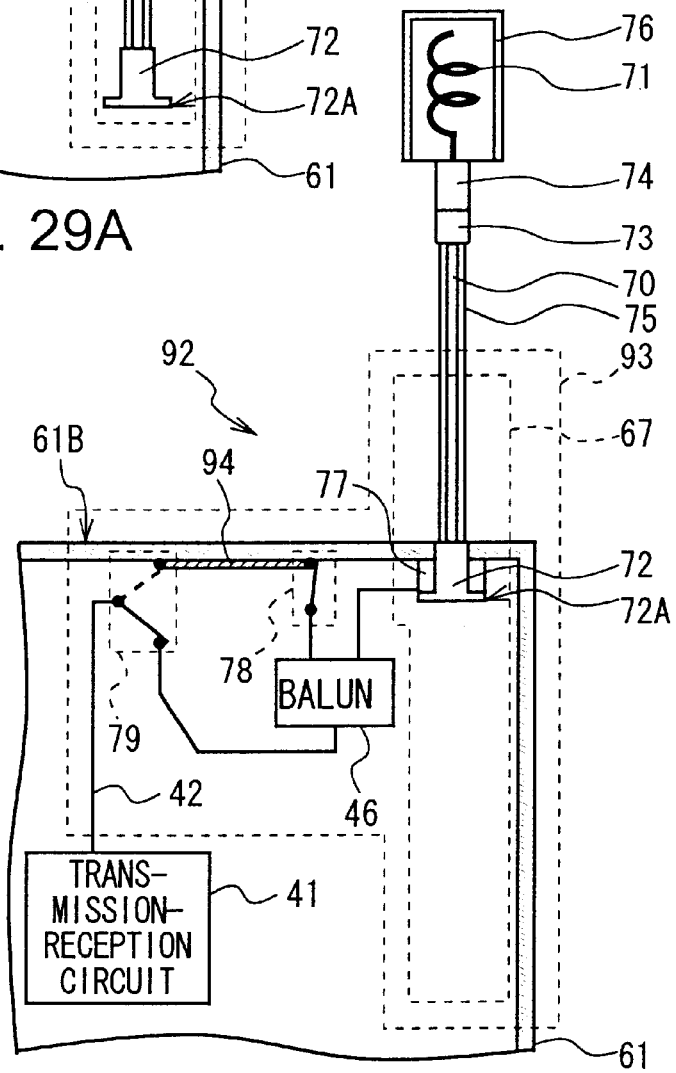

FIGS. 29A and 29B, in which the same numerals as in FIGS. 24A and 24B are given to show the corresponding portions, show a cellular telephone 92 according to the fourth practical embodiment, which is configured as in the cellular telephone 60 (FIGS. 24A and 24B) according to the above described first practical embodiment except the configuration of the antenna device 93.

Figure 30:
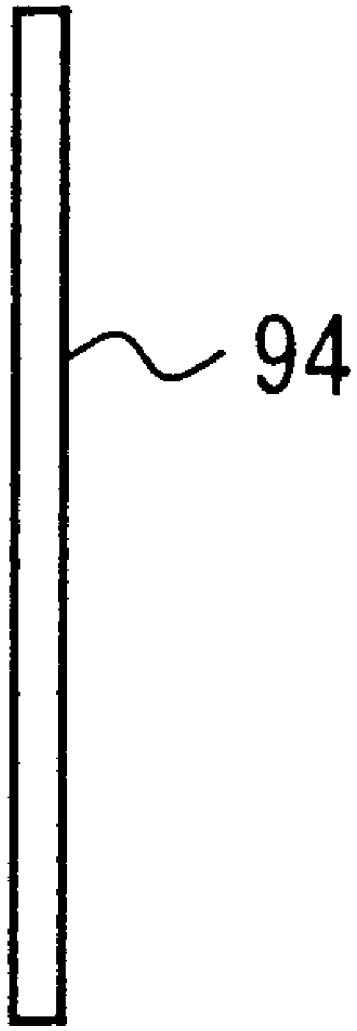
FIG. 30 is a plan view showing a configuration of sheet line antenna.

This antenna device 93 is provided with an antenna element forming a line with conductive sheet (this hereinafter to be referred to sheet line antenna) 94 as shown in FIG. 30 instead of the first helical antenna 68 (FIGS. 24A and 24B) of the cellular telephone 60 according to the above described first practical embodiment.

This sheet line antenna 94, which is selected to have approximately the same electrical length as the electrical length of the rod antenna 70 or the second helical antenna 71, is stuck onto the inner side of the upper surface 61B of the housing 61.

Thereby, in the cellular telephone 92, this sheet line antenna 94 is remarkably thin compared with the first helical antenna 68 and is disposed inside the upper surface 61B of the housing 61 so that, when a hand of a user grabbing the housing 61 and this housing 61 approach the head of the user, this sheet line antenna 94 can be made to keep away from a human body, and thus deterioration of antenna characteristics of this cellular telephone 92 in the vicinity of the human body can be reduced further.

In addition, in this cellular telephone 92, this sheet line antenna 94 can be disposed in a remarkably small space compared with the disposition space for the first helical antenna 68 inside the housing 61, and thus the housing 61 can be miniaturized along the box elongated direction.

(6) Fifth Practical Embodiment

Figure 31A:
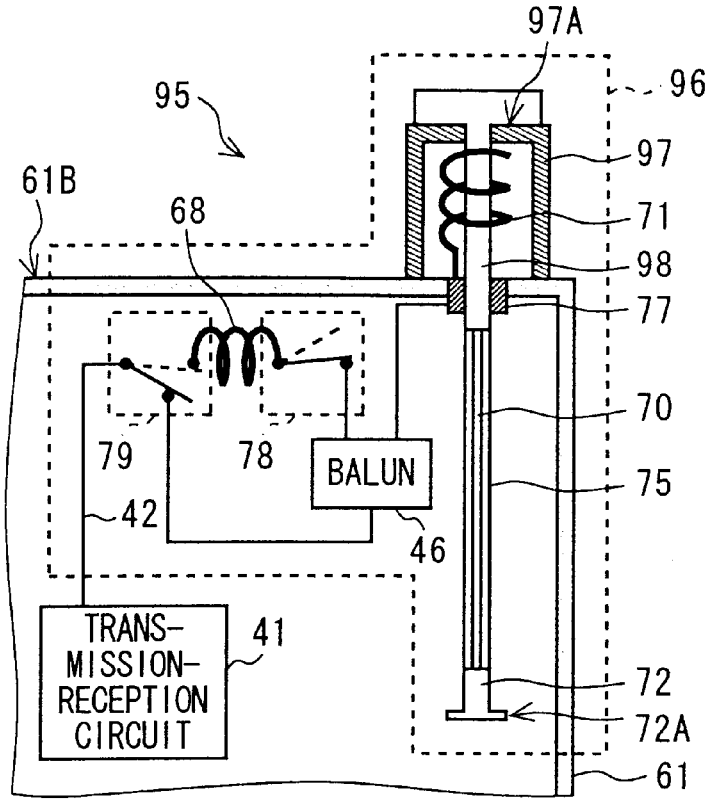
FIGS. 31A and 31B are block diagrams showing an inner configuration of a cellular telephone according to a fifth practical embodiment.
Figure 31B:
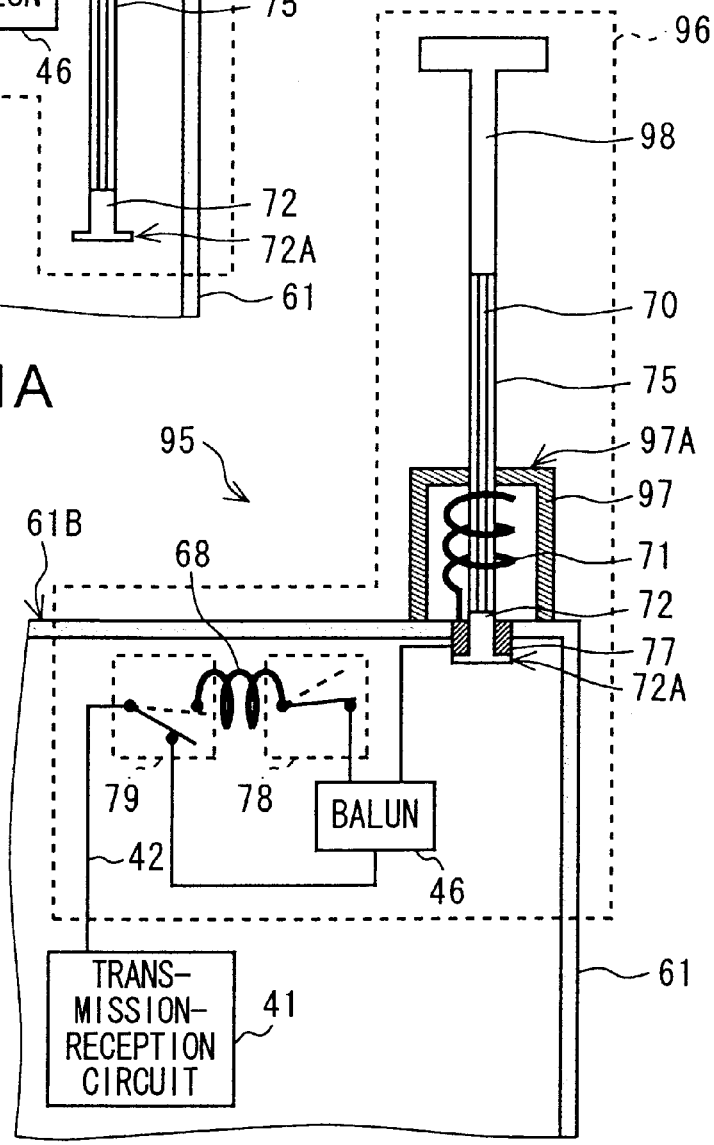

FIGS. 31A and 31B, in which the same numerals as in FIGS. 24A and 24B are given to show the corresponding portions, show a cellular telephone 95 according to the fifth practical embodiment, which is configured as in the cellular telephone 60 (FIGS. 24A and 24B) according to the above described first practical embodiment except the configuration of the antenna device 96.

This antenna device 96 has a cap-shaped antenna cover for the helical 97, which is provided in the back surface 61C side of the upper surface 61B of the housing 61, and this antenna cover for the helical 97 has an upper surface 97A, in which a rod antenna 70 is provided along the box elongated direction in a fashion so as to be able to be retracted and pulled out freely.

The lower end of this rod antenna 70 is brought into electrical and mechanical connection with the power supply member for the rod 72, and the upper end of the above described rod antenna 70 is brought into mechanical connection with an antenna knob 98 having T form sectional view made of non-conductive member.

In addition, inside the antenna cover for the helical 97 has the second helical antenna 71 for fixing, the second central axis of which is disposed approximately in parallel along the elongated direction of the rod antenna 70, and the lower end of this second helical antenna 70 is brought into electrical and mechanical connection with the antenna power supply terminal 77.

In addition, in the antenna device 96, the rod antenna 70 is arranged to be inserted into the second helical antenna 71 and the antenna power supply terminal 77 along the second central axis so as to be thrust and pulled out.

Actually, in this antenna device 96, at the time when the rod antenna 70 is retracted, the antenna knob 98 is pushed in the direction of retracting so as to be thrust onto the upper surface 97A of the antenna cover for the helical 97, and then, this antenna knob 98 is thrust over the second helical antenna 71 and the antenna power supply terminal 77, and thus the rod antenna 70 is electrically separated from the antenna power supply terminal 77 and housed inside the housing 61.

In addition, in the antenna device 96, under this state at the time of transmission and at the time of reception, the transmission-reception circuit 41, which supplies this first and second helical antenna 68 and 71 with power sequentially via the unbalanced transmission line 42 and the balun 46, operates these first and second helical antenna 68 and 71 as an antenna of approximately balanced type, and at this time balanced-to-unbalanced transforming function of the balun 46 prevents the leakage current from flowing from the second helical antenna 71 to the ground side of the unbalanced transmission line 42.

In addition, in the antenna device 96, at the time when the rod antenna 70 is pulled out, the antenna knob 98 is pulled in the direction of drawing so that the power supply member for the rod 72 is thrust onto the antenna power supply terminal 77, then the rod antenna 70 is pulled out outside from the upper surface 97A of the antenna cover for the helical 97, and the lower end of this rod antenna 70 is brought into electrical connection with the lower end of second helical antenna 71 via the power supply member of the rod 72 and the antenna power supply terminal 77 so that a compound antenna is formed from the above-described rod antenna 70 and the second helical antenna 71.

In addition, in this-antenna device 96, under this state, at the time of transmission and at the time of power supply, the transmission-reception circuit 41 provides these first helical antenna 68 and the compound antenna with power sequentially via the unbalanced transmission line 42 and the balun 46 so as to operate the above described first helical antenna 68 and the compound antenna as an antenna of approximately balanced type and at that time, balanced-to-unbalanced transforming function of the balun 46 prevents the leakage current from flowing from the compound antenna to the ground side of the unbalanced transmission line 42.

Accordingly, in this cellular telephone 95, at the time of transmission and at the time of reception, in the case where the second helical antenna 71 or the compound antenna is used together with the first helical antenna 63, as in the above described first practical embodiment, the leakage current is prevented from flowing from the ground side of the unbalanced transmission line 42 to the shield case so as not to operate this shield case as an antenna, and thus causes the shield case to function only as an essential electrical shield plate and the ground.

Thereby, in this cellular telephone 95, due to the portion of the shield case not to operate as an antenna, even if the housing 61 is grabbed by a hand of a user and the housing 61 approaches the head of a user so that this shield case is disposed in the vicinity of a human body, deterioration of the antenna characteristics of the cellular telephone 95 in the vicinity of the human body can be sizably reduced, and the power absorbed by the human body from the shield case i s controlled to sizably reduce the SAR.

Incidentally, in this cellular telephone 95, even in the case where the second helical antenna 71 can hardly be disposed inside the housing 61 due to the space occupied by a battery, etc, this second helical antenna 71 can be installed easily.

(7) Sixth Practical Embodiment

Figure 32A:
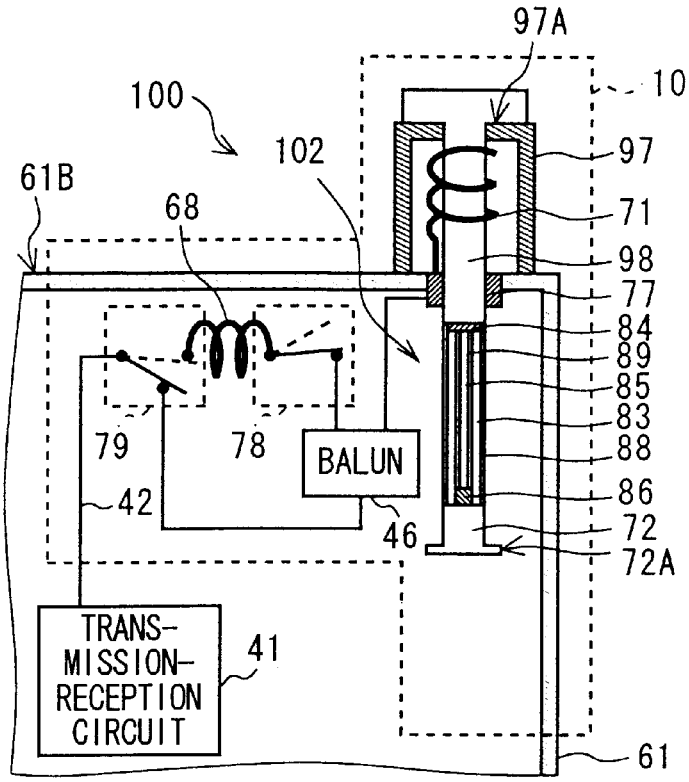
FIGS. 32A and 32B are block diagrams showing an inner configuration of a cellular telephone according to a sixth practical embodiment.
Figure 32B:
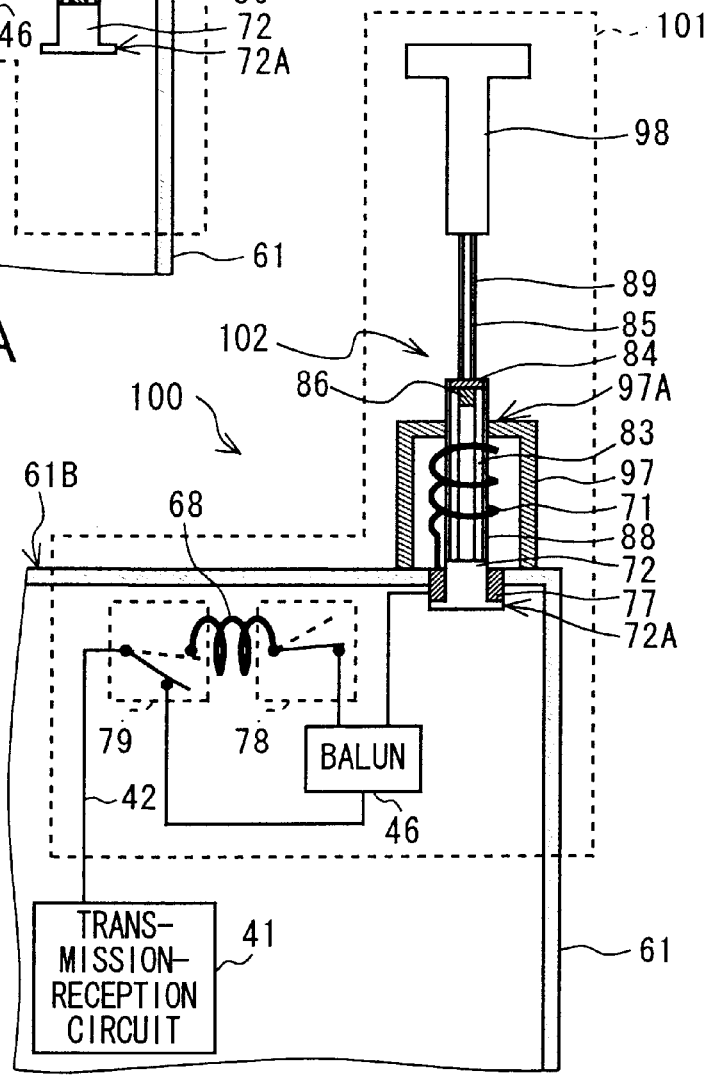

FIGS. 32A and 32B, in which the same numerals as in FIGS. 31A and 31B are given to show the corresponding portions, show a cellular telephone 100 according to a sixth practical embodiment, which is configured as in the cellular telephone 95 (FIGS. 31A and 31B) according to the above described fifth practical embodiment except the configuration of the antenna device 101.

Figure 33A:
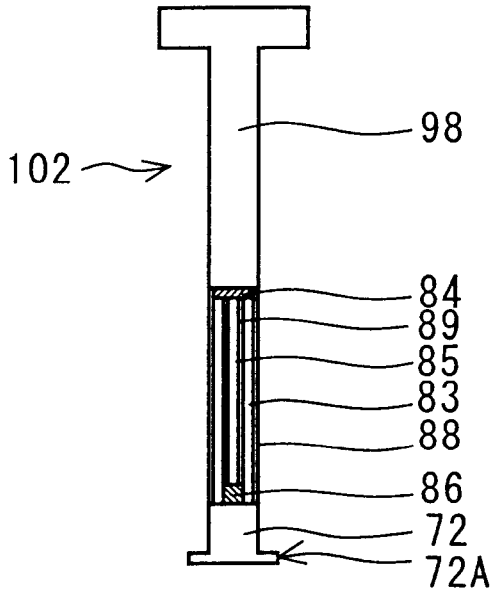
FIGS. 33A and 33B are schematic sectional views showing a configuration of a rod antenna.
Figure 33B:
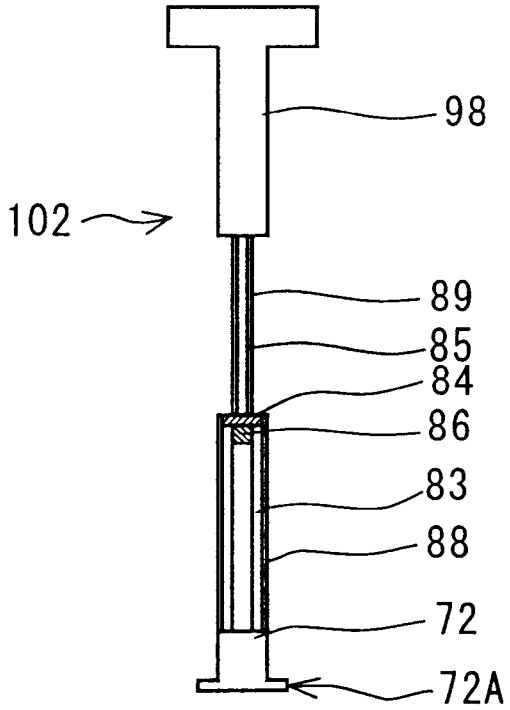

In FIGS. 33A and 33B, in which the same numerals as in FIGS. 31A and 31B as well as FIGS. 27A and 27B are given to show the corresponding portions, the antenna device 101 has an elastic rod antenna 102 in which the second antenna half part 85 is inserted into the first antenna half part 83 in a fashion so as to be retracted and pulled out freely, and the upper end of this second antenna half part 85 is brought into mechanical connection with the antenna knob 98.

In addition, in the antenna device 101 (FIGS. 32A and 32B), at the time when the rod antenna 102 is retracted, when the antenna knob 98 is pushed toward the retracting direction, the rod antenna 102 is shortened in such a way that the second antenna half part 85 is thrust into the first antenna half side 83, and this shortened rod antenna 102 is thrust into inside the housing 61 for housing.

Incidentally, in this antenna device 101, the rod antenna 102, which has been shortened at this time, is electrically separated from the second helical antenna 71.

In addition, in the antenna device 101, at the time when the rod antenna 102 is pulled out, the antenna knob 98 is pulled toward the pulling direction so that the power supply member for the rod 72 is thrust onto the antenna power supply terminal 77, then the second antenna half part 85 is pulled out from the first antenna half part 83 to extend the rod antenna 102, and this extended rod antenna 102 is pulled outside from the upper surface 97A of the antenna cover for the helical 97, and this rod antenna 102 as well as the second helical antenna 71 forms a compound antenna.

Thus, in the cellular telephone 100, at the time when the rod antenna 102 is thrust, this rod antenna 102 is shortened so as to be thrust inside the housing 61 so that the portion of this rod antenna 102 to be thrust inside the housing 61 can be remarkably shortened compared with the cellular telephone 95 (FIGS. 31A and 31B) according to the above described fifth practical embodiment.

Accordingly, in this cellular telephone 100, even in the case where the rod antenna 102 can hardly be thrust inside the housing 61 due to the space occupied by the battery, etc., this rod antenna 102 can be installed easily.

(8) Seventh Practical Embodiment

Figure 34A:
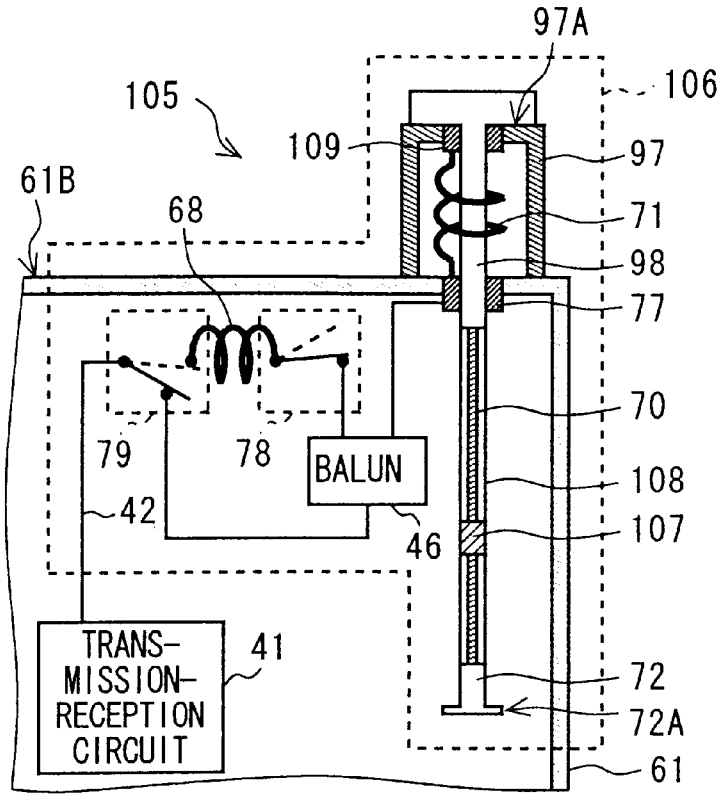
FIGS. 34A and 34B are block diagrams showing an inner configuration of a cellular telephone according to a seventh practical embodiment.
Figure 34B:
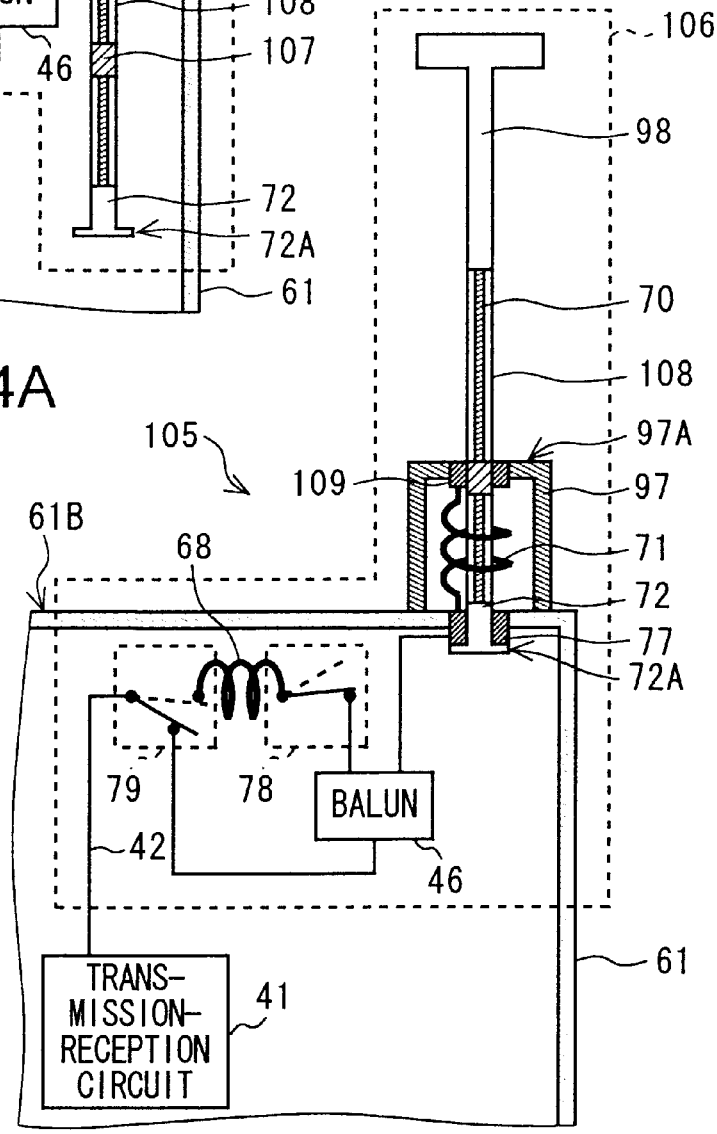

FIGS. 34A and 34B, in which the same numerals as in FIGS. 31A and 31B are given to show the corresponding portions, show a cellular telephone 105 according to the seventh practical embodiment, which is configured as in the cellular telephone 95 (FIGS. 31A and 31B) according to the above described fifth practical embodiment except the configuration of the antenna device 106.

In this antenna device 106, a short-circuiting member 107 made of conductive member is provided at a predetermined location along the elongated direction of the rod antenna 70 so as to be brought into electrical and mechanical connection with this rod antenna 70, and the above described rod antenna 70 is covered with the antenna cover for the rod 108 made of non-conductive member so as to expose the peripheral surface of this short-circuiting member 107.

In addition, an excavation is gouged in the upper surface 97A of the antenna cover for the helical 97, and a terminal for the helical short-circuiting terminal 109 formed into a ring made of conductive member is fitted into the above described excavation. In addition, this terminal for the helical short-circuiting terminal 109 is brought into electrical and mechanical connection with the upper end of the second helical antenna 71.

Thereby, in the antenna device 106, at the time when the rod antenna 70 is retracted, the antenna knob 98 is pushed in the direction of retracting so as to be thrust onto the upper surface 97A of the antenna cover for the helical 97, and then, this antenna knob 98 is inserted into the terminal for the helical short-circuiting terminal 109, the second helical antenna 71 and the antenna power supply terminal 77, and thus the rod antenna 70 is electrically separated from the antenna power supply terminal 77 and housed inside the housing 61.

In addition, in the antenna device 106, at the time when the rod antenna 70 is pulled out, the antenna knob 98 is pulled in the direction of drawing so that the power supply member for the rod 72 is thrust onto the antenna power supply terminal 77, then this power supply member for the rod 72 is brought into electrical connection with the antenna power supply terminal 77, and at the same time, the short-circuiting member 107 is brought into electrical connection with the terminal for the helical short-circuiting terminal 109, and thus the upper end and the lower end of the second helical antenna 71 are short-circuited with the rod antenna 70 to form a compound antenna.

Here, in the antenna device 106, under this state, at the time of transmission and at the time of reception, the transmission-reception circuit 41 supplies the first helical antenna 68 and the compound antenna with power sequentially via the unbalanced transmission line 42 and the balun 46, so as to operate this first helical antenna 68 an antenna.

In addition, in the antenna device 106, in the compound antenna, the electrical length of the second helical antenna 71 appears to change due to short-circuiting to the rod antenna 70, and the resonance point toward the working frequency of this second helical antenna 71 shifts so as to cause only the rod antenna 70 to operate as an antenna without causing the second helical antenna 71 to operate as an antenna.

That is, in the antenna device 106, the first helical antenna 68 and the rod antenna 70 are caused to operate as an antenna of approximately balanced type, and at this time, balanced-to-unbalanced transforming function of the balun 46 prevents the leakage current from flowing from the rod antenna 70 to the ground side of the unbalanced transmission line 42, and this prevents the leakage current from flowing from the ground side of the unbalanced transmission line 42 to the shield case so as not to cause the above described shield case to operate as an antenna.

Accordingly, in this cellular telephone 105, at the time of transmission and at the time of reception, when the second helical antenna 71 or the compound antenna is used together with the first helical antenna 68, the shield case is prevented from operating as an antenna and is caused to function only as the essential electrical shield plate and the ground, and thus deterioration of the antenna characteristics of this cellular telephone 105 in the vicinity of a human body can be remarkably reduced. In addition, the power absorbed by the human body from the shield case is controlled so that the SAR can be remarkably decreased.

(9) Eighth Practical Embodiment

Figure 35A:
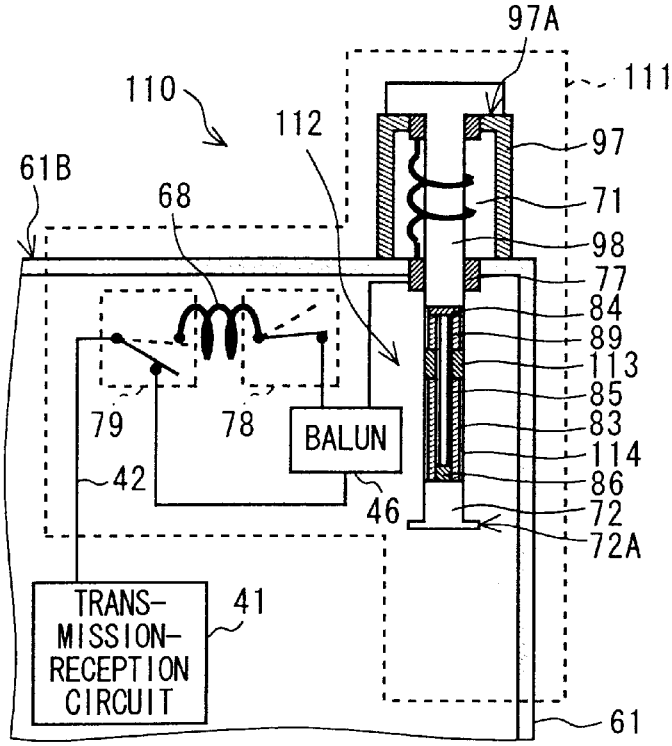
FIGS. 35A and 35B are block diagrams showing an inner configuration of a cellular telephone according to an eighth practical embodiment.
Figure 35B:
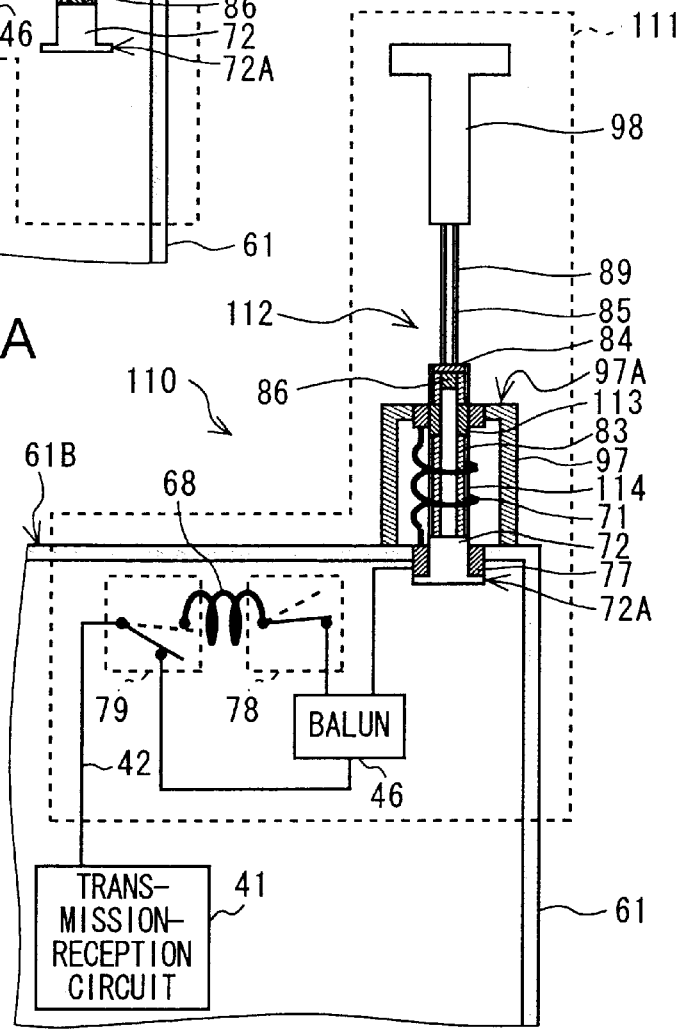

FIGS. 35A and 35B, in which the same numerals as in FIGS. 34A and 34B are given to show the corresponding portions, show a cellular telephone 110 according to the eighth practical embodiment, which is configured as in the cellular telephone 105 (FIGS. 34A and 34B) according to the above described seventh practical embodiment except the configuration of the antenna device 111.

Figure 36A:
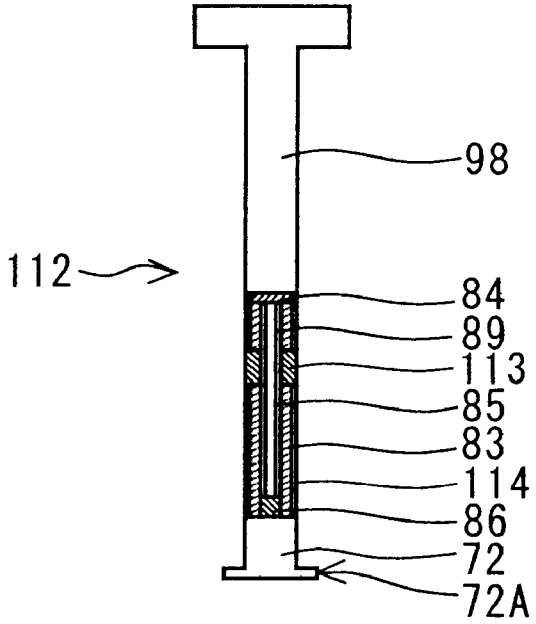
FIGS. 36A and 36B are schematic sectional views showing a configuration of an rod antenna.
Figure 36B:
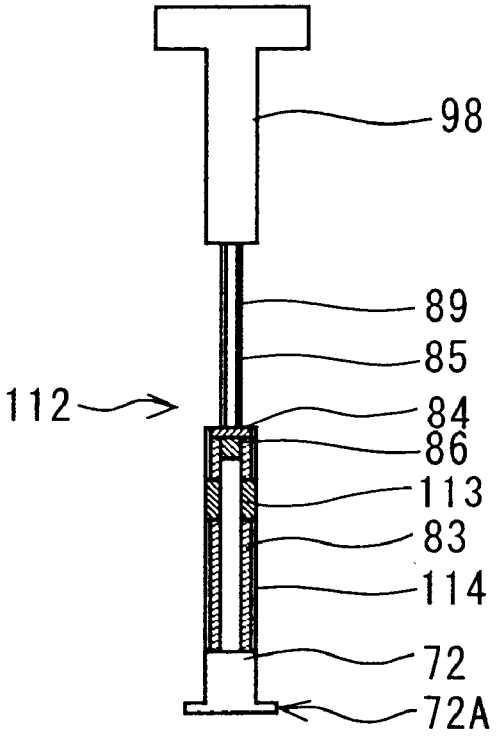

In FIGS. 36A and 36B in which the same numerals denotes the corresponding portions in FIGS. 34A and 34B as well as FIGS. 33A and 33B, the antenna device 111 has an elastic rod antenna 112, in which a second antenna half part 85 is inserted through into a first antenna half part 83 in such a fashion so as to be able to be retracted and pulled out freely, and a short-circuiting member 113 is brought into electrical and mechanical connection with a predetermined location of the first antenna half 83, and this first antenna half side 83 is covered with the antenna cover for the rod 114 made of non-conductive member so as to expose the peripheral surface of the short-circuiting member 113.

In addition, in the antenna device 111 (FIGS. 35A and 35B), at the time when the rod antenna 112 is retracted, when the antenna knob 98 is pushed toward the retracting direction, the rod antenna 112 is shortened in such a way that the second antenna half part 85 is thrust into the first antenna half side 83, and this shortened rod antenna 112 is thrust into inside the housing 61 for housing. Incidentally, in this antenna device 111, the rod antenna 112, which has been shortened at this time, is electrically separated from the second helical antenna 71.

In addition, in the antenna device 111, at the time when the rod antenna 112 is pulled out, the antenna knob 98 is pulled toward the pulling direction so that the power supply member for the rod 72 is thrust onto the antenna power supply terminal 77, then the second antenna half part 85 is pulled out from the first antenna half part 83 to extend the rod antenna 112 so that the power supply member for the rod 72 is brought into electrical connection with the antenna power supply terminal 77 and the short-circuiting member 113 is brought into electrical connection with the terminal for the helical short-circuiting terminal 109, and thus the upper end and the lower end of the second helical antenna 71 are short-circuited with the extended rod antenna 112, and a compound antenna is formed.

Thus, in the cellular telephone 110, at the time when the rod antenna 112 is retracted, this rod antenna 112 is shortened so as to be thrust inside the housing 61 so that the portion of this rod antenna 112 to be thrust inside the housing 61 can be remarkably shortened compared with the cellular telephone 105 (FIGS. 34A and 34B) according to the above described seventh practical embodiment.

Accordingly, in this cellular telephone 110, even in the case where the rod antenna 112 can hardly be thrust inside the housing 61 due to the space occupied by the battery, etc., this rod antenna 112 can be installed easily.

(10) Ninth Practical Embodiment

Figure 37A:
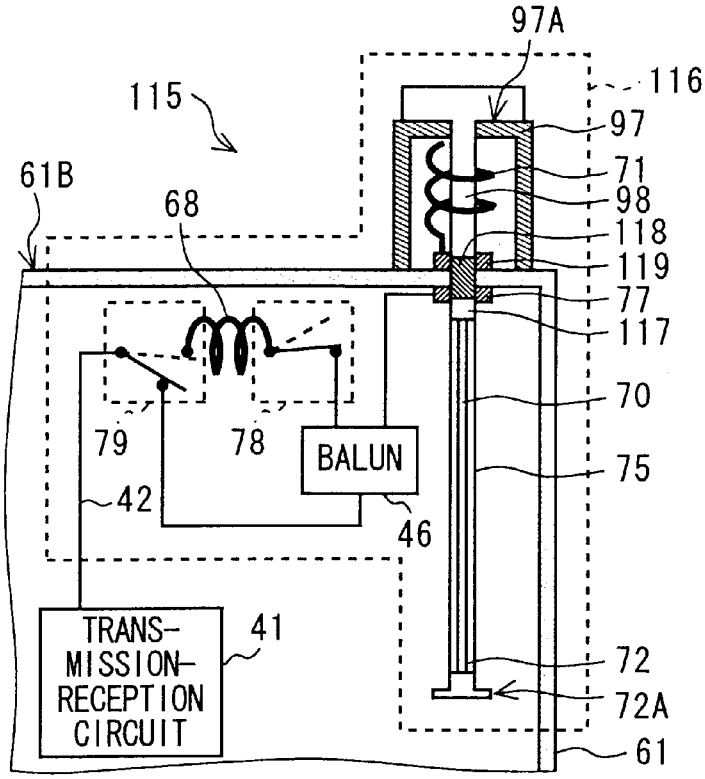
FIGS. 37A and 37B are block diagrams showing an inner configuration of a cellular telephone according to a ninth practical embodiment.
Figure 37B:
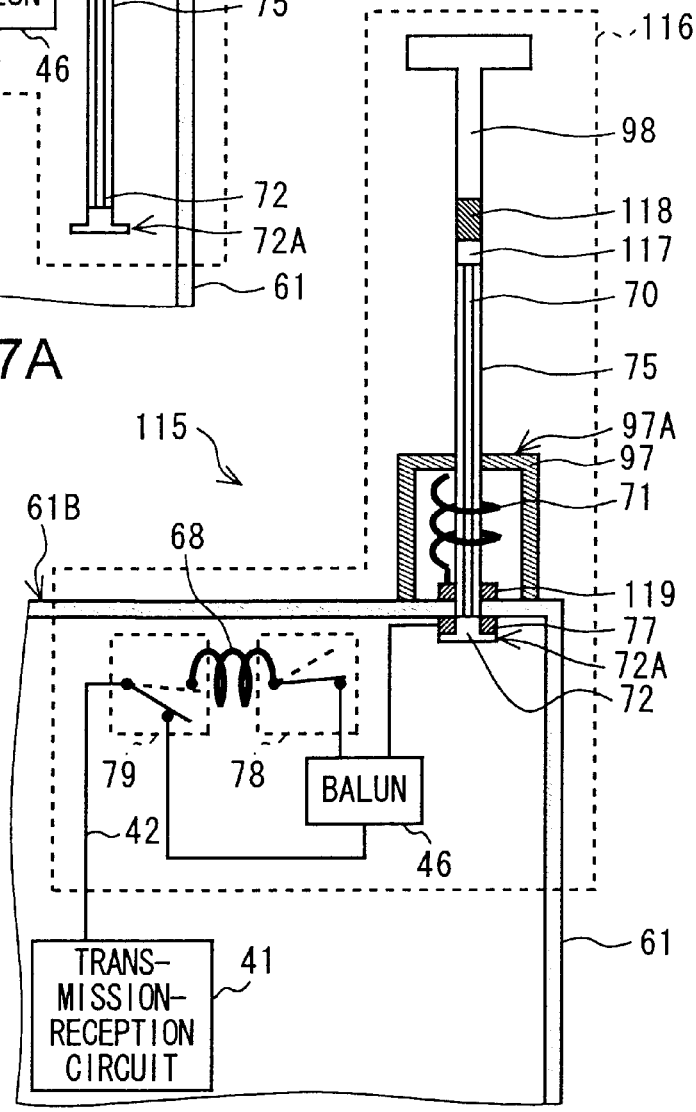

FIGS. 37A and 37B, in which the same numerals as in FIGS. 31A and 31B are given to show the corresponding portions, show a cellular telephone 115 according to a ninth practical embodiment, which is configured as in the cellular telephone 95 (FIGS. 31A and 31B) according to the above described fifth practical embodiment except the configuration of the antenna device 116.

In this antenna device 116, a connecting section 117 made of non-conductive member is brought into mechanical connection with the upper end of the rod antenna 70, and an antenna member 118 made of conductive member is brought into mechanical connection with this connecting section 117, and moreover, this antenna member 118 is provided with an antenna knob 99. Thereby, this rod antenna 70 and the antenna member 118 are brought into mechanical connection by the connecting section 117, but are separated electrically.

In addition in the predetermined location in the upper surface 61B of the housing 61, a power supply member 119 for the helical, which is located inside the antenna cover for the helical 97 and is formed as a ring made of conductive member so as to be electrically separated from the antenna power supply terminal 77, is disposed, and the lower end of the second helical antenna 71 is brought into electrical and mechanical connection with this power supply member 119 for the helical.

In addition, in this antenna device 116, the rod antenna 70 is arranged to be inserted into the second helical antenna 71 and the power supply member 119 for the helical and the antenna power supply terminal 77 so as to be thrust and pulled out.

Actually, in this antenna device 116, at the time when the rod antenna 70 is retracted, the antenna knob 98 is pushed in the direction of retracting so as to be thrust onto the upper surface 97A of the antenna cover for the helical 97, and then, the antenna member 118 is brought into electrical connection with the power supply member 119 for the helical and the antenna power supply terminal 77, and thus this antenna member 118 is brought into electrical connection with the second helical antenna 71, and thus this antenna member 118 and the second helical antenna 71 form a compound antenna.

Thereby, in this antenna device 116, under this state at the time of transmission and at the time of reception, the transmission-reception circuit 41, which supplies the first helical antenna 68 and this compound antenna with power sequentially via the unbalanced transmission line 42 and the balun 46, operates these first helical antenna 68 and the compound antenna as an antenna of approximately balanced type, and at this time balanced-to-unbalanced transforming function of the balun 46 prevents the leakage current from flowing from the compound antenna to the ground side of the unbalanced transmission line 42, and thus prevents the shield case from operating as an antenna.

In addition, in the antenna device 116, at the time when the rod antenna 70 is pulled out, the antenna knob 98 is pulled in the direction of drawing so that the protrusion 72A of the power supply member for the rod 72 is thrust onto the antenna power supply terminal 77, then this power supply member for the rod 72 is brought into electrical connection with the antenna power supply terminal 77, and the rod antenna 70 is brought into electrical contact with the balanced side of the balun 46, and at the same time, the second helical antenna 71 is electrically separated from the balanced side of the balun 46.

Thereby, in the antenna device 116, under this state, at the time of transmission and at the time of reception, the transmission-reception circuit 41 provides the first helical antenna 68 and the rod antenna 70 with power sequentially via the unbalanced transmission line 42 and the balun 46 so as to operate this first helical antenna 68 and the rod antenna 70 as an antenna of approximately balanced type and at that time, balanced-to-unbalanced transforming function of the balun 46 prevents the leakage current from flowing from the rod antenna 70 to the ground side of the unbalanced transmission line 42, and thus prevents the shield case to operate as an antenna.

Accordingly, in this cellular telephone 115, at the time of transmission and at the time of reception, when the compound antenna or the rod antenna 70 is used together with the first helical antenna 68, the shield case is not caused to operate as an antenna but is caused to function only as the essential electrical shield plate and the ground, and thus deterioration of the antenna characteristics of this cellular telephone 115 in the vicinity of a human body can be remarkably reduced, and at the same time, the power absorbed by the human body from this shield case is controlled so that the SAR can be remarkably decreased.

(11) Tenth Practical Embodiment

Figure 38A:
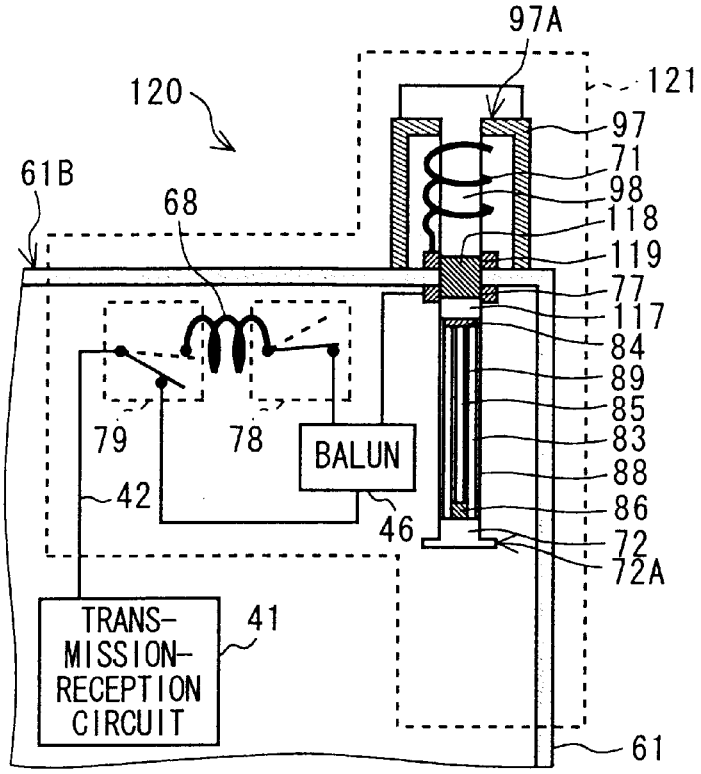
FIGS. 38A and 38B are block diagrams showing an inner configuration of a cellular telephone according to a tenth practical embodiment.
Figure 38B:
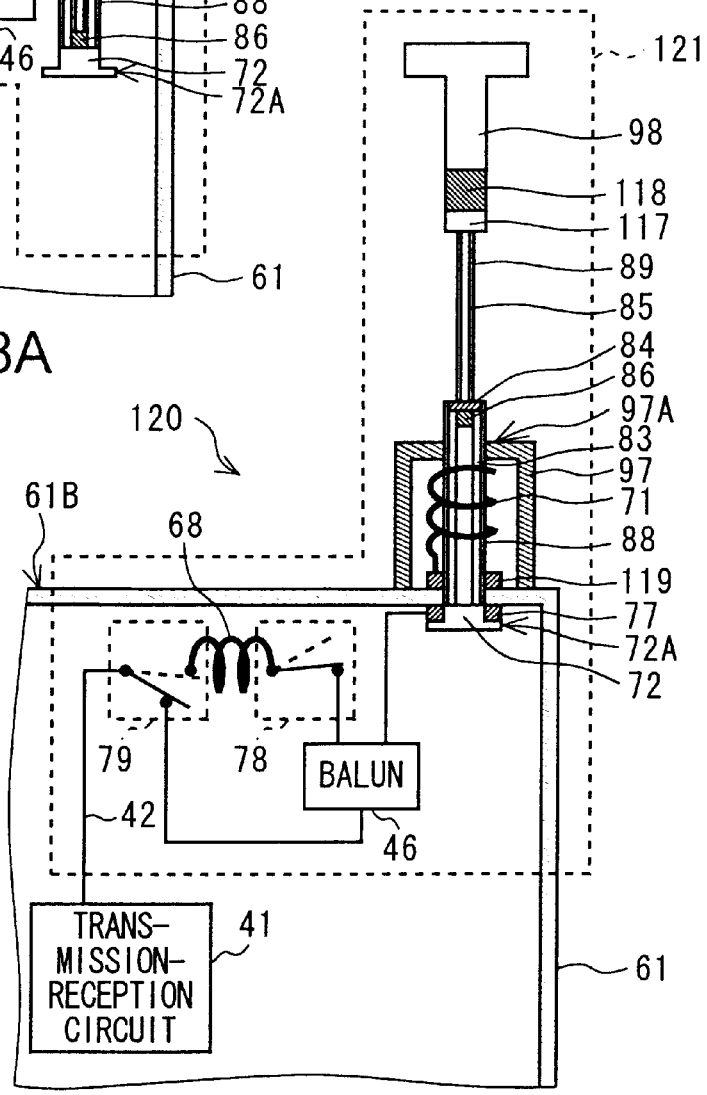

FIGS. 38A and 38B, in which the same numerals as in FIGS. 37A and 37B are given to show the corresponding portions, show a cellular telephone 120 according to the tenth practical embodiment, which is configured as in the cellular telephone 115 (FIGS. 34A and 34B) according to the above described ninth practical embodiment except the configuration of the antenna device 121.

Figure 39A:
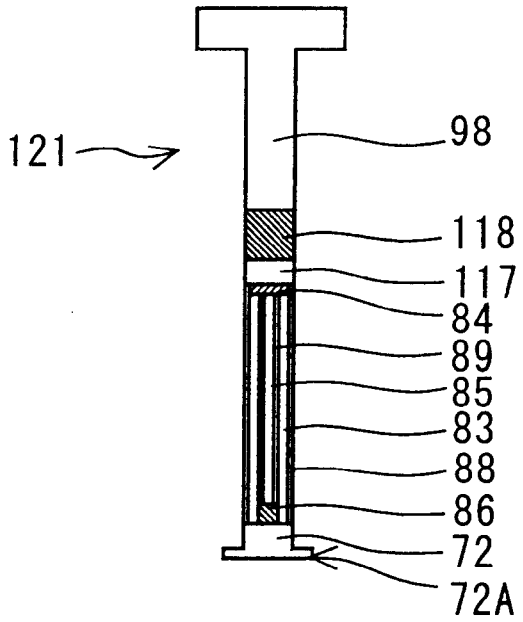
FIGS. 39A and 39B are schematic sectional views showing a configuration of a rod antenna.
Figure 39B:
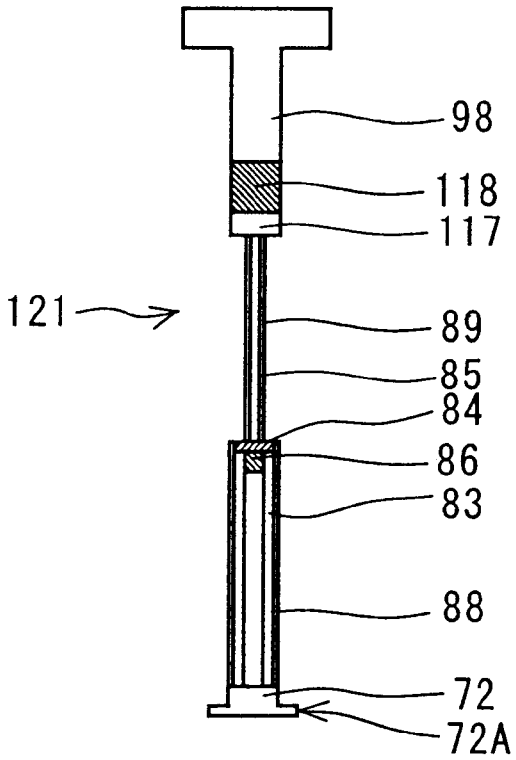

In FIGS. 39A and 39B in which the same numerals denotes the corresponding portions in FIGS. 37A and 37B as well as FIGS. 33A and 33B, the antenna device 121 has an elastic rod antenna 121, in which a second antenna half part 85 is inserted through into a first antenna half part 83 in such a fashion so as to be able to be retracted and pulled out freely, and the antenna member 118 is provided in the upper end of the second antenna half part 85 via the connecting section 117.

In addition, in the antenna device 121 (FIGS. 38A and 38B), at the time when the rod antenna 121 is retracted, when the antenna knob 98 is pushed toward the retracting direction, the rod antenna 121 is shortened in such a way that the second antenna half part 85 is thrust into the first antenna half side 83, and this shortened rod antenna 121 is thrust into inside the housing 61 for housing, at this time, the antenna member 118 is brought into electrical connection with the power supply member 119 for the helical and the antenna power supply terminal 77 so that this antenna member 118 and the second helical antenna 71 form the compound antenna.

In addition, in the antenna device 121, at the time when the rod antenna 121 is pulled out, the antenna knob 98 is pulled toward the pulling direction so that the protrusion 71A of the power supply member for the rod 72 is thrust onto the antenna power supply terminal 77, then the second antenna half part 85 is pulled out from the first antenna half part 83 to extend the rod antenna 121 to bring the power supply member for the rod 72 into electrical connection with the antenna power supply terminal 77.

Thus, in the cellular telephone 120, at the time when the rod antenna 121 is thrust, this rod antenna 121 is shortened so as to be thrust inside the housing 61 so that the portion of this rod antenna 121 to be thrust inside the housing 61 can be remarkably shortened compared with the cellular telephone 115 (FIGS. 37A and 37B) according to the above described ninth practical embodiment.

Accordingly, in this cellular telephone 120, even in the case where the rod antenna 121 can hardly be thrust inside the housing 61 due to the space occupied by the battery, etc., this rod antenna 121 can be installed easily.

(12) Other Practical Embodiments

Figure 40:
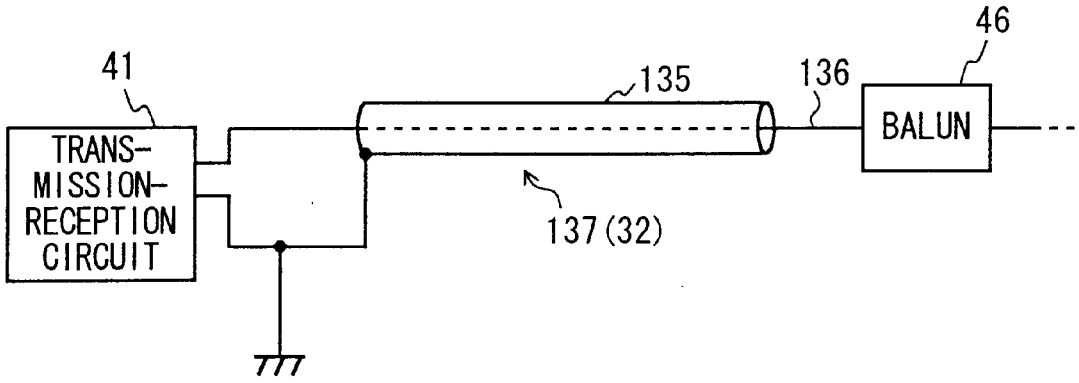
FIG. 40 is a schematic view showing a configuration of an unbalanced transmission line made of a coaxial cable according to another practical embodiment.

Incidentally, the above described first to tenth practical embodiments describe those cases where a micro-strip line 34 shown in FIG. 12 is applied as the unbalanced transmission line 42, but the present invention is not limited thereto, and otherwise various kinds of unbalanced transmission lines such as a coaxial cable 137 which is formed by a cylindrical external conductor 135 (that is, the ground side) as shown in FIG. 40 and a central conductor 136 (that is, the hot side) inserted into this external conductor 135 being insulated each other, and the like.

Figure 41A:
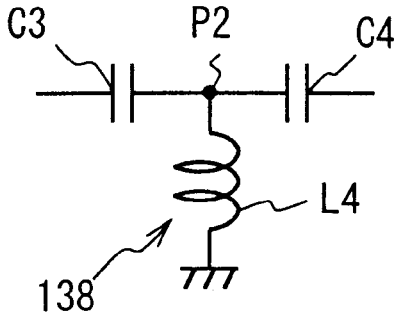
FIGS. 41A to 41C are block diagrams showing a configuration of a phasing circuit according to another practical embodiment.
Figure 41B:
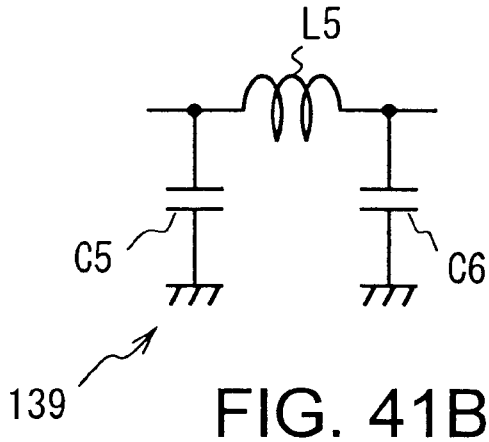
Figure 41C:
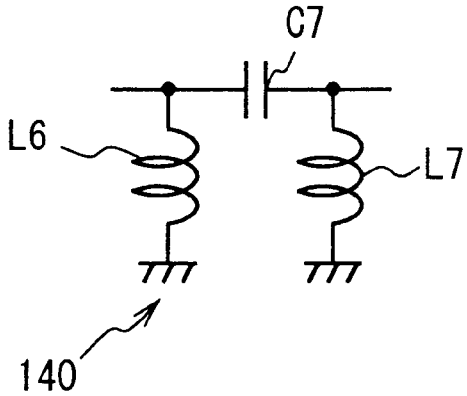

In addition, the above described first to tenth practical embodiments describe those cases where the phasing device 49 configured by assembling phasing circuits 50 shown in FIG. 16 in the balun 46 shown in FIG. 15 is arranged to be used, but the present invention is not limited thereto, and, as shown in FIGS. 41A to 41C, with phasing devices such as the one configured by assembling T-type phasing circuits 138 in a symmetrical configuration in each of which two capacitive reactance elements C3 and C4 are brought into connection in series having their connection middle point P2 with which one of inductive reactance element L4 is brought into conductive connection, and the other end of the above described inductive reactance element L4 is grounded, the one configured by assembling π-type phasing circuits 139 in a symmetrical configuration in each of which one ends of capacitive reactance elements C5 and C6 are respectively brought into conductive connection with one end and the other end of the inductive reactance element L5, and the other ends of the above described capacitive reactance elements C5 and C6 are grounded, and the one configured by assembling π-type phasing circuits 140 in a symmetrical configuration in each of which one ends of the inductive reactance elements L5 and L7 are respectively brought into conductive connection with one end and the other end of the capacitive reactance element C7, and the other ends of the above described inductive reactance elements L6 and L7 are grounded, the phase of the high frequency signals of which can be shifted around 180 degrees within the working frequency band, phasing devices in various kinds of configurations can be used.

Moreover, the above described first to tenth practical embodiments describes those cases where the balun 46 shown in FIG. 15 is used, but the present invention is not limited thereto, and baluns other than this in various kinds of configurations can be used if they can prevent the leakage current from flowing form the antenna of approximately balanced type to the ground side of the unbalanced transmission line 42.

Figure 42:
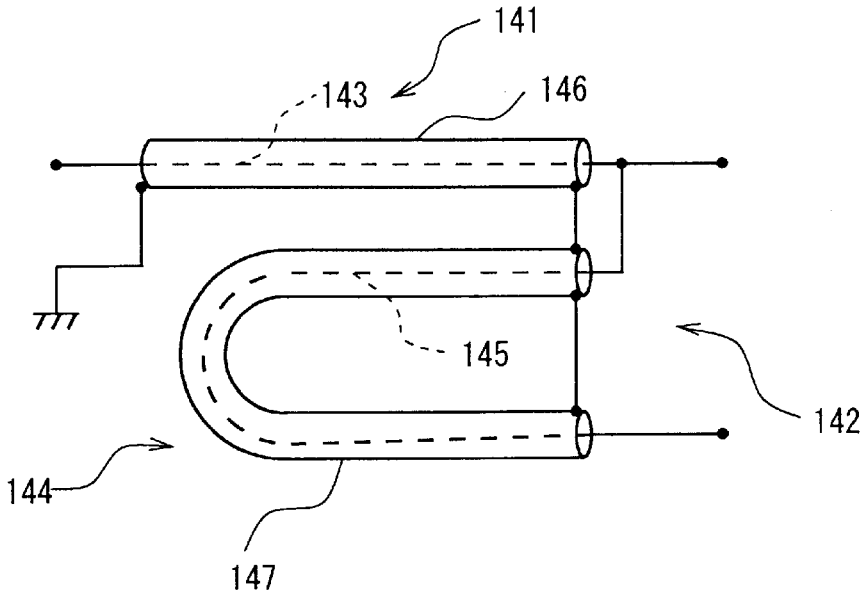
FIG. 42 is a schematic view showing a configuration of a balun according to another practical embodiment.

Actually, as this kind of balun, FIG. 42 shows a balun 142 in another configuration using the unbalanced transmission line 141 made of a coaxial cable, being configured by one end of the hot side 145 of the coaxial cable (this hereinafter to be referred to as a bypass line) 144 having an electrical length of a half wave length in the working frequency being brought into electrical connection with one end of the hot side of the unbalanced transmission line 141 and by one end of the ground side 147 of this bypass line 144 being brought into electrical connection with one end of the ground side 146 of the above described unbalanced line 141. That is, the balun 142 in such configuration is the one in which the bypass line 144 having electrical length of a half wavelength instead of the phasing device 49 of the balun 46 shown in FIG. 15.

In the balun 142 in such a configuration, the first antenna element of the antenna of approximately balanced type is brought into electrical connection with the one end of the hot side 143 of the unbalanced transmission line 141, and the second antenna element of this antenna of approximately balanced type is brought into electrical connection with the other end of the hot side 145 of the bypass line 144 so that the high frequency signals sent out to the first antenna element via the hot side 143 of the unbalanced transmission line 141 are also sent out via the hot side 145 of the bypass line 144 to the second antenna element with the phase being shifted by around 180 degrees against the first antenna element, and thereby the leakage current is to be prevented from flowing from the second antenna element to the ground side 146 of the unbalanced transmission line 141.

Figure 43:
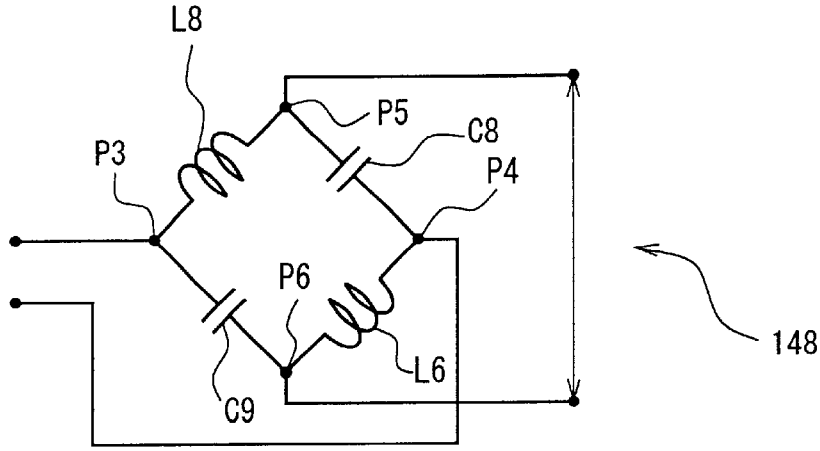
FIG. 43 is a schematic view showing a configuration of a balun according to another practical embodiment.

In addition, as this kind of balun, as shown in FIG. 43, there is the one, in which the first and second inductive reactance elements L8 and L9 and the first and second capacitive reactance elements C8 and C9 are connected sequentially alternately to form a ring, the hot side of the not-shown unbalanced transmission line is brought into electrical connection with the connecting middle-point P3 between the first inductive reactance element L8 and the second capacitive reactance element C9, the ground side of this unbalanced transmission line is brought into electrical connection with the connecting middle point 4 between the first capacitive reactance element C8 and the second inductive reactance element L9, the first antenna element of the antenna of the not-shown approximately unbalanced type is brought into electrical connection with the connecting middle point P5 between the first inductive reactance element L8 and the first capacitive reactance element C8, and the second antenna element of the antenna of this approximately balanced type is brought into electrical connection with the connecting middle point P6 between the second inductive reactance element L8 and the second capacitive reactance element C8 to configure so-called LG bridge balun.

In such configured balun 148, with the first and second inductive reactance elements L8 and L9 having respectively the same value, and with the first and second capacitive reactance elements C7 and C8 having respectively the same value, the above described inductance L and the capacitance C are configuring the following equation:

$$(2\pi f)^2 LC=1 \quad (1)$$

and, the following equation:

$$L/C=Z1Z2 \quad (2)$$

and they are selected to fulfill those equations so that the high frequency signals given from the hot side of the unbalanced transmission line are sent out without any changes from the connecting middle point P5 to the first antenna element, and these high frequency signals undergo phase shifting of around 180 degrees against the connecting middle point P5 within the working frequency band, and the obtained high frequency signals with shifted phases are sent out from the connecting middle point P6 to the second antenna element. Incidentally, Z1 represents impedance between the hot side and the ground side of the unbalanced transmission line, and Z2 represents impedance between the connecting points P5 and P6. Moreover, f represents a working frequency.

In addition, such a balun 148, which can be formed as a micro chip of around 1 mm cube as in the phasing device 49 of the balun 46 shown in the above described FIG. 15, can be easily installed in cellular telephones which tend to be miniaturized.

Figure 44A:
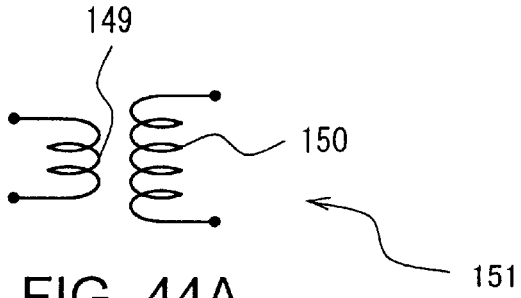
FIGS. 44A and 44B are schematic views showing a configuration of a balun according to another practical embodiment.
Figure 44B:
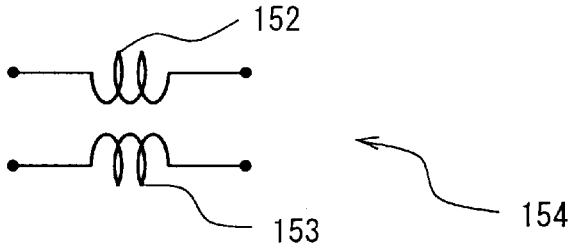

Moreover, as this kind of balun, as shown in FIGS. 44A and 44B, there are also a trans form balun 151 comprising an air-core coil 149 formed between the hot side and the ground side of the not-shown unbalanced transmission line and an air-core coil 150 formed between the first and second antenna elements of the antenna of approximately balanced type so that they are caused to face each other and a trans form balun 154 comprising an air-core coil 152 formed between the hot side of the unbalanced transmission line and the first antenna element of the antenna of approximately balanced type, and an air-core coil 153 formed between the ground side of the above described unbalanced transmission line and the second antenna element of the antenna of approximately balanced type so that they are caused to face each other.

Figure 45:
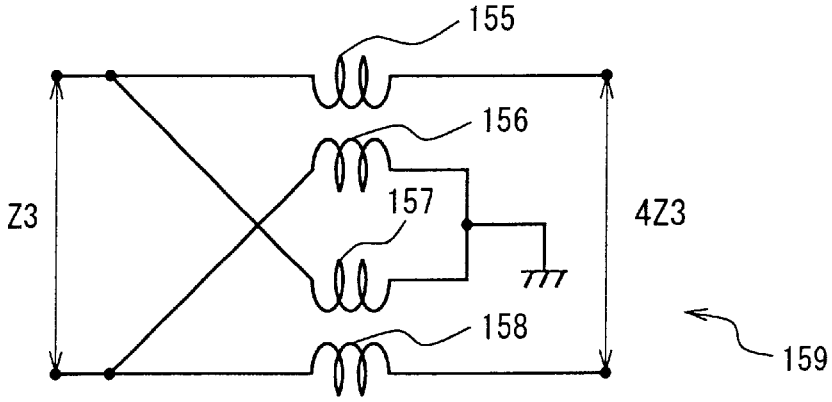
FIG. 45 is a schematic view showing a configuration of a balun according to another practical embodiment.

In addition, as this kind of balun, as shown in FIG. 45, there is also a trans form balun 159 comprising an air-core coil 155 formed between the hot side of the not-shown unbalanced transmission line and the first antenna element of the antenna of approximately balanced type and an air-core coil 156 formed between the ground side of the above described unbalanced transmission line and the ground so that they are caused to face each other and comprising an air-core coil 157 formed between the above described ground side and the second antenna element of the antenna of this approximately balanced type, and an air-core coil 158 formed between the hot side and the ground so that they are caused to face each other.

Incidentally, in such a trans form balun 159 configured as shown above, impedance between the connecting terminals of the first and second antenna elements will be larger by around four times (4Z3) than the impedance Z3 between the hot side and the ground side of the unbalanced transmission line.

Figure 46:
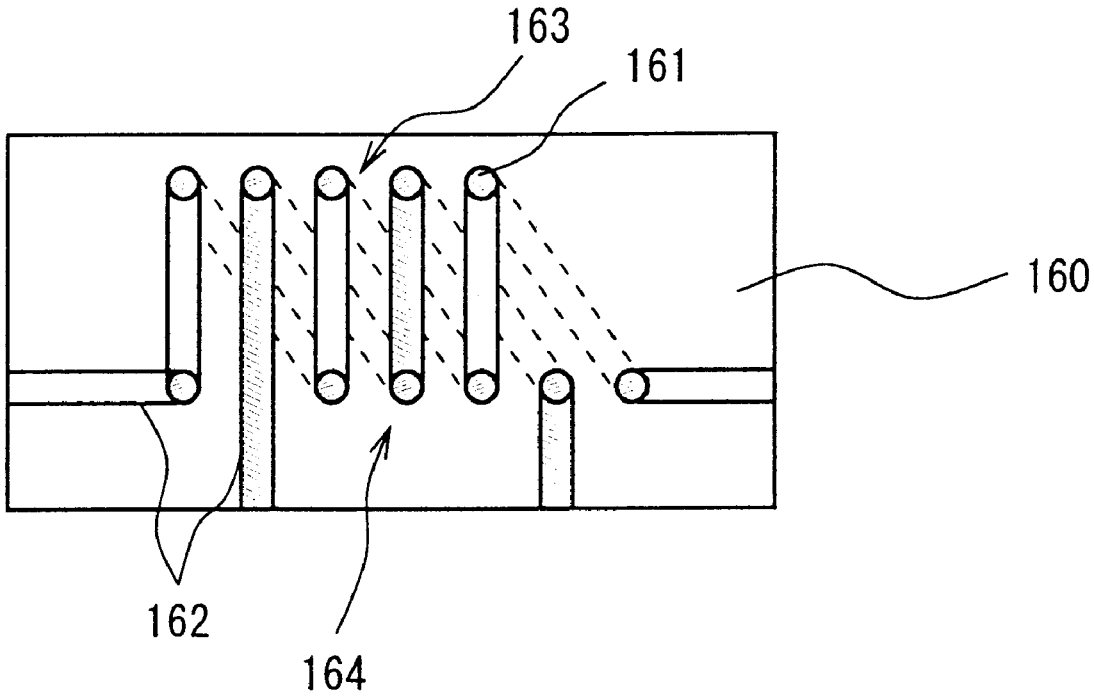
FIG. 46 is a top view showing a coil to be used in a balun of trans form.

In addition, in the trans form baluns 151, 154, and 159 as shown in FIGS. 44A and 44B and FIG. 45, instead of the air-core coils 149, 150, 152, 153, 155, 156, 157, and 158, a pair of coils 163 and 164 formed by a multi-layer wiring substrate 160, through-hole 161 and a conductive pattern 162 as shown in FIG. 46 can be used.

In addition, the trans form baluns 151, 154, and 159 can be formed by micro-chips of around one to three (mm) cube in their entirety when coils formed by integrating conductor pattern are thus used, and therefore can be installed easily even in the case where the space is limited as in the above described LC bridge balun 148 (FIG. 43).

Figure 47A:
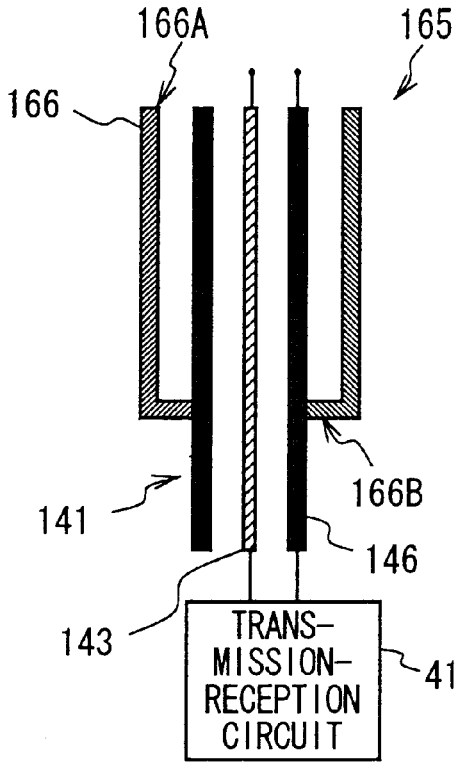
FIGS. 47A and 47B are schematic sectional views and a schematic view showing a configuration of a Sperrtopf balun using a coaxial cable according to another practical embodiment.
Figure 47B:
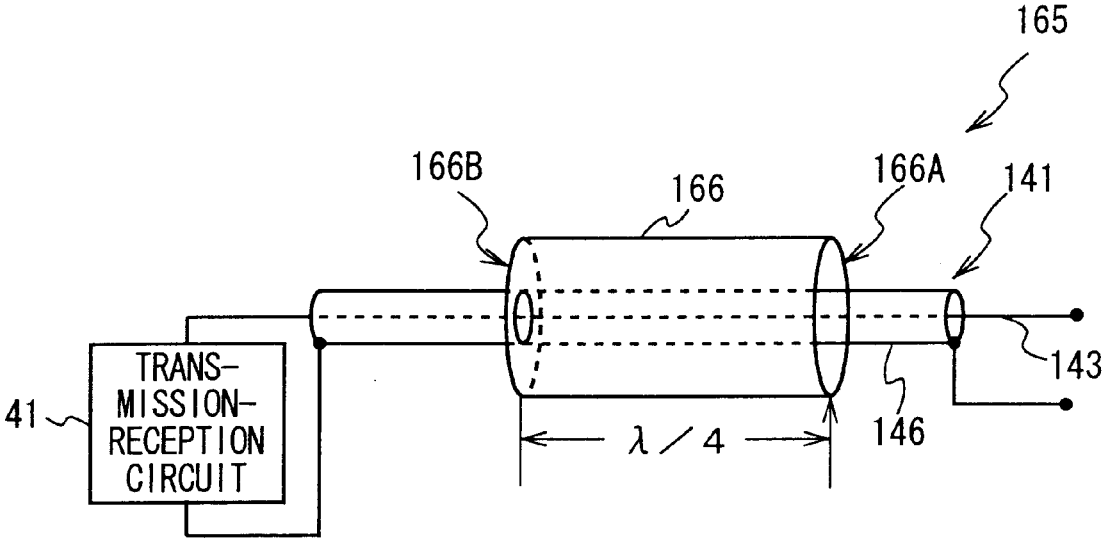

In addition, as this kind of balun, FIGS. 47A and 47B show a balun 165 in another configuration where the unbalanced transmission line 141 made of a coaxial cable is used, in which the unbalanced transmission line 141 is inserted through the cylindrical conductor 166 so that one end 166A of this cylindrical conductor 166 opens and the other end 166B is short-circuited with the ground side 146 of this unbalanced transmission line 141, which is also called as Sperrtophf balun or Bazooka balun.

In such configured balun 165, the first antenna element of the antenna of approximately balanced type is brought into electrical connection with the hot side 143 of the unbalanced transmission line 141 in the open side (balanced side) of the cylindrical conductor 166, the second antenna element of the antenna of approximately balanced type is brought into electrical connection with the ground side 146 of this unbalanced transmission line 141, and the transmission-reception circuit 41 is brought into electrical connection with the hot side 143 and the ground side 146 of the unbalanced transmission line 141 in the short-circuited side (unbalanced side) of the cylindrical conductor 166.

In addition, in this balun 165, since the cylindrical conductor 166 is selected to have electrical length of a quarter wave length of the working frequency, when the unbalanced side is looked at from the balanced side, in its entirety the unbalanced transmission line 141 becomes an inner conductor, and the cylindrical conductor 166 becomes an external conductor so as to give rise to a deemed transmission line of electric length of a quarter wave length in which one end is short-circuited so that the impedance becomes infinite against the leakage current and the leakage current can be prevented from flowing to the ground side 146 of the unbalanced transmission line 141.

Figure 48:
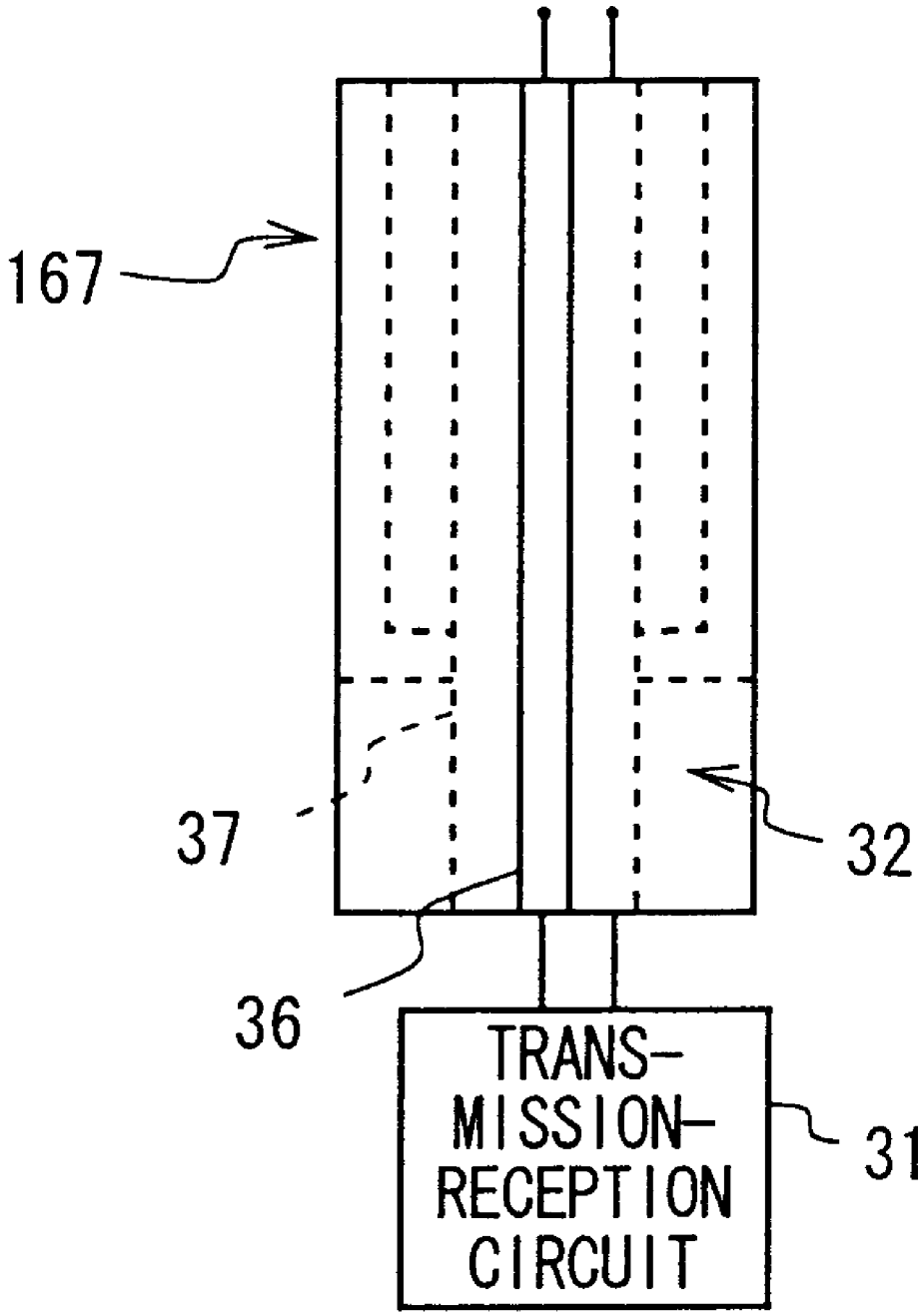
FIG. 48 is a schematic view showing a configuration of the Ho Sperrtopf balun using a micro-strip line according to another practical embodiment.

Incidentally, FIG. 48 is to show a Sperrtopf balun 167 using the unbalanced transmission line 42 made of a micro-strip line becomes equivalent to the Sperrtopf balun 165 shown in FIGS. 47A and 47B to operate likewise with the hot side 44 being formed as a line 80 as to resemble the central conductor of the coaxial cable and with the ground side 45 being formed so as to resemble the external conductor of the coaxial cable and the sectional view of the cylindrical conductor.

Figure 49:
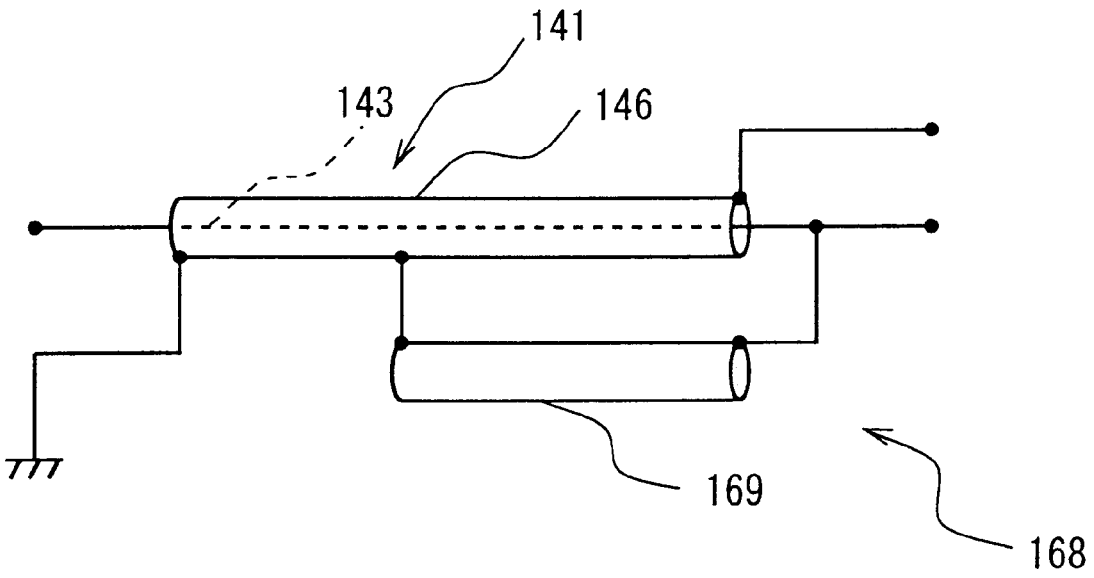
FIG. 49 is a schematic view showing a configuration of a balun according to another practical embodiment.

In addition, as a balun of this kind, FIG. 49 shows a balun 168 in anther configuration to be described by using the unbalanced transmission line 141 made of a coaxial cable, wherein the unbalanced transmission line 141 and a conductor (this hereinafter to be referred to as diverging conductor) 169 having electrical length of a quarter wave length are disposed so that the other ends thereof is trued up and one end of this diverging conductance 169 is brought into electrical connection with one end of the hot side 143 of the unbalanced transmission line 141, and the other end of the above described diverging conductor 169 is brought into electrical connection with the opposite location of the ground side 146 of this unbalanced transmission line 141 for configuration.

In the balun 168 in such a configuration, the first antenna element is brought into electrical connection with the other end of the hot side 143 of this unbalanced transmission line 141, and the second antenna element is brought into electrical connection with the other end of the ground side 146 of this unbalanced transmission line 141, so as to give rise to a circuit equivalent to the baluns 165 and 167 shown in the FIGS. 47A and 47B, and FIG. 48 described above, and to prevent the leakage current by making the impedance at the other end of the hot side 143 of the unbalanced transmission line 141 infinite as in these baluns 165 and 167.

Moreover, the above described first to tenth practical embodiments describe those cases where the antenna of approximately balanced type is used, but the present invention is not limited thereto, and antennas of balanced type which are completely symmetrical structurally and electrically and antennas which are completely non-symmetrical structurally and electrically in a medium excited figure can be arranged to be used. Incidentally, in the case where an antenna in the medium excited figure is used, the voltage figures in the first and the second antenna elements are different, and therefore, the baluns 165, 157, and 168 shown in FIG. 47A to FIG. 49 described above are to be used so that the leakage current can be prevented from flowing form the first or the second antenna element to the ground side of the unbalanced transmission line.

Figure 50A:
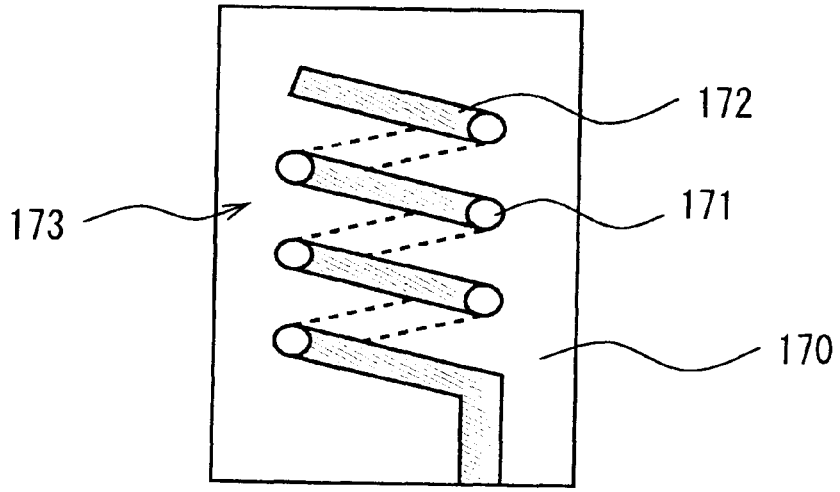
FIGS. 50A and 50B are schematic top views showing a configuration of an antenna element replacing first and second helical antennas according to another practical embodiment.
Figure 50B:
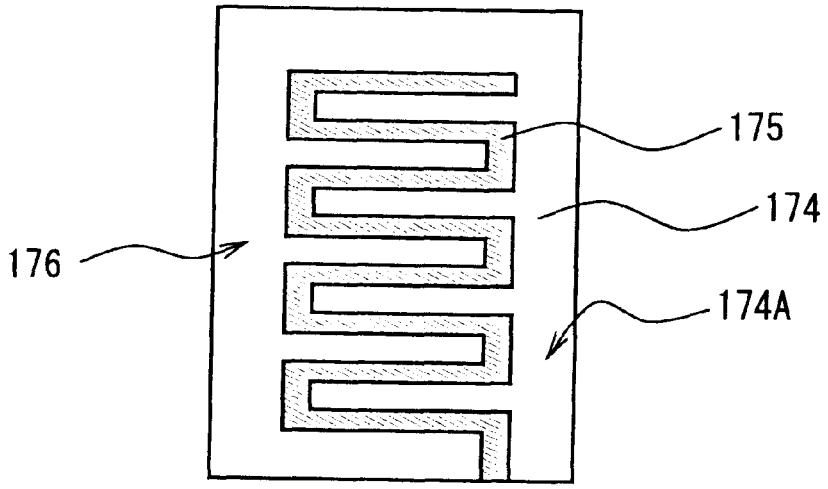

Moreover, the above described first to tenth practical embodiments describe the case where the first and the second helical antennas 68 and 71 with conductive line member being rolled spirally for forming are to be used, but the present invention is not limited thereto, and various kinds of antenna elements other than this, as shown in FIGS. 50A and 50B, such as the helical antenna 173 formed by the multi-layer wiring substrate 170, the through hole 171, and the conductor pattern 172 and the antenna element 176 with a conductor pattern 175 meandering on one surface 174A of the circuit substrate 174 for formation, and the like can be arranged to be used.

Figure 51A:
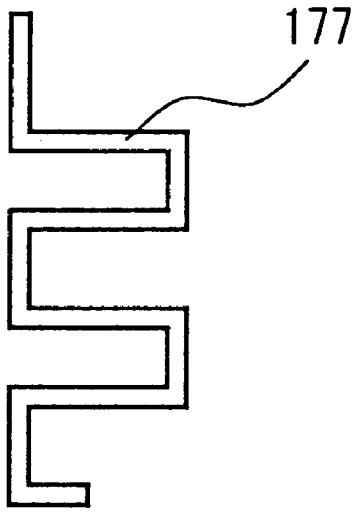
FIGS. 51A and 51B are schematic top views showing a configuration of a film form antenna element according to another practical embodiment.
Figure 51B:
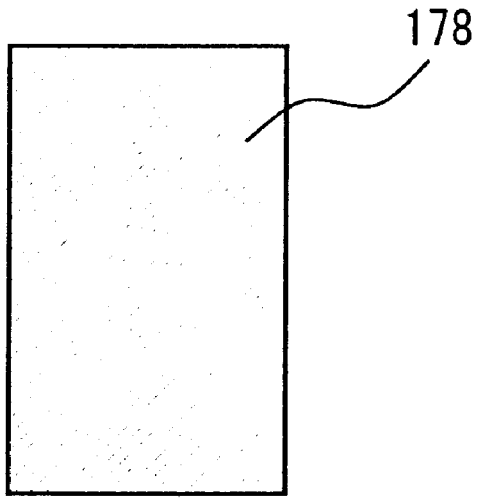

In addition, instead of the first and the second helical antennas 68 and 71, sheet antenna elements such as the above described thin line form antenna 94, and as shown in FIGS. 51A and 51B, the antenna element 177 with a conductive film meandering for formation, and the antenna element 178 squarely formed with conductive film and the like can be used inside or outside the housing 61, and such antenna elements can be used to prevent the housing 61 from getting bigger.

Figure 52:
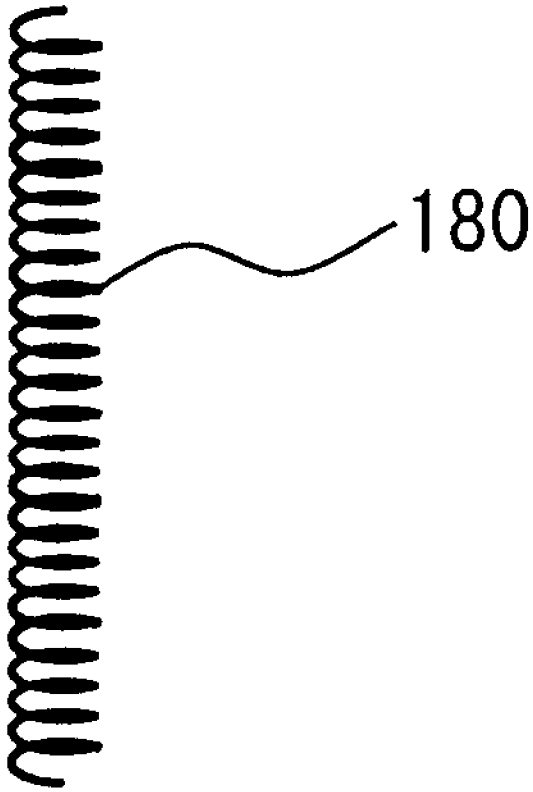
FIG. 52 is a schematic view showing a configuration of an antenna element replacing a rod antenna.

Moreover, the first practical embodiment, the third to fifth practical embodiments, the seventh practical embodiment, and the ninth practical embodiment described above describe those cases where the rod antenna 70 made of a conductive stick form line member is arranged to be used, but the present invention is not limited thereto, and various kinds of antenna elements other than this, as shown in FIG. 52, such as tight coil 180 to be used as an antenna element in which a conductive line member is tightly coiled spirally for formation to electrically become a cylindrical conductor, or the antenna element, etc., to be used which is formed with a predetermined conductor on the circuit substrate and the like can be arranged to be used. Incidentally, this tight coil 180 can be used as an antenna element so as to prevent destruction thereof even if it is bent when it is pulled out from the housing 61.

Incidentally, this tight coil 180 can be used as the first antenna half part 83 in the above described second and sixth practical embodiments, and the eighths and tenth practical embodiments, and when used as this first antenna half part 83, destruction thereof can be prevented as described above even if it is bent when it is pulled out from the housing 61.

Figure 53A:
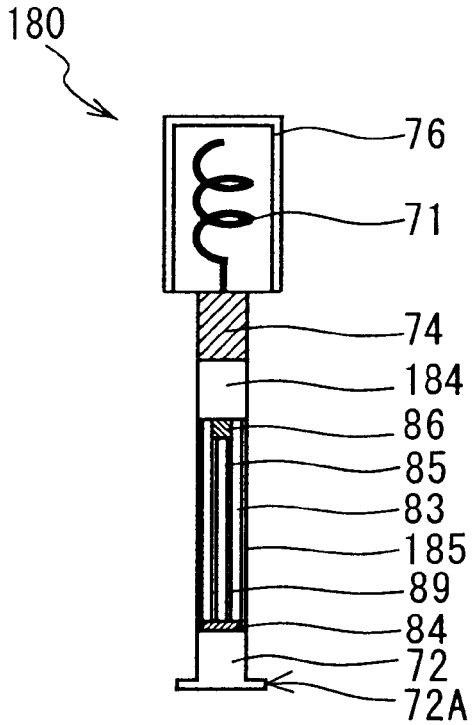
FIGS. 53A and 53B are schematic sectional views showing a configuration of an antenna section according to another practical embodiment.
Figure 53B:
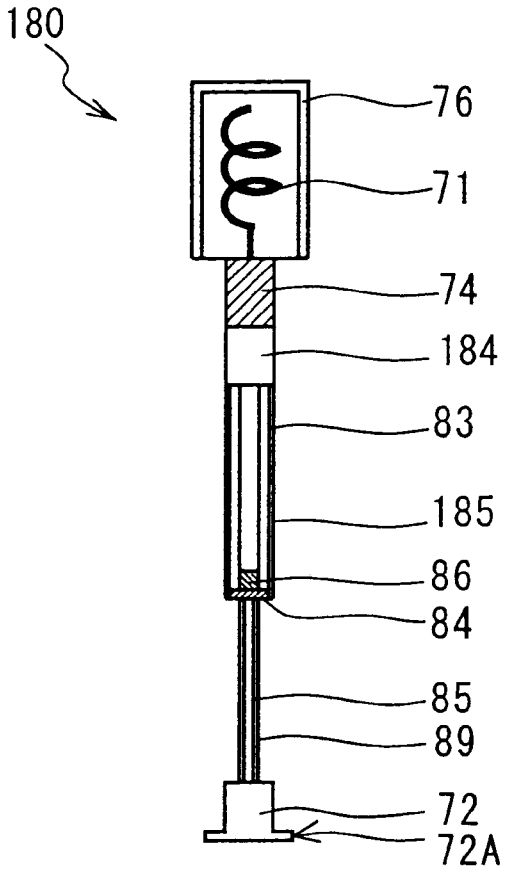
Figure 54A:
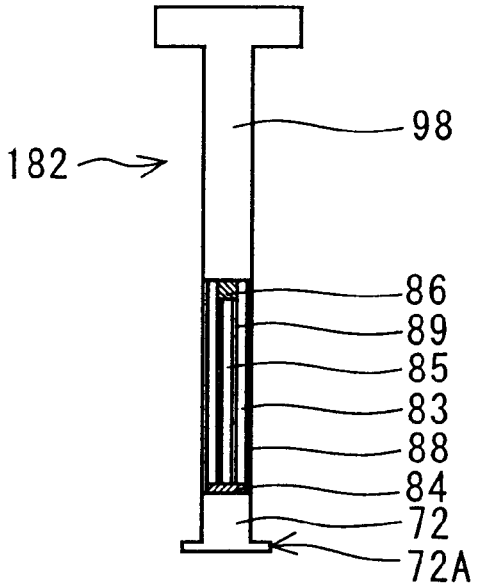
FIGS. 54A and 54B are schematic sectional views showing a configuration of a rod antenna according to another practical embodiment.
Figure 54B:
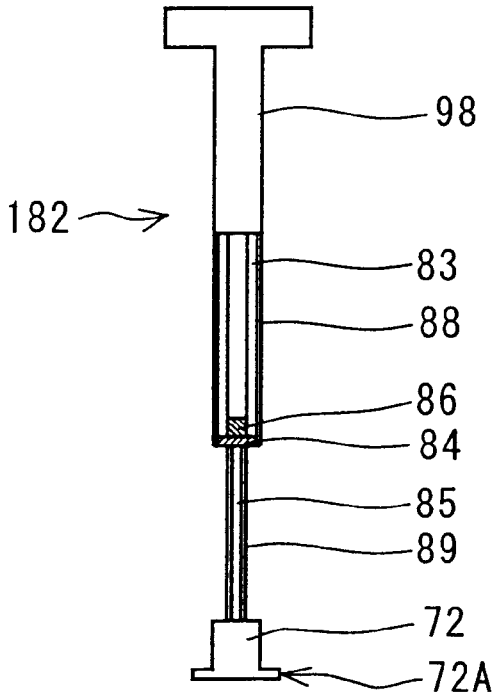
Figure 55A:
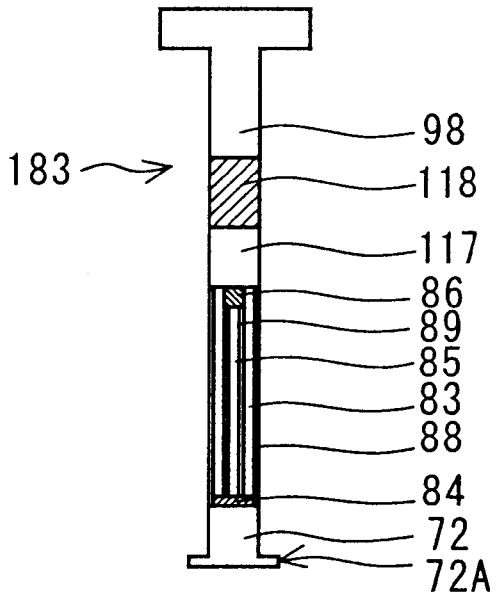
FIGS. 55A and 55B are schematic sectional views showing a configuration of the rod antenna according to another practical embodiment.
Figure 55B:
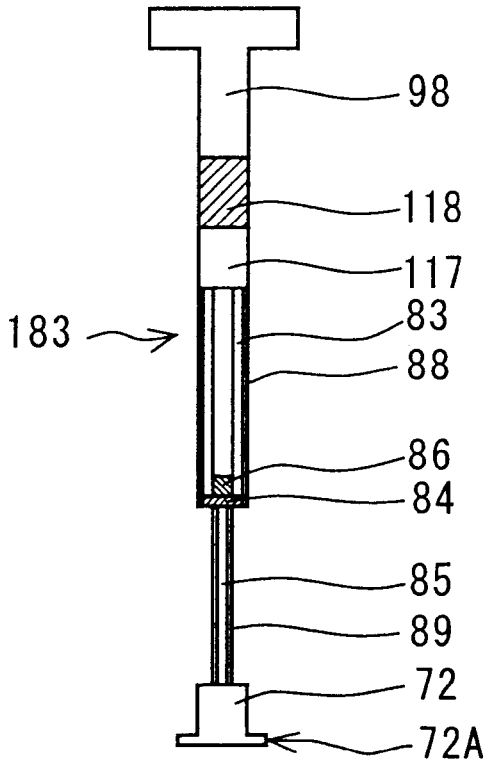

Moreover, the above described second, sixth, and tenth practical embodiments describe the case where the antenna section 82 in which elastic rod antenna is installed as shown in FIGS. 27A. and 27B and the elastic rod antennas 102 and 121 shown in FIGS. 33A and 33B FIGS. 39A and 39B are arranged to be used, but the present invention is not limited thereto, and the antenna section 181, in which an elastic rod antenna is installed so as to be configured as in FIGS. 53A and 53B, in which the same numerals as in FIGS. 27A and 27B are given to show the corresponding portions, the elastic rod antenna 182, which is configured as in FIGS. 54A and 54B, in which the same numerals as in FIGS. 33A and 33B are given to show the corresponding portions, and the elastic rod antenna 183, which is configured as in FIGS. 55A and 55B, in which the same numerals as in FIGS. 39A and 39B are given to show the corresponding portions can be arranged to be used.

Actually, in the antenna section 181 shown in FIGS. 53A and 53B, the power supply member for the rod 72 is brought into electrical and mechanical connection with the lower end of the second antenna half side 85, and the upper end is inserted into the cavity of the first antenna half part 83 and is brought into electrical and mechanical connection with the sliding spring 86. In addition, the stopper against overdrawing 84 is installed in the lower end of the first antenna half part 83, and the upper end is brought into electrical and mechanical connection with the power supply member for the helical 74 via the connecting section 184 made of non-conductive member. In addition, this first antenna half part 83 is covered with the antenna cover for the rod 185. Thereby, the antenna section 181 can form an elastic rod antenna with the first and the second antenna half parts 83 and 85 as in the antenna section 82 of the above described second practical embodiment.

In addition, in the rod antenna 182 shown in FIGS. 54A and 54B, the power supply member for the rod 72 is brought into electrical and mechanical connection with the lower end of the second antenna half part 85, and the upper end is inserted through the cavity of the first antenna half part 83 and is brought into electrical and mechanical connection with the sliding spring 86. In addition, the stopper for overdrawing 84 is installed in the lower end of the first antenna half part 83 and the antenna knob 98 is installed in the upper end thereof. Thereby this rod antenna 182 will be also configured to be elastic because of the first and the second antenna half parts 83 and 84 as in the above described sixth practical embodiment.

Moreover, in the rod antenna 183 shown in FIGS. 55A and 55B, the power supply member for the rod 72 is brought into electrical and mechanical connection with the lower end of the second antenna half part 85, and the upper end is inserted through the cavity of the first antenna half part 83 and is brought into electrical and mechanical connection with the sliding spring 86. In addition, the stopper for overdrawing 84 is installed in the lower end of the first antenna half part 83 and the upper end thereof is brought into mechanical connection with the connecting section 117. Thereby this rod antenna 183 will be also configured to be elastic because of the first and the second antenna half parts 83 and 84 as in the above described tenth practical embodiment.

Figure 56:
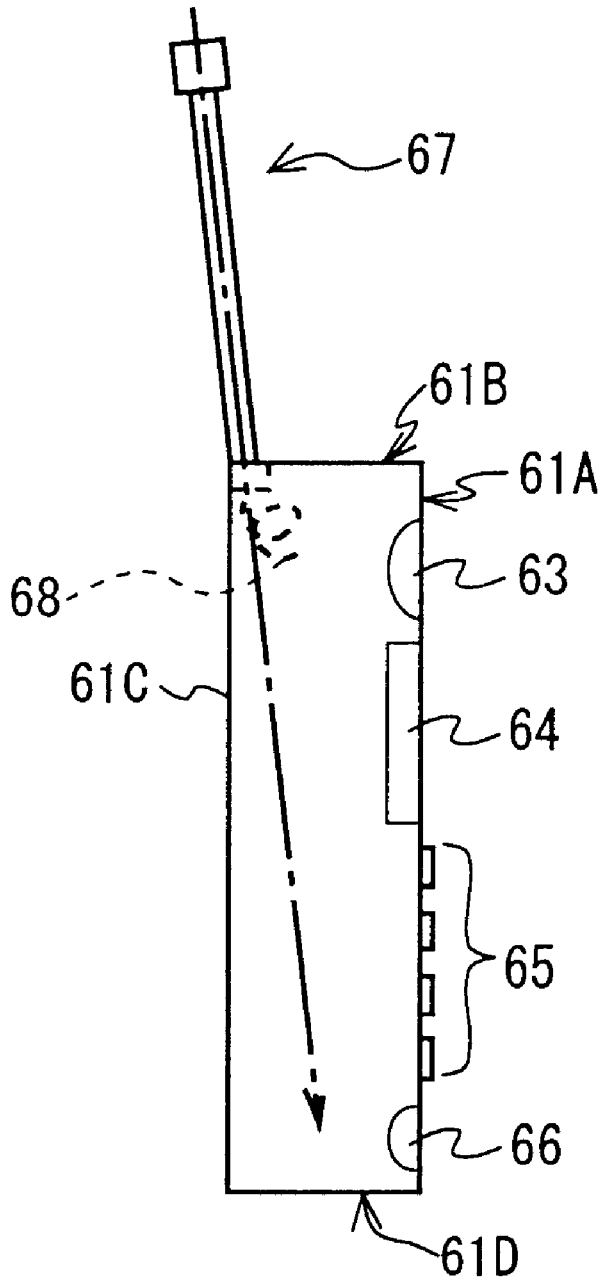
FIG. 56 is a schematic side view to be served to describe direction of retracting and pulling out an antenna section according to another practical embodiment.

Moreover, the above described first to tenth practical embodiments describe the case where the antenna section 67 and 82, and the rod antennas 70, 102, 112, and 121 are arranged to be installed in such a fashion so as to be thrust and pulled out freely approximately in parallel along the box elongated direction, but the present invention is not limited thereto, and as in FIG. 56 in which the same numerals as in FIGS. 22 are given to show the corresponding portions, the antenna section 67 (or antenna section 82, the rod antenna 70, 102, 112, and 121) can be arranged to be installed in such a fashion so as to be retracted and pulled out freely along the inclined direction from the side of the back surface 61C of the upper surface 61B of the housing 61 to the box elongated direction on the side of the front surface 61A in the lower surface 61D.

Thereby, even if the cellular telephone approaches the head of a user when the antenna sections 67 and 82 and the rod antennas 70, 102, 112, and 121 are pulled out, these antenna sections 67 and 82 and rod antennas 70, 102, 112, and 121 can be kept further remote from the head, and thus deterioration of the antenna characteristics of the cellular telephone in the vicinity of a human body can be further reduced.

Figure 57:
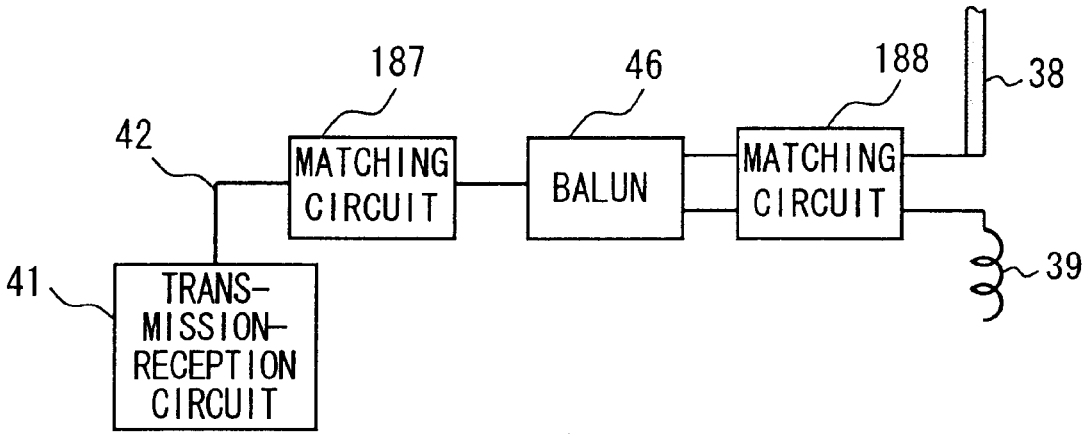
FIG. 57 is a block diagram to be served to describe disposition of a matching circuit according to another practical embodiment.

Moreover, the above described first to tenth practical embodiments, as described in the principle, describe the case where a matching circuit is provided between the transmission-reception circuit 41 and the balun 46 or between the balun 46 and the first and second antenna elements, but the present invention is not limited thereto, and as shown in FIG. 57, the matching circuits 187 and 186 can be arranged to be provided in the balanced side as well as the unbalanced side of the balun 46.

Figure 58:
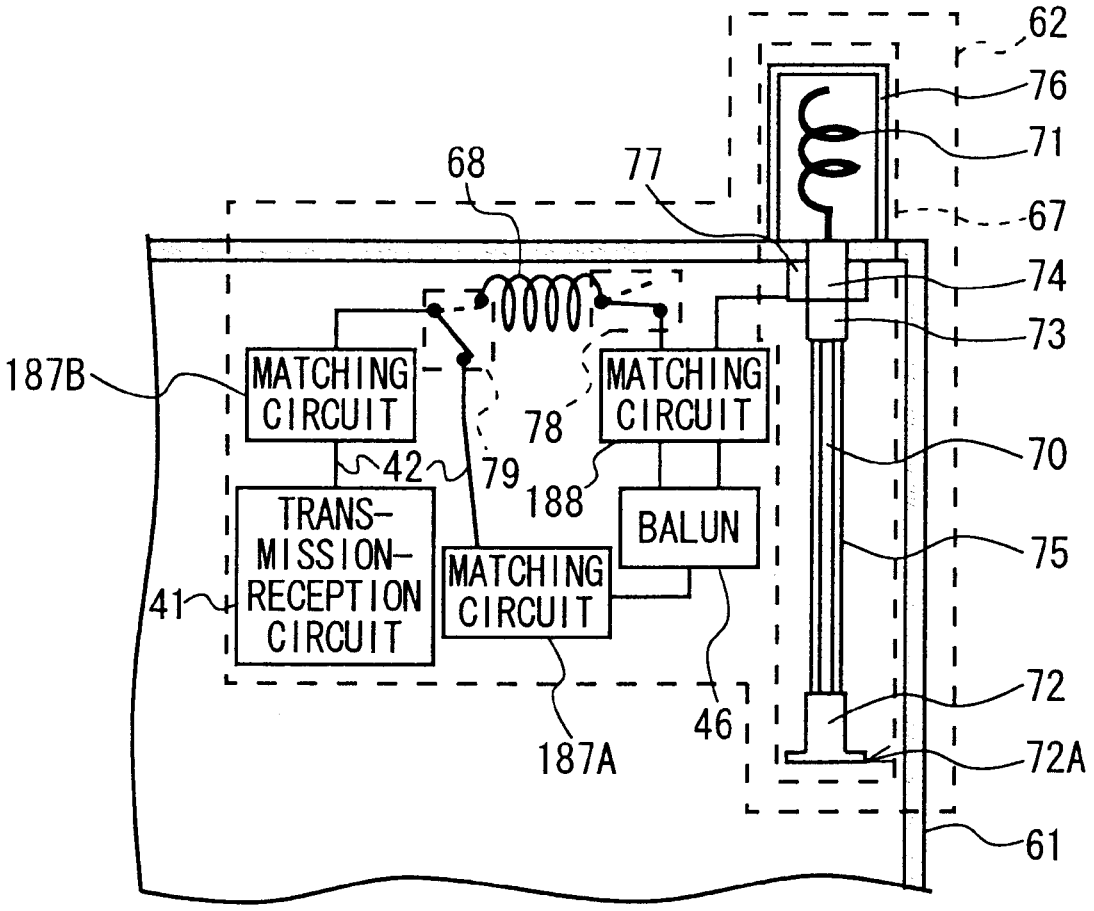
FIG. 58 is a block diagram to be served to describe disposition of a matching circuit according to another practical embodiment.

In addition, as in FIG. 58, in which the same numerals as in FIGS. 24A and 24B are given to show the corresponding portions, the matching circuits 187 of the unbalanced side of the balun 46 can be arranged to be divided into two matching circuits 187A and 187B for forming, with one matching circuit 187A being disposed between the unbalanced side of the balun 46 and the second switch 79 and with the other matching circuit 187B being disposed between the second switch 79 and the transmission-reception circuit 41.

Moreover, the above described first to tenth practical embodiments describe the case where balanced-to-unbalanced transforming function of the balun 46 prevents the leakage current from flowing from the second antenna element to the ground side of the unbalanced transmission line 42, but the present invention is not limited thereto, and such an arrangement can be made that the connection of the first and second antenna elements toward the terminal of the balanced side of the balun 46 is switched so that this balanced-to-unbalanced transforming function of the balun 46 prevents the leakage current from flowing from the first antenna element to the ground side of the unbalanced transmission line 42.

Figure 59:
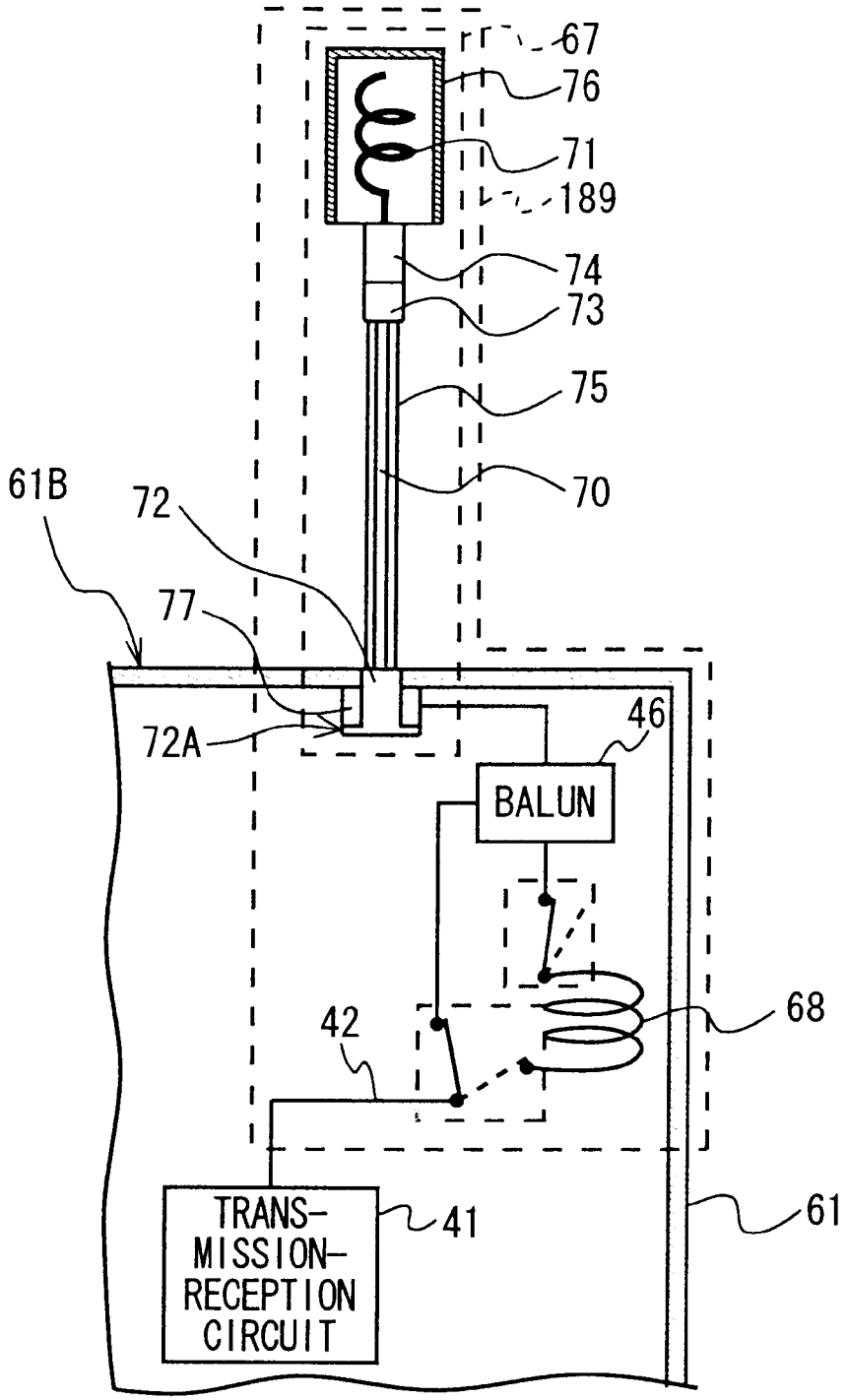
FIG. 59 is a block diagram to be served to describe disposition of a first helical antenna according to another practical embodiment.

Moreover, the above described third practical embodiment describes the case where the first helical antenna 68 has its first central axis to approximately correspond with the elongated line of the second central axis of the second helical antenna 71 and the rod antenna 70 to be disposed to insert therethrough, but the present invention is not limited thereto, and as in FIG. 59, in which the same numerals as in FIGS. 28A and 28B are given to show the corresponding portions, in the antenna device 189, the first helical antenna 68 can be arranged so that the first central axis is disposed approximately in parallel along the elongated line of the second central axis of the second helical antenna 71. Thereby, the antenna device 189 can be configured simply without necessity to implement complicated positioning to cause the rod antenna 70 to insert through the first helical antenna 68.

Figure 60:
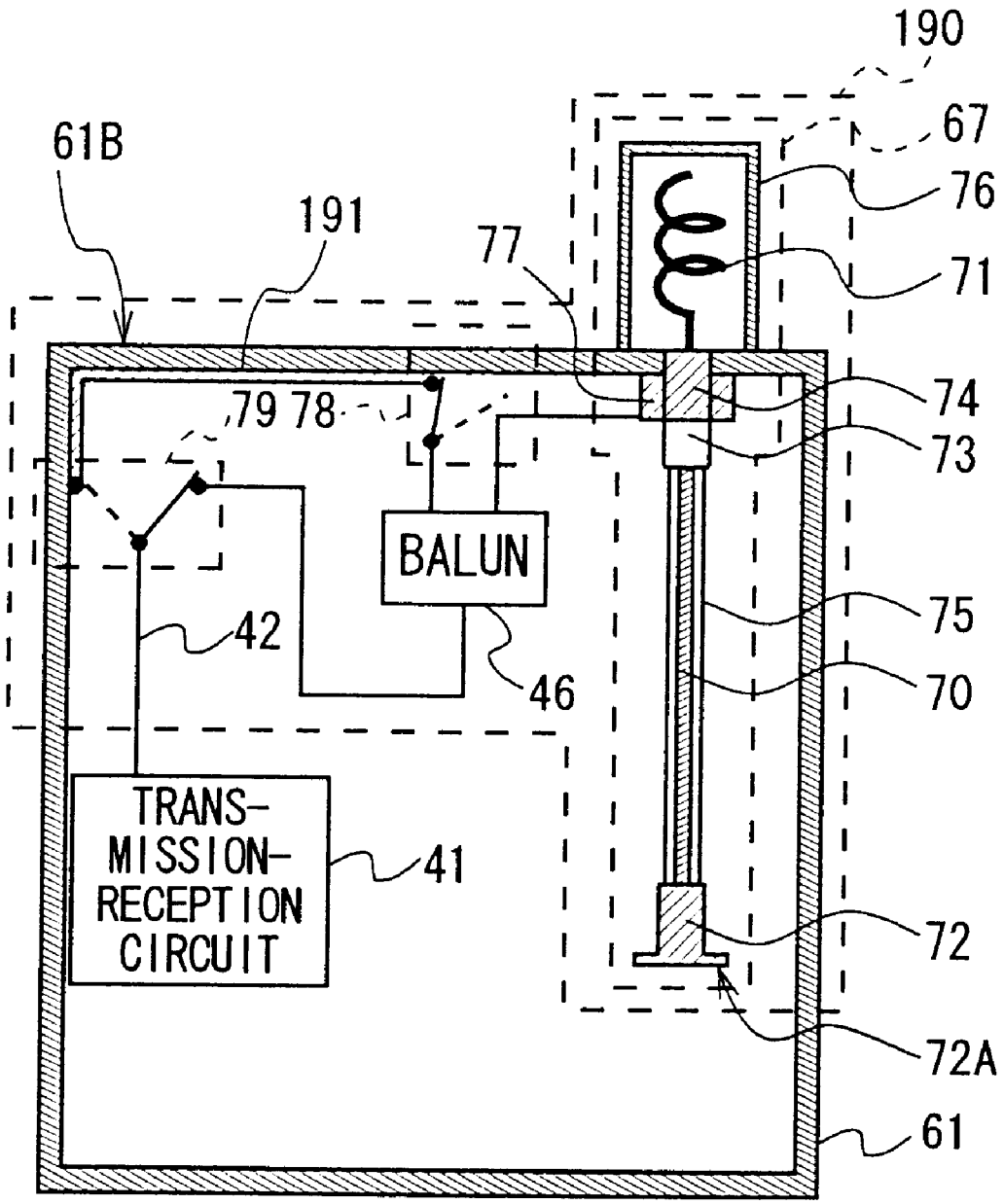
FIG. 60 is a block diagram to be served to describe disposition of a sheet line antenna according to another practical embodiment.

Moreover, the above described fourth practical embodiment describes the case where the sheet line antenna 94 is arranged to be stuck on the inner side of the upper surface 61B of the housing 61, but the present invention is not limited thereto, and as in FIG. 60, in which the same numerals as in FIGS. 29A and 29B are given to show the corresponding portions, in the antenna device 190, when the sheet line antenna 191 can hardly be stuck only on the inner part of the upper surface 61B of the housing 61 due to its electrical length, etc., such an arrangement can be made that one end side of this sheet line antenna 191 is stuck for example on the inner side of the upper surface 61B of the housing 61, and the other end side of this sheet line antenna 191 is stuck, in a fashion so as to be bent, on the inner side of the side surface 61E of this housing 61.

Moreover, the above described first and second practical embodiments, and the fourth to tenth practical embodiments describe the case where the first helical antenna 68 has the first central axis to be disposed approximately in parallel with the perpendicular direction and the sheet line antenna 94 has its elongated direction to be disposed approximately in parallel along the perpendicular direction of the box, but the present invention is not limited thereto, and such an arrangement can be made that the first helical antenna 68 has the first central axis to be inclined against the perpendicular direction of the box for disposition, and in addition the film form line antenna 94 has its elongated direction to be inclined against the perpendicular direction of the box for disposition.

Moreover, the above described fifth to tenth practical embodiments describe the case where the second helical antenna 71 is disposed so that the rod antennas 70, 102, 112, and 121 are thrust and pulled out along the second central axis, but the present invention is not limited thereto, and the second helical antenna 71 can be arranged to be disposed to have the second central axis approximately in parallel along the elongated direction of the rod antenna 70, 102, 112, and 121. Thereby, the antenna device can be configured simply without necessity to implement complicated positioning to cause the rod antenna 70, 102, 112, and 121 to insert through the second helical antenna 71.

Moreover, the above described first to tenth practical embodiments describe the case where the present invention is arranged to be applicable to the cellular telephones 60, 80, 90, 92, 95, 100, 105, 110, 115, 120 but the present invention is not limited thereto, and can be applied to various kinds of portable wireless devices other than this, such as portable wireless equipment for receiving purposes only and the cellular phones of cordless telephones, and the like.

Moreover, the above described first to tenth practical embodiments describe the case where the balun 46 is arranged to be applied as balanced-to-unbalanced transformation means for implementing balanced-to-unbalanced transforming function between the unbalanced transmission line and the first and second antenna elements, but the present invention is not limited thereto, and various kinds of balanced-to-unbalanced transformation means other than this such as the above described various kinds of baluns can be widely applied if they can implement balanced-to-unbalanced transforming function between the unbalanced transmission line and the first and second antenna elements.

Moreover, the above described first to tenth practical embodiments describe the case where the first and the second switch device 78 and 79 are applied as the switching means for selectively switching connections of the unbalanced transmission line with the first and the second antenna elements and with only the first antenna element so that at the time of reception, the first and second antenna elements are brought into connection with the unbalanced transmission line via the balanced-unbalanced transmission line, or only the first antenna element is brought into connection with the unbalanced transmission line, but the present invention is not limited thereto, and various kinds of switching means other than this can be widely applied if they can selectively switch connections of the unbalanced transmission line with the first and the second antenna elements and with only the first antenna element so that, at the time of reception, the first and second antenna elements are brought into connection with the unbalanced transmission line via the balanced-unbalanced transmission line, or only the first antenna element is brought into connection with the unbalanced transmission line.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. An antenna device of a diversity reception system, comprising:

a first antenna element installed so as to be retracted and pulled out freely;

a fixed second antenna element;

an unbalanced transmission line for supplying said first and second antenna elements with power;

balancing-unbalancing transformation means for implementing balancing-unbalancing transformation action between said unbalanced transmission line and said first and second antenna elements; and switching means for selectively switching connections of said unbalanced transmission line with said first and second antenna elements and with only said first antenna element so that, at the time of reception, said first and second antenna elements are brought into connection with said unbalanced transmission line via said balancing-unbalancing transformation means, or only said second antenna element is brought into connection with said unbalanced transmission line, wherein said switching means are arranged to bring said unbalanced transmission line into connection with said the first and second antenna elements via said balancing-unbalancing transformation means so that said unbalanced transmission line supplies said first and second antenna elements with power via said balancing-unbalancing transformation means so as to operate said first and second antenna elements as an antenna.

2. The antenna device according to claim 1, wherein said switching means causes said first and second antenna elements to operate as an antenna at the time of transmission, when said unbalanced transmission line is brought into connection with said first and second antenna elements via said balancing-unbalancing transformation means so that said unbalanced transmission line supplies said first and second antenna elements with power.

3. The antenna device according to claim 2, wherein said first antenna element has a stick form rod antenna provided so as to be retracted and pulled out freely, and said second antenna element is configured by a spiral-formed fixed helical antenna to be disposed so that a central axis of a spiral is made approximately perpendicular to an elongated direction of said rod antenna.

4. The antenna device according to claim 2, wherein said first antenna element has a stick form rod antenna provided so as to be retracted and pulled out freely, and said second antenna element is configured by a spiral-formed fixed helical antenna to be disposed so that said rod antenna is thrust and pulled out along a central axis of a spiral of said helical antenna.

5. The antenna device according to claim 2, wherein said first antenna element has a stick form rod antenna provided so as to be retracted and pulled out freely, and said second antenna element is configured by a spiral-formed fixed helical antenna to be disposed so that a central axis of said rod antenna is to be approximately perpendicular to an elongated direction of said rod antenna.

6. The antenna device according to claim 2, wherein said first antenna element comprises a stick form rod antenna provided so as to be retracted and pulled out freely, and said second antenna element comprises a first spiral-formed fixed helical antenna, and further comprising a second spiral-formed fixed second helical antenna, wherein at least one end of said second helical antenna is brought into electrical connection with said rod antenna so that a compound antenna is formed when said rod antenna is retracted or pulled out.

7. The antenna device according to claim 6, wherein said second helical antenna is disposed so that said rod antenna is thrust or pulled out along a central axis of a spiral of said helical antenna.

8. The antenna device according to claim 6, wherein said second helical antenna is disposed so that a central axis of a spiral of said helical antenna is approximately parallel to an elongated direction of said rod antenna.

9. The antenna device according to claim 6, wherein said rod antenna is formed of elastic material so as to comprise a conductive cylindrical member having a cavity through which a conductive stick form member is inserted.

10. A portable radio set having an antenna device of a diversity reception system, wherein said antenna device comprises:

a first antenna element installed so as to be retracted and pulled out freely;

a fixed second antenna element;

an unbalanced transmission line for supplying said first and second antenna elements with power;

balancing-unbalancing transformation means for implementing balancing-unbalancing transformation action between said unbalanced transmission line and said first and second antenna elements;

switching means for selectively switching connections of said unbalanced transmission line with said first and second antenna elements and with only said first antenna element so that, at the time of reception, said first and second antenna elements are brought into connection with said unbalanced transmission line via said balancing-unbalancing transformation means, or only said second antenna element is brought into connection with said unbalanced transmission line; and said switching means are arranged to bring said unbalanced transmission line into connection with said the first and second antenna elements via said balancing-unbalancing transformation means so that said unbalanced transmission line supplies said first and second antenna elements with power via said balancing-unbalancing transformation means so as to operate said first and second antenna elements as an antenna.

11. The portable radio set according to claim 10, wherein in said antenna device, said switching means cause said first and second antenna elements to operate as an antenna at a time of transmission, when said unbalanced transmission line is brought into connection with said first and second antenna elements via said balanced-unbalanced transmission line by means of said switching means so that said unbalanced transmission line supplies said first and second antenna elements with power via said balancing-unbalancing transformation means.

12. The portable radio set according to claim 11, wherein said first antenna element comprises a stick form rod antenna provided so as to be retracted and pulled out freely, and said second antenna element is configured by a spiral-formed fixed helical antenna, and is disposed so that a central axis of a spiral of said helical antenna is approximately parallel to an elongated direction of said rod antenna.

13. The portable radio set according to claim 11, wherein said first antenna element comprises a stick form rod antenna provided so as to be retracted and pulled out freely, and said second antenna element is configured by a spiral-formed fixed helical antenna, and is disposed so that said rod antenna is thrust or pulled out along a central axis of a spiral of said helical antenna.

14. The portable radio set according to claim 11, wherein said first antenna element comprises a stick form rod antenna provided so as to be retracted and pulled out freely, and said second antenna element is configured by a spiral-formed fixed helical antenna, and is disposed so that a central axis of a spiral of said helical antenna is approximately parallel to an elongated direction of said rod antenna.

15. The portable radio set according to claim 11, wherein said first antenna element comprises a stick form rod antenna provided so as to be retracted and pulled out freely, and said second antenna element comprises a first spiral-formed fixed helical antenna, and further comprising a second spiral-formed fixed second helical antenna, wherein at least one end of said second helical antenna is brought into electrical connection with said rod antenna so that a compound antenna is formed at a time when said rod antenna is retracted or pulled out.

16. The portable radio set according to claim 15, wherein said second helical antenna is disposed so that said rod antenna is thrust or pulled out along a central axis of a spiral of said helical antenna.

17. The portable radio set according to claim 15, wherein said second helical antenna is disposed so that said central axis of a spiral of said helical antenna is approximately parallel to an elongated direction of said rod antenna.

18. The portable radio set according to claim 15, wherein said rod antenna is formed of elastic material so as to comprise a conductive cylindrical member having a cavity through which a conductive stick form member is inserted.

* * * * *